US011224895B2

(12) United States Patent
Brown et al.

(10) Patent No.: US 11,224,895 B2
(45) Date of Patent: Jan. 18, 2022

(54) COMPACT ULTRASOUND DEVICE HAVING ANNULAR ULTRASOUND ARRAY PERIPHERALLY ELECTRICALLY CONNECTED TO FLEXIBLE PRINTED CIRCUIT BOARD AND METHOD OF ASSEMBLY THEREOF

(71) Applicant: Ulthera, Inc., Mesa, AZ (US)

(72) Inventors: Jeremy A. Brown, Halifax (CA); Jeffrey R. Leadbetter, Dartmouth (CA); Charles D. Emery, Gilbert, AZ (US)

(73) Assignee: Ulthera, Inc., Mesa, AZ (US)

( * ) Notice: Subject to any disclaimer, the term of this patent is extended or adjusted under 35 U.S.C. 154(b) by 738 days.

(21) Appl. No.: 16/069,319

(22) PCT Filed: Jan. 16, 2017

(86) PCT No.: PCT/US2017/013657
§ 371 (c)(1),
(2) Date: Jul. 11, 2018

(87) PCT Pub. No.: WO2017/127328
PCT Pub. Date: Jul. 27, 2017

(65) Prior Publication Data

US 2019/0022700 A1 Jan. 24, 2019

Related U.S. Application Data

(60) Provisional application No. 62/280,038, filed on Jan. 18, 2016.

(51) Int. Cl.
*B06B 1/06* (2006.01)

(52) U.S. Cl.
CPC ..... *B06B 1/0625* (2013.01)

(58) Field of Classification Search
CPC ..... B06B 1/0625
See application file for complete search history.

(56) References Cited

U.S. PATENT DOCUMENTS 2,427,348 A 9/1947 Bond et al.
2,792,829 A 2/1952 Calosi
(Continued)

FOREIGN PATENT DOCUMENTS

CN 2460061 11/2001
CN 1734284 12/2009
(Continued)

OTHER PUBLICATIONS

US 10,398,895 B2, 09/2019, Schwarz (withdrawn)
(Continued)

*Primary Examiner* — Shawki S Ismail
*Assistant Examiner* — Monica Mata
(74) *Attorney, Agent, or Firm* — Knobbe Martens Olson & Bear LLP

(57) ABSTRACT

Ultrasound devices, and associated methods of assembly thereof, are disclosed whereby an annular electrode array of an ultrasound transducer is electrically connected to a flexible printed circuit board in a compact configuration. The flexible circuit board includes an elongate flexible segment and a distal distribution segment, where the distribution segment is attached to a peripheral support ring that surrounds at least a portion of the ultrasound transducer. The distribution segment includes a plurality of spatially distributed contact pads, and electrical connections are provided between the contact pads and the annular electrodes of the annular array. A backing material may be provided that contacts and extends from the annular array electrodes, and a distal portion of the elongate flexible segment may be encapsulated in the backing material, such that the distal
(Continued)

portion extends inwardly from the peripheral support ring, without contacting the electrical connections and without contacting the array surface.

19 Claims, 18 Drawing Sheets

(56) References Cited

U.S. PATENT DOCUMENTS 3,913,386 A 10/1975 Saglio
3,965,455 A 6/1976 Hurwitz
3,992,925 A 11/1976 Perilhou
4,039,312 A 8/1977 Patru
4,059,098 A 11/1977 Murdock
4,101,795 A 7/1978 Fukumoto
4,151,834 A 5/1979 Sato et al.
4,166,967 A 9/1979 Benes et al.
4,211,948 A 7/1980 Smith et al.
4,211,949 A 7/1980 Brisken et al.
4,213,344 A 7/1980 Rose
4,276,491 A 6/1981 Daniel
4,315,514 A 2/1982 Drewes et al.
4,325,381 A 4/1982 Glenn
4,343,301 A 8/1982 Indech
4,372,296 A 2/1983 Fahim
4,379,145 A 4/1983 Masuho et al.
4,381,007 A 4/1983 Doss
4,381,787 A 5/1983 Hottinger
4,397,314 A 8/1983 Vaguine
4,409,839 A 10/1983 Taenzer
4,417,170 A 11/1983 Benisncasa
4,431,008 A 2/1984 Wanner et al.
4,441,486 A 4/1984 Pounds
4,452,084 A 6/1984 Taenzer
4,484,569 A 11/1984 Driller
4,507,582 A 3/1985 Glenn
4,513,749 A 4/1985 Kino
4,513,750 A 4/1985 Heyman et al.
4,527,550 A 7/1985 Ruggera et al.
4,528,979 A 7/1985 Marchenko
4,534,221 A 8/1985 Fife et al.
4,566,459 A 1/1986 Umemura et al.
4,567,895 A 2/1986 Putzke
4,586,512 A 5/1986 Do-Huu
4,587,971 A 5/1986 Stolfi
4,601,296 A 7/1986 Yerushalmi
4,620,546 A 11/1986 Aida et al.
4,637,256 A 1/1987 Sugiyama et al.
4,646,756 A 3/1987 Watmough
4,663,358 A 5/1987 Hyon
4,668,516 A 5/1987 Duraffourd et al.
4,672,591 A 6/1987 Breimesser et al.
4,680,499 A 7/1987 Umemura et al.
4,697,588 A 10/1987 Reichenberger
4,754,760 A 7/1988 Fukukita et al.
4,757,820 A 7/1988 Itoh
4,771,205 A 9/1988 Mequio
4,801,459 A 1/1989 Liburdy
4,803,625 A 2/1989 Fu et al.
4,807,633 A 2/1989 Fry
4,817,615 A 4/1989 Fukukita et al.
4,858,613 A 8/1989 Fry
4,860,732 A 8/1989 Hasegawa et al.
4,865,041 A 9/1989 Hassler
4,865,042 A 9/1989 Umemura
4,867,169 A 9/1989 Machida
4,874,562 A 10/1989 Hyon
4,875,487 A 10/1989 Seppi
4,881,212 A 11/1989 Takeuchi
4,891,043 A 1/1990 Zeimer et al.
4,893,624 A 1/1990 Lele
4,896,673 A 1/1990 Rose
4,900,540 A 2/1990 Ryan et al.
4,901,729 A 2/1990 Saitoh
4,917,096 A 4/1990 Englehart
4,932,414 A 6/1990 Coleman et al.
4,938,216 A 7/1990 Lele
4,938,217 A 7/1990 Lele
4,947,046 A 8/1990 Kawabata et al.
4,951,653 A 8/1990 Fry
4,955,365 A 9/1990 Fry
4,958,626 A 9/1990 Nambu
4,976,709 A 12/1990 Sand
4,979,501 A 12/1990 Valchanov
4,992,989 A 2/1991 Watanabe et al.
5,012,797 A 5/1991 Liang
5,018,508 A 5/1991 Fry et al.
5,030,874 A 7/1991 Saito et al.
5,036,855 A 8/1991 Fry
5,040,537 A 8/1991 Katakura
5,054,310 A 10/1991 Flynn
5,054,470 A 10/1991 Fry
5,054,491 A 10/1991 Saito et al.
5,070,879 A 12/1991 Herres
5,088,495 A 2/1992 Miyagawa
5,115,814 A 5/1992 Griffith
5,117,832 A 6/1992 Sanghvi
5,123,418 A 6/1992 Saurel
5,142,511 A 8/1992 Kanai et al.
5,143,063 A 9/1992 Fellner
5,143,074 A 9/1992 Dory
5,149,319 A 9/1992 Unger
5,150,711 A 9/1992 Dory
5,150,714 A 9/1992 Green
5,152,294 A 10/1992 Mochizuki et al.
5,156,144 A 10/1992 Iwasaki
5,158,536 A 10/1992 Sekins
5,159,931 A 11/1992 Pini
5,163,421 A 11/1992 Bernstein
5,163,436 A 11/1992 Saitoh et al.
5,178,135 A 1/1993 Uchiyama et al.
5,190,518 A 3/1993 Takasu
5,190,766 A 3/1993 Ishihara
5,191,880 A 3/1993 McLeod
5,205,287 A 4/1993 Erbel et al.
5,209,720 A 5/1993 Unger
5,212,671 A 5/1993 Fujii et al.
5,215,680 A 6/1993 D'Arrigo
5,224,467 A 7/1993 Oku
5,230,334 A 7/1993 Klopotek
5,230,338 A 7/1993 Allen et al.
5,247,924 A 9/1993 Suzuki et al.
5,255,681 A 10/1993 Ishimura et al.
5,257,970 A 11/1993 Dougherty
5,265,614 A 11/1993 Hayakawa
5,267,985 A 12/1993 Shimada
5,269,297 A 12/1993 Weng
5,282,797 A 2/1994 Chess
5,295,484 A 3/1994 Marcus
5,295,486 A 3/1994 Wollschlager et al.
5,304,169 A 4/1994 Sand
5,305,756 A 4/1994 Entrekin et al.
5,321,520 A 6/1994 Inga et al.
5,323,779 A 6/1994 Hardy et al.
5,327,895 A 7/1994 Hashimoto et al.
5,329,202 A 7/1994 Garlick et al.
5,348,016 A 9/1994 Unger et al.
5,358,466 A 10/1994 Aida et al.
5,360,268 A 11/1994 Hayashi
5,370,121 A 12/1994 Reichenberger
5,370,122 A 12/1994 Kunig
5,371,483 A 12/1994 Bhardwaj
5,375,602 A 12/1994 Lancee et al.
5,379,773 A 1/1995 Hornsby
5,380,280 A 1/1995 Peterson
5,380,519 A 1/1995 Schneider et al.
5,383,917 A 1/1995 Desai et al.
5,391,140 A 2/1995 Schaetzle et al.
5,391,197 A 2/1995 Burdette et al.
5,392,259 A 2/1995 Bolorforosh
5,396,143 A 3/1995 Seyed-Bolorforosh et al.
5,398,689 A 3/1995 Connor et al.
5,406,503 A 4/1995 Williams
5,413,550 A 5/1995 Castel

(56) References Cited

U.S. PATENT DOCUMENTS 5,417,216 A 5/1995 Tanaka
5,423,220 A 6/1995 Finsterwald et al.
5,435,311 A 7/1995 Umemura
5,438,998 A 8/1995 Hanafy
5,443,068 A 8/1995 Cline et al.
5,445,611 A 8/1995 Eppstein et al.
5,458,596 A 10/1995 Lax
5,460,179 A 10/1995 Okunuki et al.
5,460,595 A 10/1995 Hall et al.
5,419,327 A 11/1995 Rohwedder
5,469,854 A 11/1995 Unger et al.
5,471,488 A 12/1995 Fujio
5,472,405 A 12/1995 Buchholtz et al.
5,487,388 A 1/1996 Rello et al.
5,492,126 A 2/1996 Hennige
5,496,256 A 3/1996 Bock
5,501,655 A 3/1996 Rolt
5,503,152 A 4/1996 Oakley et al.
5,503,320 A 4/1996 Webster et al.
5,507,790 A 4/1996 Weiss
5,511,296 A 4/1996 Dias et al.
5,520,188 A 5/1996 Hennige
5,522,869 A 6/1996 Burdette
5,523,058 A 6/1996 Umemura et al.
5,524,620 A 6/1996 Rosenchein
5,524,624 A 6/1996 Tepper
5,524,625 A 6/1996 Okazaki
5,526,624 A 6/1996 Berg
5,526,812 A 6/1996 Dumoulin et al.
5,526,814 A 6/1996 Cline et al.
5,526,815 A 6/1996 Granz
5,529,070 A 6/1996 Augustine et al.
5,540,235 A 7/1996 Wilson
5,558,092 A 9/1996 Unger
5,560,362 A 10/1996 Sliwa et al.
5,573,497 A 11/1996 Chapelon
5,575,291 A 11/1996 Hayakawa
5,575,807 A 11/1996 Faller
5,577,502 A 11/1996 Darrow et al.
5,577,507 A 11/1996 Snyder et al.
5,577,991 A 11/1996 Akui et al.
5,580,575 A 12/1996 Unger et al.
5,643,179 A 1/1997 Fujimoto
5,601,526 A 2/1997 Chapelon
5,603,323 A 2/1997 Pflugrath et al.
5,605,154 A 2/1997 Ries et al.
5,609,562 A 3/1997 Kaali
5,615,091 A 3/1997 Palatnik
5,618,275 A 4/1997 Bock
5,620,479 A 4/1997 Diederich
5,622,175 A 4/1997 Sudol et al.
5,617,858 A 5/1997 Taverna et al.
5,638,819 A 6/1997 Manwaring et al.
5,644,085 A 7/1997 Lorraine et al.
5,647,373 A 7/1997 Paltieli
5,655,535 A 8/1997 Frlemel et al.
5,655,538 A 8/1997 Lorraine
5,657,760 A 8/1997 Ying
5,658,328 A 8/1997 Johnson
5,660,836 A 8/1997 Knowlton
5,662,116 A 9/1997 Kondo
5,665,053 A 9/1997 Jacobs
5,665,141 A 9/1997 Vago
5,671,746 A 9/1997 Dreschel et al.
5,673,699 A 10/1997 Trahey et al.
5,676,692 A 10/1997 Sanghvi
5,685,820 A 11/1997 Riek et al.
5,690,608 A 11/1997 Watanabe
5,694,936 A 12/1997 Fujimoto
5,697,897 A 12/1997 Buchholtz
5,701,900 A 12/1997 Shehada et al.
5,704,361 A 1/1998 Seward et al.
5,706,252 A 1/1998 Le Verrier et al.
5,706,564 A 1/1998 Rhyne
5,715,823 A 2/1998 Wood et al.
5,720,287 A 2/1998 Chapelon et al.
5,722,411 A 3/1998 Suzuki
5,727,554 A 3/1998 Kalend et al.
5,735,280 A 4/1998 Sherman et al.
5,740,804 A 4/1998 Cerofolini
5,743,863 A 4/1998 Chapelon
5,746,005 A 5/1998 Steinberg
5,746,762 A 5/1998 Bass
5,748,767 A 5/1998 Raab
5,749,364 A 5/1998 Sliwa et al.
5,755,228 A 5/1998 Wilson et al.
5,755,753 A 5/1998 Knowlton
5,762,066 A 6/1998 Law
5,763,886 A 6/1998 Schulte
5,769,790 A 6/1998 Watkins
5,779,644 A 7/1998 Eberle et al.
5,792,058 A 8/1998 Lee
5,795,297 A 8/1998 Daigle
5,795,311 A 8/1998 Wess
5,810,009 A 9/1998 Mine et al.
5,810,888 A 9/1998 Fenn
5,814,599 A 9/1998 Mitragotri et al.
5,817,013 A 10/1998 Ginn et al.
5,817,021 A 10/1998 Reichenberger
5,820,564 A 10/1998 Slayton
5,823,962 A 10/1998 Schaetzle
5,827,204 A 10/1998 Grandia et al.
5,840,032 A 11/1998 Hatfield et al.
5,844,140 A 12/1998 Seale
5,853,367 A 12/1998 Chalek et al.
5,866,024 A 2/1999 de Villeneuve
5,869,751 A 2/1999 Bonin
5,871,524 A 2/1999 Knowlton
5,873,902 A 2/1999 Sanghvi
5,876,341 A 3/1999 Wang et al.
5,879,303 A 3/1999 Averkiou et al.
5,882,557 A 3/1999 Hayakawa
5,891,034 A 4/1999 Bucholz
5,895,356 A 4/1999 Andrus et al.
5,899,861 A 5/1999 Friemel et al.
5,904,659 A 5/1999 Duarte
5,919,219 A 7/1999 Knowlton
5,923,099 A 7/1999 Bilir
5,924,989 A 7/1999 Polz
5,928,169 A 7/1999 Schatzle et al.
5,931,805 A 8/1999 Brisker
5,938,606 A 8/1999 Bonnefous
5,938,612 A 8/1999 Kline-Schoder
5,948,011 A 9/1999 Knowlton
5,957,844 A 9/1999 Dekel
5,957,882 A 9/1999 Nita et al.
5,957,941 A 9/1999 Ream
5,964,707 A 10/1999 Fenster et al.
5,967,980 A 10/1999 Ferre et al.
5,968,034 A 10/1999 Fullmer
5,971,949 A 10/1999 Levin
5,977,538 A 11/1999 Unger et al.
5,984,881 A 11/1999 Ishibashi et al.
5,984,882 A 11/1999 Rosenchein
5,990,598 A 11/1999 Sudol et al.
5,997,471 A 12/1999 Gumb et al.
5,997,497 A 12/1999 Nita et al.
5,999,843 A 12/1999 Anbar
6,004,262 A 12/1999 Putz et al.
6,007,499 A 12/1999 Martin et al.
6,013,032 A 1/2000 Rd
6,014,473 A 1/2000 Hossack et al.
6,016,255 A 1/2000 Bolan et al.
6,019,724 A 2/2000 Gronningsaeter et al.
6,022,308 A 2/2000 Williams
6,022,317 A 2/2000 Cruanas et al.
6,022,327 A 2/2000 Chang
6,030,374 A 2/2000 McDaniel
6,036,646 A 3/2000 Barthe
6,039,048 A 3/2000 Silberg
6,039,689 A 3/2000 Lizzi
6,042,556 A 3/2000 Beach
6,049,159 A 4/2000 Barthe
6,050,943 A 4/2000 Slayton

(56) References Cited

U.S. PATENT DOCUMENTS

| | | | |
|---|---|---|---|
| 6,059,727 | A | 5/2000 | Fowlkes |
| 6,071,239 | A | 6/2000 | Cribbs |
| 6,080,108 | A | 6/2000 | Dunham |
| 6,083,148 | A | 7/2000 | Williams |
| 6,086,535 | A | 7/2000 | Ishibashi |
| 6,086,580 | A | 7/2000 | Morden et al. |
| 6,090,054 | A | 7/2000 | Tagishi |
| 6,093,148 | A | 7/2000 | Fujimoto |
| 6,093,883 | A | 7/2000 | Sanghvi |
| 6,100,626 | A | 8/2000 | Frey et al. |
| 6,101,407 | A | 8/2000 | Groezinger |
| 6,106,469 | A | 8/2000 | Suzuki et al. |
| 6,113,558 | A | 9/2000 | Rosenchein |
| 6,113,559 | A | 9/2000 | Klopotek |
| 6,120,452 | A | 9/2000 | Barthe |
| 6,123,081 | A | 9/2000 | Durette |
| 6,126,619 | A | 10/2000 | Peterson et al. |
| 6,135,971 | A | 10/2000 | Hutchinson |
| 6,139,499 | A | 10/2000 | Wilk |
| 6,159,150 | A | 12/2000 | Yale et al. |
| 6,171,244 | B1 | 1/2001 | Finger et al. |
| 6,176,840 | B1 | 1/2001 | Nishimura |
| 6,183,426 | B1 | 2/2001 | Akisada |
| 6,183,502 | B1 | 2/2001 | Takeuchi |
| 6,183,773 | B1 | 2/2001 | Anderson |
| 6,190,323 | B1 | 2/2001 | Dias |
| 6,190,336 | B1 | 2/2001 | Duarte |
| 6,193,658 | B1 | 2/2001 | Wendelken |
| 6,198,956 | B1 | 3/2001 | Dunne |
| 6,210,327 | B1 | 4/2001 | Brackett et al. |
| 6,213,948 | B1 | 4/2001 | Barthe |
| 6,216,029 | B1 | 4/2001 | Paltieli |
| 6,233,476 | B1 | 5/2001 | Strommer et al. |
| 6,234,990 | B1 | 5/2001 | Rowe et al. |
| 6,241,753 | B1 | 6/2001 | Knowlton |
| 6,246,898 | B1 | 6/2001 | Vesely et al. |
| 6,251,074 | B1 | 6/2001 | Averkiou et al. |
| 6,251,088 | B1 | 6/2001 | Kaufman et al. |
| 6,268,405 | B1 | 7/2001 | Yao |
| 6,273,864 | B1 | 8/2001 | Duarte |
| 6,280,402 | B1 | 8/2001 | Ishibashi et al. |
| 6,287,257 | B1 | 9/2001 | Matichuk |
| 6,287,304 | B1 | 9/2001 | Eggers et al. |
| 6,296,619 | B1 | 10/2001 | Brisken |
| 6,301,989 | B1 | 10/2001 | Brown et al. |
| 6,307,302 | B1 | 10/2001 | Toda |
| 6,309,355 | B1 | 10/2001 | Cain et al. |
| 6,311,090 | B1 | 10/2001 | Knowlton |
| 6,315,741 | B1 | 11/2001 | Martin |
| 6,322,509 | B1 | 11/2001 | Pan et al. |
| 6,322,532 | B1 | 11/2001 | D'Sa |
| 6,325,540 | B1 | 12/2001 | Lounsberry et al. |
| 6,325,758 | B1 | 12/2001 | Carol et al. |
| 6,325,769 | B1 | 12/2001 | Klopotek |
| 6,325,798 | B1 | 12/2001 | Edwards et al. |
| 6,350,276 | B1 | 2/2002 | Knowlton |
| 6,356,780 | B1 | 3/2002 | Licato et al. |
| 6,361,531 | B1 | 3/2002 | Hissong |
| 6,370,411 | B1 | 4/2002 | Osadchy et al. |
| 6,375,672 | B1 | 4/2002 | Aksan |
| 6,377,854 | B1 | 4/2002 | Knowlton |
| 6,377,855 | B1 | 4/2002 | Knowlton |
| 6,381,497 | B1 | 4/2002 | Knowlton |
| 6,381,498 | B1 | 4/2002 | Knowlton |
| 6,387,380 | B1 | 5/2002 | Knowlton |
| 6,390,982 | B1 | 5/2002 | Bova et al. |
| 6,405,090 | B1 | 6/2002 | Knowlton |
| 6,409,720 | B1 | 6/2002 | Hissong |
| 6,413,216 | B1 | 7/2002 | Cain et al. |
| 6,413,253 | B1 | 7/2002 | Koop |
| 6,413,254 | B1 | 7/2002 | Hissong |
| 6,419,648 | B1 | 7/2002 | Vitek |
| 6,423,007 | B2 | 7/2002 | Lizzi et al. |
| 6,425,865 | B1 | 7/2002 | Salcudean |
| 6,425,867 | B1 | 7/2002 | Vaezy |
| 6,425,912 | B1 | 7/2002 | Knowlton |
| 6,428,477 | B1 | 8/2002 | Mason |
| 6,428,532 | B1 | 8/2002 | Doukas |
| 6,430,446 | B1 | 8/2002 | Knowlton |
| 6,432,057 | B1 | 8/2002 | Mazess et al. |
| 6,432,067 | B1 | 8/2002 | Martin |
| 6,432,101 | B1 | 8/2002 | Weber |
| 6,436,061 | B1 | 8/2002 | Costantino |
| 6,438,424 | B1 | 8/2002 | Knowlton |
| 6,440,071 | B1 | 8/2002 | Slayton |
| 6,440,121 | B1 | 8/2002 | Weber |
| 6,443,914 | B1 | 9/2002 | Costantino |
| 6,447,443 | B1 | 9/2002 | Keogh et al. |
| 6,450,979 | B1 | 9/2002 | Miwa et al. |
| 6,451,013 | B1 | 9/2002 | Bays et al. |
| 6,453,202 | B1 | 9/2002 | Knowlton |
| 6,461,304 | B1 | 10/2002 | Tanaka et al. |
| 6,461,378 | B1 | 10/2002 | Knowlton |
| 6,470,216 | B1 | 10/2002 | Knowlton |
| 6,338,716 | B1 | 11/2002 | Hossack |
| 6,485,420 | B1 | 11/2002 | Bullis |
| 6,488,626 | B1 | 12/2002 | Lizzi |
| 6,491,657 | B2 | 12/2002 | Rowe |
| 6,500,121 | B1 | 12/2002 | Slayton |
| 6,500,141 | B1 | 12/2002 | Irion |
| 6,506,171 | B1 | 1/2003 | Vitek et al. |
| 6,508,774 | B1 | 1/2003 | Acker |
| 6,511,427 | B1 | 1/2003 | Sliwa, Jr. et al. |
| 6,511,428 | B1 | 1/2003 | Azuma |
| 6,514,244 | B2 | 2/2003 | Pope |
| 6,517,484 | B1 | 2/2003 | Wilk |
| 6,524,250 | B1 | 2/2003 | Weber |
| 6,666,835 | B2 | 3/2003 | Martin |
| 6,540,679 | B2 | 4/2003 | Slayton |
| 6,540,685 | B1 | 4/2003 | Rhoads et al. |
| 6,540,700 | B1 | 4/2003 | Fujimoto et al. |
| 6,547,788 | B1 | 4/2003 | Maguire et al. |
| 6,554,771 | B1 | 4/2003 | Buil et al. |
| 6,569,099 | B1 | 5/2003 | Babaev |
| 6,569,108 | B2 | 5/2003 | Sarvazyan et al. |
| 6,572,552 | B2 | 6/2003 | Fukukita |
| 6,575,956 | B1 | 6/2003 | Brisken et al. |
| 6,595,934 | B1 | 7/2003 | Hissong |
| 6,599,256 | B1 | 7/2003 | Acker |
| 6,605,043 | B1 | 8/2003 | Dreschel |
| 6,605,080 | B1 | 8/2003 | Altshuler et al. |
| 6,607,498 | B2 | 8/2003 | Eshel |
| 6,618,620 | B1 | 9/2003 | Freundlich et al. |
| 6,623,430 | B1 | 9/2003 | Slayton |
| 6,626,854 | B2 | 9/2003 | Friedman |
| 6,626,855 | B1 | 9/2003 | Weng |
| 6,638,226 | B2 | 10/2003 | He et al. |
| 6,645,145 | B1 | 11/2003 | Dreschel et al. |
| 6,645,150 | B2 | 11/2003 | Angelsen et al. |
| 6,645,162 | B2 | 11/2003 | Friedman |
| 6,662,054 | B2 | 12/2003 | Kreindel |
| 6,663,627 | B2 | 12/2003 | Francischelli |
| 6,665,806 | B1 | 12/2003 | Shimizu |
| 6,669,638 | B1 | 12/2003 | Miller |
| 6,685,639 | B1 | 2/2004 | Wang et al. |
| 6,685,640 | B1 | 2/2004 | Fry |
| 6,692,450 | B1 | 2/2004 | Coleman |
| 6,699,237 | B2 | 3/2004 | Weber |
| 6,716,184 | B2 | 4/2004 | Vaezy et al. |
| 6,719,449 | B1 | 4/2004 | Laughlin |
| 6,719,694 | B2 | 4/2004 | Weng |
| 6,726,627 | B1 | 4/2004 | Lizzi et al. |
| 6,733,449 | B1 | 5/2004 | Krishnamurthy et al. |
| 6,749,624 | B2 | 6/2004 | Knowlton |
| 6,772,490 | B2 | 8/2004 | Toda |
| 6,773,409 | B2 | 8/2004 | Truckai et al. |
| 6,775,404 | B1 | 8/2004 | Pagoulatos et al. |
| 6,790,187 | B2 | 9/2004 | Thompson et al. |
| 6,824,516 | B2 | 11/2004 | Batten et al. |
| 6,825,176 | B2 | 11/2004 | White |
| 6,835,940 | B2 | 12/2004 | Morikawa et al. |
| 6,846,290 | B2 | 1/2005 | Lizzi et al. |
| 6,875,176 | B2 | 4/2005 | Mourad et al. |
| 6,882,884 | B1 | 4/2005 | Mosk et al. |

(56) References Cited

U.S. PATENT DOCUMENTS

| | | | |
|---|---|---|---|
| 6,887,239 | B2 | 5/2005 | Elstrom |
| 6,887,260 | B1 | 5/2005 | McDaniel |
| 6,889,089 | B2 | 5/2005 | Behl |
| 6,896,657 | B2 | 5/2005 | Willis |
| 6,902,536 | B2 | 6/2005 | Manna |
| 6,905,466 | B2 | 6/2005 | Saigo |
| 6,918,907 | B2 | 7/2005 | Kelly |
| 6,920,883 | B2 | 7/2005 | Bessette |
| 6,921,371 | B2 | 7/2005 | Wilson |
| 6,932,771 | B2 | 8/2005 | Whitmore |
| 6,932,814 | B2 | 8/2005 | Wood |
| 6,936,044 | B2 | 8/2005 | McDaniel |
| 6,936,046 | B2 | 8/2005 | Hissong |
| 6,945,937 | B2 | 9/2005 | Culp et al. |
| 6,948,843 | B2 | 9/2005 | Laugharn et al. |
| 6,953,941 | B2 | 10/2005 | Nakano et al. |
| 6,958,043 | B2 | 10/2005 | Hissong |
| 6,971,994 | B1 | 12/2005 | Young et al. |
| 6,974,417 | B2 | 12/2005 | Lockwood |
| 6,976,492 | B2 | 12/2005 | Ingle |
| 6,992,305 | B2 | 1/2006 | Maezawa et al. |
| 6,997,923 | B2 | 2/2006 | Anderson |
| 7,006,874 | B2 | 2/2006 | Knowlton |
| 7,020,528 | B2 | 3/2006 | Neev |
| 7,022,089 | B2 | 4/2006 | Ooba |
| 7,058,440 | B2 | 6/2006 | Heuscher et al. |
| 7,063,666 | B2 | 6/2006 | Weng |
| 7,070,565 | B2 | 7/2006 | Vaezy et al. |
| 7,074,218 | B2 | 7/2006 | Washington et al. |
| 7,094,252 | B2 | 8/2006 | Koop |
| 7,108,663 | B2 | 9/2006 | Talish et al. |
| 7,115,123 | B2 | 10/2006 | Knowlton |
| 7,122,029 | B2 | 10/2006 | Koop et al. |
| 7,142,905 | B2 | 11/2006 | Slayton |
| 7,165,451 | B1 | 1/2007 | Brooks et al. |
| 7,179,238 | B2 | 2/2007 | Hissong |
| 7,189,230 | B2 | 3/2007 | Knowlton |
| 7,229,411 | B2 | 6/2007 | Slayton |
| 7,235,592 | B2 | 6/2007 | Muratoglu |
| 7,258,674 | B2 | 8/2007 | Cribbs |
| 7,273,459 | B2 | 9/2007 | Desilets |
| 7,294,125 | B2 | 11/2007 | Phalen et al. |
| 7,297,117 | B2 | 11/2007 | Trucco |
| 7,303,555 | B2 | 12/2007 | Makin et al. |
| 7,311,679 | B2 | 12/2007 | Desilets et al. |
| 7,327,071 | B2 | 2/2008 | Nishiyama et al. |
| 7,331,951 | B2 | 2/2008 | Eshel et al. |
| 7,332,985 | B2 | 2/2008 | Larson et al. |
| 7,338,434 | B1 | 3/2008 | Haarstad et al. |
| 7,347,855 | B2 | 3/2008 | Eshel |
| RE40,403 | E | 6/2008 | Cho et al. |
| 7,393,325 | B2 | 7/2008 | Barthe |
| 7,398,116 | B2 | 7/2008 | Edwards |
| 7,399,279 | B2 | 7/2008 | Abend et al. |
| 7,491,171 | B2 | 2/2009 | Barthe et al. |
| 7,507,235 | B2 | 3/2009 | Keogh et al. |
| 7,510,536 | B2 | 3/2009 | Foley et al. |
| 7,517,315 | B2 | 4/2009 | Willis |
| 7,530,356 | B2 | 5/2009 | Slayton |
| 7,530,958 | B2 | 5/2009 | Slayton |
| 7,532,201 | B2 | 5/2009 | Quistgaard et al. |
| 7,571,336 | B2 | 8/2009 | Barthe |
| 7,601,120 | B2 | 10/2009 | Moilanen et al. |
| 7,615,015 | B2 | 11/2009 | Coleman |
| 7,615,016 | B2 | 11/2009 | Barthe |
| 7,652,411 | B2 | 1/2010 | Crunkilton et al. |
| 7,662,114 | B2 | 2/2010 | Seip et al. |
| 7,674,257 | B2 | 3/2010 | Pless et al. |
| 7,686,763 | B2 | 3/2010 | Vaezy et al. |
| 7,713,203 | B2 | 3/2010 | Lacoste et al. |
| 7,694,406 | B2 | 4/2010 | Wildes et al. |
| 7,695,437 | B2 | 4/2010 | Quistgaard et al. |
| 7,727,156 | B2 | 6/2010 | Angelsen et al. |
| 7,758,524 | B2 | 7/2010 | Barthe |
| 7,766,848 | B2 | 8/2010 | Desilets et al. |
| 7,789,841 | B2 | 9/2010 | Huckle et al. |
| 7,806,839 | B2 | 10/2010 | Mast et al. |
| 7,815,570 | B2 | 10/2010 | Eshel et al. |
| 7,819,826 | B2 | 10/2010 | Diederich et al. |
| 7,828,734 | B2 | 10/2010 | Azhari et al. |
| 7,824,348 | B2 | 11/2010 | Barthe |
| 7,833,162 | B2 | 11/2010 | Hasegawa et al. |
| 7,841,984 | B2 | 11/2010 | Cribbs et al. |
| 7,846,096 | B2 | 12/2010 | Mast et al. |
| 7,857,773 | B2 | 12/2010 | Desilets et al. |
| 7,875,023 | B2 | 1/2011 | Eshel et al. |
| 7,901,359 | B2 | 3/2011 | Mandrusov et al. |
| 7,905,007 | B2 | 3/2011 | Calisti et al. |
| 7,905,844 | B2 | 3/2011 | Desilets et al. |
| 7,914,453 | B2 | 3/2011 | Slayton et al. |
| 7,914,469 | B2 | 3/2011 | Torbati |
| 7,955,281 | B2 | 6/2011 | Pedersen et al. |
| 7,967,764 | B2 | 6/2011 | Lidgren et al. |
| 7,967,839 | B2 | 6/2011 | Flock et al. |
| 7,955,262 | B2 | 7/2011 | Rosenberg |
| 7,993,289 | B2 | 8/2011 | Quistgaard et al. |
| 8,057,465 | B2 | 9/2011 | Sliwa, Jr. et al. |
| 8,057,389 | B2 | 11/2011 | Barthe et al. |
| 8,066,641 | B2 | 11/2011 | Barthe et al. |
| 8,123,707 | B2 | 2/2012 | Huckle et al. |
| 8,128,618 | B2 | 3/2012 | Gliklich et al. |
| 8,133,180 | B2 | 3/2012 | Slayton et al. |
| 8,133,191 | B2 | 3/2012 | Rosenberg et al. |
| 8,142,200 | B2 | 3/2012 | Crunkilton et al. |
| 8,152,904 | B2 | 4/2012 | Slobodzian et al. |
| 8,162,858 | B2 | 4/2012 | Manna et al. |
| 8,166,332 | B2 | 4/2012 | Barthe et al. |
| 8,182,428 | B2 | 5/2012 | Angelsen et al. |
| 8,197,409 | B2 | 6/2012 | Foley et al. |
| 8,206,299 | B2 | 6/2012 | Foley et al. |
| 8,208,346 | B2 | 6/2012 | Crunkilton |
| 8,211,017 | B2 | 7/2012 | Foley et al. |
| 8,262,591 | B2 | 9/2012 | Pedersen et al. |
| 8,262,650 | B2 | 9/2012 | Zanelli et al. |
| 8,264,126 | B2 | 9/2012 | Toda et al. |
| 8,273,037 | B2 | 9/2012 | Kreindel et al. |
| 8,282,554 | B2 | 10/2012 | Makin et al. |
| 8,292,835 | B1 | 10/2012 | Cimino |
| 8,298,163 | B1 | 10/2012 | Cimino |
| 8,333,700 | B1 | 12/2012 | Barthe et al. |
| 8,334,637 | B2 | 12/2012 | Crunkilton et al. |
| 8,337,407 | B2 | 12/2012 | Quistgaard et al. |
| 8,343,051 | B2 | 1/2013 | Desilets et al. |
| 8,454,540 | B2 | 1/2013 | Eshel et al. |
| 8,366,622 | B2 | 2/2013 | Slayton et al. |
| 8,398,549 | B2 | 3/2013 | Palmeri et al. |
| 8,409,097 | B2 | 4/2013 | Slayton et al. |
| 8,425,435 | B2 | 4/2013 | Wing et al. |
| 8,388,535 | B2 | 5/2013 | Weng et al. |
| 8,444,562 | B2 | 5/2013 | Barthe et al. |
| 8,460,193 | B2 | 6/2013 | Barthe et al. |
| 8,480,585 | B2 | 7/2013 | Slayton et al. |
| 8,486,001 | B2 | 7/2013 | Weyant |
| 8,506,486 | B2 | 8/2013 | Slayton et al. |
| 8,512,250 | B2 | 8/2013 | Quistgaard et al. |
| 8,523,775 | B2 | 9/2013 | Barthe et al. |
| 8,523,849 | B2 | 9/2013 | Liu et al. |
| 8,535,228 | B2 | 9/2013 | Slayton et al. |
| 8,570,837 | B2 | 10/2013 | Toda et al. |
| 8,573,392 | B2 | 11/2013 | Bennett et al. |
| 8,583,211 | B2 | 11/2013 | Salomir et al. |
| 8,585,618 | B2 | 11/2013 | Hunziker et al. |
| 8,604,672 | B2 | 12/2013 | Toda et al. |
| 8,622,937 | B2 | 1/2014 | Weng et al. |
| 8,636,665 | B2 | 1/2014 | Slayton et al. |
| 8,641,622 | B2 | 2/2014 | Barthe et al. |
| 8,663,112 | B2 | 3/2014 | Slayton et al. |
| 8,672,848 | B2 | 3/2014 | Slayton et al. |
| 8,690,778 | B2 | 4/2014 | Slayton et al. |
| 8,690,779 | B2 | 4/2014 | Slayton et al. |
| 8,690,780 | B2 | 4/2014 | Slayton et al. |
| 8,708,935 | B2 | 4/2014 | Barthe et al. |
| 8,715,186 | B2 | 5/2014 | Slayton et al. |
| 8,726,781 | B2 | 5/2014 | Eckhoff et al. |

(56) References Cited

U.S. PATENT DOCUMENTS 8,728,071 B2 5/2014 Lischinsky et al.
8,753,295 B2 6/2014 Thierman
8,758,253 B2 6/2014 Sano et al.
8,836,203 B2 9/2014 Nobles et al.
8,857,438 B2 10/2014 Barthe et al.
8,858,471 B2 10/2014 Barthe et al.
8,915,853 B2 12/2014 Barthe et al.
8,915,854 B2 12/2014 Slayton et al.
8,915,870 B2 12/2014 Barthe et al.
8,920,320 B2 12/2014 Stecco et al.
8,920,324 B2 12/2014 Slayton et al.
8,926,533 B2 1/2015 Bockenstedt et al.
8,932,224 B2 1/2015 Barthe et al.
8,932,238 B2 1/2015 Wing et al.
8,968,205 B2 3/2015 Zeng et al.
9,011,336 B2 4/2015 Slayton et al.
9,039,617 B2 5/2015 Slayton et al.
9,039,619 B2 5/2015 Barthe et al.
9,050,116 B2 6/2015 Homer
9,095,697 B2 8/2015 Barthe et al.
9,107,798 B2 8/2015 Azhari et al.
9,114,247 B2 8/2015 Barthe et al.
9,180,314 B2 11/2015 Desilets et al.
9,216,276 B2 12/2015 Slayton et al.
9,220,915 B2 12/2015 Liu et al.
9,272,162 B2 3/2016 Slayton et al.
9,283,409 B2 3/2016 Slayton et al.
9,283,410 B2 3/2016 Slayton et al.
9,295,607 B2 3/2016 Rosenberg
9,308,390 B2 4/2016 Youngquist
9,308,391 B2 4/2016 Liu et al.
9,314,650 B2 4/2016 Rosenberg et al.
9,320,537 B2 4/2016 Slayton et al.
9,345,910 B2 5/2016 Slayton et al.
9,363,605 B2 * 6/2016 Goodman ..... H04R 17/00
9,421,029 B2 8/2016 Barthe et al.
9,427,600 B2 8/2016 Barthe et al.
9,427,601 B2 8/2016 Barthe et al.
9,433,803 B2 9/2016 Lin et al.
9,440,093 B2 9/2016 Homer
9,440,096 B2 9/2016 Barthe et al.
9,492,645 B2 11/2016 Zhou et al.
9,492,686 B2 11/2016 Da Silva
9,498,651 B2 11/2016 Sapozhnikov et al.
9,510,802 B2 12/2016 Barthe et al.
9,522,290 B2 12/2016 Slayton et al.
9,532,832 B2 1/2017 Ron Edoute et al.
9,533,174 B2 1/2017 Barthe et al.
9,533,175 B2 1/2017 Slayton et al.
9,545,529 B2 1/2017 Britva et al.
9,566,454 B2 2/2017 Barthe et al.
9,623,267 B2 4/2017 Ulric et al.
9,694,211 B2 7/2017 Barthe et al.
9,694,212 B2 7/2017 Barthe et al.
9,700,340 B2 7/2017 Barthe et al.
9,707,412 B2 7/2017 Slayton et al.
9,710,607 B2 7/2017 Ramdas et al.
9,713,731 B2 7/2017 Slayton et al.
9,802,063 B2 10/2017 Barthe et al.
9,827,449 B2 11/2017 Barthe et al.
9,827,450 B2 11/2017 Slayton et al.
9,833,639 B2 12/2017 Slayton et al.
9,833,640 B2 12/2017 Barthe et al.
9,895,560 B2 2/2018 Barthe et al.
9,907,535 B2 3/2018 Barthe et al.
9,919,167 B2 3/2018 Domankevitz
9,974,982 B2 5/2018 Slayton et al.
9,993,664 B2 6/2018 Aviad et al.
10,010,721 B2 7/2018 Slayton et al.
10,010,724 B2 7/2018 Barthe et al.
10,010,725 B2 7/2018 Slayton et al.
10,010,726 B2 7/2018 Barthe et al.
10,016,626 B2 7/2018 Zovrin et al.
10,046,181 B2 8/2018 Barthe et al.
10,046,182 B2 8/2018 Barthe et al.
10,070,883 B2 9/2018 Barthe et al.
10,183,183 B2 1/2019 Burdette
10,226,645 B2 3/2019 Barthe
10,238,894 B2 3/2019 Slayton et al.
10,245,450 B2 4/2019 Slayton et al.
10,252,086 B2 4/2019 Barthe et al.
10,265,550 B2 4/2019 Barthe et al.
10,272,272 B2 4/2019 Lee et al.
10,300,308 B2 5/2019 Seip et al.
10,328,289 B2 6/2019 Barthe et al.
10,406,383 B2 9/2019 Luebcke
10,420,960 B2 9/2019 Emery
10,420,961 B2 9/2019 Lacoste
10,485,573 B2 11/2019 Clark, III et al.
10,492,862 B2 12/2019 Domankevitz
10,525,288 B2 1/2020 Slayton et al.
10,532,230 B2 1/2020 Barthe et al.
10,537,304 B2 1/2020 Barthe et al.
10,556,123 B2 2/2020 Altshuler et al.
10,583,287 B2 3/2020 Schwarz
10,603,519 B2 3/2020 Slayton et al.
10,603,523 B2 3/2020 Slayton et al.
10,610,705 B2 4/2020 Barthe et al.
10,610,706 B2 4/2020 Barthe et al.
10,639,006 B2 5/2020 Choi et al.
10,639,504 B2 5/2020 Kim
10,751,246 B2 8/2020 Kaila
10,772,646 B2 9/2020 Lu et al.
10,780,298 B2 9/2020 Cain et al.
10,888,716 B2 1/2021 Slayton et al.
10,888,717 B2 1/2021 Slayton et al.
10,888,718 B2 1/2021 Barthe et al.
2001/0009997 A1 7/2001 Pope
2001/0009999 A1 7/2001 Kaufman et al.
2001/0014780 A1 8/2001 Martin
2001/0014819 A1 8/2001 Ingle
2001/0031922 A1 10/2001 Weng
2001/0039380 A1 11/2001 Larson et al.
2001/0041880 A1 11/2001 Brisken
2002/0000763 A1 1/2002 Jones
2002/0002345 A1 1/2002 Marlinghaus
2002/0040199 A1 4/2002 Klopotek
2002/0040442 A1 4/2002 Ishidera
2002/0055702 A1 5/2002 Atala
2002/0062077 A1 5/2002 Emmenegger
2002/0062142 A1 5/2002 Knowlton
2002/0072691 A1 6/2002 Thompson et al.
2002/0082528 A1 6/2002 Friedman
2002/0082529 A1 6/2002 Suorsa et al.
2002/0082589 A1 6/2002 Friedman
2002/0087080 A1 7/2002 Slayton
2002/0095143 A1 7/2002 Key
2002/0099094 A1 7/2002 Anderson
2002/0111569 A1 8/2002 Rosenschien et al.
2002/0115917 A1 8/2002 Honda et al.
2002/0128639 A1 8/2002 Pless et al.
2002/0128648 A1 9/2002 Weber
2002/0143252 A1 10/2002 Dunne et al.
2002/0156400 A1 10/2002 Babaev
2002/0161357 A1 10/2002 Anderson
2002/0165529 A1 11/2002 Danek
2002/0168049 A1 11/2002 Schriever
2002/0169394 A1 11/2002 Eppstein et al.
2002/0169442 A1 11/2002 Neev
2002/0173721 A1 11/2002 Grunwald et al.
2002/0193784 A1 12/2002 McHale et al.
2002/0193831 A1 12/2002 Smith
2003/0009153 A1 1/2003 Brisken et al.
2003/0014039 A1 1/2003 Barzell et al.
2003/0018255 A1 1/2003 Martin
2003/0018270 A1 1/2003 Makin et al.
2003/0023283 A1 1/2003 McDaniel
2003/0028111 A1 2/2003 Vaezy et al.
2003/0028113 A1 2/2003 Gilbert et al.
2003/0032900 A1 2/2003 Ella
2003/0036706 A1 2/2003 Slayton et al.
2003/0040739 A1 2/2003 Koop
2003/0050678 A1 3/2003 Sierra
2003/0055308 A1 3/2003 Friemel et al.

(56) References Cited

U.S. PATENT DOCUMENTS

| | | | |
|---|---|---|---|
| 2003/0055417 | A1 | 3/2003 | Truckai et al. |
| 2003/0060736 | A1 | 3/2003 | Martin et al. |
| 2003/0065313 | A1 | 4/2003 | Koop |
| 2003/0066708 | A1 | 4/2003 | Allison et al. |
| 2003/0073907 | A1 | 4/2003 | Taylor |
| 2003/0074023 | A1 | 4/2003 | Kaplan |
| 2003/0083536 | A1 | 5/2003 | Eshel |
| 2003/0092988 | A1 | 5/2003 | Makin |
| 2003/0097071 | A1 | 5/2003 | Halmann et al. |
| 2003/0099383 | A1 | 5/2003 | Lefebvre |
| 2003/0125629 | A1 | 7/2003 | Ustuner |
| 2003/0135135 | A1 | 7/2003 | Miwa et al. |
| 2003/0139790 | A1 | 7/2003 | Ingle et al. |
| 2003/0149366 | A1 | 8/2003 | Stringer et al. |
| 2003/0153961 | A1 | 8/2003 | Babaev |
| 2003/0171678 | A1 | 9/2003 | Batten et al. |
| 2003/0171701 | A1 | 9/2003 | Babaev |
| 2003/0176790 | A1 | 9/2003 | Slayton |
| 2003/0191396 | A1 | 10/2003 | Sanghvi |
| 2003/0199794 | A1 | 10/2003 | Sakurai et al. |
| 2003/0200481 | A1 | 10/2003 | Stanley |
| 2003/0212129 | A1 | 11/2003 | Liu et al. |
| 2003/0212351 | A1 | 11/2003 | Hissong |
| 2003/0212393 | A1 | 11/2003 | Knowlton |
| 2003/0216648 | A1 | 11/2003 | Lizzi et al. |
| 2003/0216795 | A1 | 11/2003 | Harth |
| 2003/0220536 | A1 | 11/2003 | Hissong |
| 2003/0220585 | A1 | 11/2003 | Hissong |
| 2003/0229331 | A1 | 12/2003 | Brisker et al. |
| 2003/0233085 | A1 | 12/2003 | Giammarusti |
| 2003/0236487 | A1 | 12/2003 | Knowlton |
| 2004/0000316 | A1 | 1/2004 | Knowlton |
| 2004/0001809 | A1 | 1/2004 | Brisken |
| 2004/0002658 | A1 | 1/2004 | Marian, Jr. |
| 2004/0002705 | A1 | 1/2004 | Knowlton |
| 2004/0010222 | A1 | 1/2004 | Nunomura et al. |
| 2004/0015079 | A1 | 1/2004 | Berger et al. |
| 2004/0015106 | A1 | 1/2004 | Coleman |
| 2004/0030227 | A1 | 2/2004 | Littrup |
| 2004/0030268 | A1 | 2/2004 | Weng et al. |
| 2004/0039312 | A1 | 2/2004 | Hillstead |
| 2004/0039418 | A1 | 2/2004 | Elstrom |
| 2004/0041563 | A1 | 3/2004 | Lewin et al. |
| 2004/0041880 | A1 | 3/2004 | Ikeda et al. |
| 2004/0042168 | A1 | 3/2004 | Yang et al. |
| 2004/0044375 | A1 | 3/2004 | Diederich et al. |
| 2004/0049134 | A1 | 3/2004 | Tosaya et al. |
| 2004/0049734 | A1 | 3/2004 | Tosaya et al. |
| 2004/0059266 | A1 | 3/2004 | Fry |
| 2004/0068186 | A1 | 4/2004 | Ishida et al. |
| 2004/0073079 | A1 | 4/2004 | Altshuler et al. |
| 2004/0073113 | A1 | 4/2004 | Saigo. |
| 2004/0073115 | A1 | 4/2004 | Horzewski et al. |
| 2004/0073116 | A1 | 4/2004 | Smith |
| 2004/0073204 | A1 | 4/2004 | Ryan et al. |
| 2004/0077977 | A1 | 4/2004 | Ella et al. |
| 2004/0082857 | A1 | 4/2004 | Schonenberger |
| 2004/0082859 | A1 | 4/2004 | Schaer |
| 2004/0102697 | A1 | 5/2004 | Evron |
| 2004/0105559 | A1 | 6/2004 | Aylward et al. |
| 2004/0106867 | A1 | 6/2004 | Eshel et al. |
| 2004/0122323 | A1 | 6/2004 | Vortman et al. |
| 2004/0122493 | A1 | 6/2004 | Ishibashi et al. |
| 2004/0143297 | A1 | 7/2004 | Ramsey |
| 2004/0152982 | A1 | 8/2004 | Hwang et al. |
| 2004/0158150 | A1 | 8/2004 | Rabiner et al. |
| 2004/0186535 | A1 | 9/2004 | Knowlton |
| 2004/0189155 | A1 | 9/2004 | Funakubo |
| 2004/0206365 | A1 | 10/2004 | Knowlton |
| 2004/0210214 | A1 | 10/2004 | Knowlton |
| 2004/0217675 | A1 | 11/2004 | Desilets |
| 2004/0249318 | A1 | 12/2004 | Tanaka |
| 2004/0254620 | A1 | 12/2004 | Lacoste |
| 2004/0267252 | A1 | 12/2004 | Washington et al. |
| 2005/0007879 | A1 | 1/2005 | Nishida |
| 2005/0033201 | A1 | 2/2005 | Takahashi |
| 2005/0033316 | A1 | 2/2005 | Kertz |
| 2005/0038340 | A1 | 2/2005 | Vaezy et al. |
| 2005/0055018 | A1 | 3/2005 | Kreindel |
| 2005/0055073 | A1 | 3/2005 | Weber |
| 2005/0061834 | A1 | 3/2005 | Garcia et al. |
| 2005/0070961 | A1 | 3/2005 | Maki |
| 2005/0074407 | A1 | 4/2005 | Smith |
| 2005/0080469 | A1 | 4/2005 | Larson |
| 2005/0085731 | A1 | 4/2005 | Miller et al. |
| 2005/0091770 | A1 | 5/2005 | Mourad et al. |
| 2005/0096542 | A1 | 5/2005 | Weng |
| 2005/0104690 | A1 | 5/2005 | Larson et al. |
| 2005/0113689 | A1 | 5/2005 | Gritzky |
| 2005/0131302 | A1 | 6/2005 | Poland |
| 2005/0137656 | A1 | 6/2005 | Malak |
| 2005/0143677 | A1 | 6/2005 | Young et al. |
| 2005/0154313 | A1 | 7/2005 | Desilets |
| 2005/0154314 | A1 | 7/2005 | Quistgaard |
| 2005/0154332 | A1 | 7/2005 | Zanelli |
| 2005/0154431 | A1 | 7/2005 | Quistgaard |
| 2005/0187495 | A1 | 8/2005 | Quistgaard |
| 2005/0191252 | A1 | 9/2005 | Mitsui |
| 2005/0193451 | A1 | 9/2005 | Quistgaard |
| 2005/0193820 | A1 | 9/2005 | Sheljaskow et al. |
| 2005/0197681 | A1 | 9/2005 | Barolet et al. |
| 2005/0228281 | A1 | 10/2005 | Nefos |
| 2005/0240127 | A1 | 10/2005 | Seip et al. |
| 2005/0240170 | A1 | 10/2005 | Zhang et al. |
| 2005/0251120 | A1 | 11/2005 | Anderson et al. |
| 2005/0251125 | A1 | 11/2005 | Pless et al. |
| 2005/0256406 | A1 | 11/2005 | Barthe |
| 2005/0261584 | A1 | 11/2005 | Eshel |
| 2005/0261585 | A1 | 11/2005 | Makin et al. |
| 2005/0267454 | A1 | 12/2005 | Hissong |
| 2005/0288748 | A1 | 12/2005 | Li et al. |
| 2006/0004306 | A1 | 1/2006 | Altshuler |
| 2006/0020260 | A1 | 1/2006 | Dover et al. |
| 2006/0025756 | A1 | 2/2006 | Francischelli |
| 2006/0042201 | A1 | 3/2006 | Curry |
| 2006/0058664 | A1 | 3/2006 | Barthe |
| 2006/0058671 | A1 | 3/2006 | Vitek et al. |
| 2006/0058707 | A1 | 3/2006 | Barthe |
| 2006/0058712 | A1 | 3/2006 | Altshuler et al. |
| 2006/0074309 | A1 | 4/2006 | Bonnefous |
| 2006/0074313 | A1 | 4/2006 | Slayton et al. |
| 2006/0074314 | A1 | 4/2006 | Slayton |
| 2006/0074355 | A1 | 4/2006 | Slayton |
| 2006/0079816 | A1 | 4/2006 | Barthe |
| 2006/0079868 | A1 | 4/2006 | Makin |
| 2006/0084891 | A1 | 4/2006 | Barthe |
| 2006/0089632 | A1 | 4/2006 | Barthe |
| 2006/0089688 | A1 | 4/2006 | Panescu |
| 2006/0094988 | A1 | 5/2006 | Tosaya |
| 2006/0106325 | A1 | 5/2006 | Perrier |
| 2006/0111744 | A1 | 5/2006 | Makin |
| 2006/0116583 | A1 | 6/2006 | Ogasawara et al. |
| 2006/0116671 | A1 | 6/2006 | Slayton |
| 2006/0122508 | A1 | 6/2006 | Slayton |
| 2006/0122509 | A1 | 6/2006 | Desilets |
| 2006/0161062 | A1 | 7/2006 | Arditi et al. |
| 2006/0184069 | A1 | 8/2006 | Vaitekunas |
| 2006/0184071 | A1 | 8/2006 | Klopotek |
| 2006/0189972 | A1 | 8/2006 | Grossman |
| 2006/0206105 | A1 | 9/2006 | Chopra |
| 2006/0224090 | A1 | 10/2006 | Ostrovsky et al. |
| 2006/0229514 | A1 | 10/2006 | Wiener |
| 2006/0238068 | A1 | 10/2006 | May et al. |
| 2006/0241440 | A1 | 10/2006 | Eshel |
| 2006/0241442 | A1 | 10/2006 | Barthe |
| 2006/0241470 | A1 | 10/2006 | Novak et al. |
| 2006/0241576 | A1 | 10/2006 | Diederich et al. |
| 2006/0250046 | A1 | 11/2006 | Koizumi et al. |
| 2006/0282691 | A1 | 12/2006 | Barthe |
| 2006/0291710 | A1 | 12/2006 | Wang et al. |
| 2007/0016039 | A1 | 1/2007 | Vortman et al. |
| 2007/0032784 | A1 | 2/2007 | Gilklich et al. |
| 2007/0035201 | A1 | 2/2007 | Desilets |
| 2007/0055154 | A1 | 3/2007 | Torbati |

(56) References Cited

U.S. PATENT DOCUMENTS

2007/0055155 A1 3/2007 Owen et al.
2007/0055156 A1 3/2007 Desilets et al.
2007/0065420 A1 3/2007 Johnson
2007/0083120 A1 4/2007 Cain et al.
2007/0087060 A1 4/2007 Dietrich
2007/0088245 A1 4/2007 Babaev et al.
2007/0088346 A1 4/2007 Mirizzi et al.
2007/0161902 A1 7/2007 Dan
2007/0166357 A1 7/2007 Shaffer et al.
2007/0167709 A1 7/2007 Slayton
2007/0208253 A1 9/2007 Slayton
2007/0219448 A1 9/2007 Seip et al.
2007/0219604 A1 9/2007 Yaroslavsky et al.
2007/0219605 A1 9/2007 Yaroslavsky et al.
2007/0238994 A1 10/2007 Stecco et al.
2007/0239075 A1 10/2007 Rosenberg
2007/0239077 A1 10/2007 Azhari et al.
2007/0239079 A1 10/2007 Manstein et al.
2007/0239142 A1 10/2007 Altshuler
2008/0015435 A1 1/2008 Cribbs et al.
2008/0027328 A1 1/2008 Klopotek
2008/0033458 A1 2/2008 McLean et al.
2008/0039724 A1 2/2008 Seip et al.
2008/0071255 A1 3/2008 Barthe
2008/0086054 A1 4/2008 Slayton
2008/0086056 A1 4/2008 Chang et al.
2008/0097214 A1 4/2008 Meyers et al.
2008/0097253 A1 4/2008 Pedersen et al.
2008/0114251 A1 5/2008 Weymer
2008/0139943 A1 6/2008 Deng et al.
2008/0139974 A1 6/2008 Da Silva
2008/0146970 A1 6/2008 Litman et al.
2008/0167556 A1 7/2008 Thompson
2008/0183077 A1 7/2008 Moreau-Gobard et al.
2008/0183110 A1 7/2008 Davenport et al.
2008/0188745 A1 8/2008 Chen et al.
2008/0194964 A1 8/2008 Randall et al.
2008/0195000 A1 8/2008 Spooner et al.
2008/0200810 A1 8/2008 Buchalter
2008/0200813 A1 8/2008 Quistgaard
2008/0214966 A1 9/2008 Slayton
2008/0214988 A1 9/2008 Altshuler et al.
2008/0221491 A1 9/2008 Slayton
2008/0223379 A1 9/2008 Stuker
2008/0242991 A1 10/2008 Moon et al.
2008/0243035 A1 10/2008 Crunkilton
2008/0269608 A1 10/2008 Anderson et al.
2008/0275342 A1 11/2008 Barthe
2008/0281206 A1 11/2008 Bartlett et al.
2008/0281236 A1 11/2008 Eshel et al.
2008/0281237 A1 11/2008 Slayton
2008/0281255 A1 11/2008 Slayton
2008/0294072 A1 11/2008 Crutchfield, III
2008/0294073 A1 11/2008 Barthe
2008/0319356 A1 12/2008 Cain
2009/0005680 A1 1/2009 Jones et al.
2009/0012394 A1 1/2009 Hobelsberger et al.
2009/0043198 A1 2/2009 Milner et al.
2009/0043293 A1 2/2009 Pankratov et al.
2009/0048514 A1 2/2009 Azhari et al.
2009/0069677 A1 3/2009 Chen et al.
2009/0093737 A1 4/2009 Chomas et al.
2009/0156969 A1 6/2009 Santangelo
2009/0163807 A1 6/2009 Sliwa
2009/0171252 A1 7/2009 Bockenstedt et al.
2009/0171266 A1 7/2009 Harris
2009/0177122 A1 7/2009 Peterson
2009/0177123 A1 7/2009 Peterson
2009/0182231 A1 7/2009 Barthe et al.
2009/0198157 A1 8/2009 Babaev et al.
2009/0216159 A1 8/2009 Slayton et al.
2009/0226424 A1 9/2009 Hsu
2009/0227910 A1 9/2009 Pedersen et al.
2009/0230823 A1 9/2009 Kushculey et al.
2009/0253988 A1 10/2009 Slayton et al.
2009/0281463 A1 11/2009 Chapelon et al.
2009/0312693 A1 12/2009 Thapliyal et al.
2009/0318909 A1 12/2009 Debenedictis et al.
2009/0326420 A1 12/2009 Moonen et al.
2010/0011236 A1 1/2010 Barthe et al.
2010/0022919 A1 1/2010 Peterson
2010/0022921 A1 1/2010 Seip et al.
2010/0022922 A1 1/2010 Barthe et al.
2010/0030076 A1 2/2010 Vortman et al.
2010/0042020 A1 2/2010 Ben-Ezra
2010/0049178 A1 2/2010 Deem et al.
2010/0056925 A1 3/2010 Zhang et al.
2010/0100014 A1 4/2010 Eshel et al.
2010/0113983 A1 5/2010 Heckerman et al.
2010/0130891 A1 5/2010 Taggart et al.
2010/0160782 A1 6/2010 Slayton et al.
2010/0160837 A1 6/2010 Hunziker et al.
2010/0168576 A1 7/2010 Poland et al.
2010/0191120 A1 7/2010 Kraus et al.
2010/0241035 A1 9/2010 Barthe et al.
2010/0249602 A1 9/2010 Buckley et al.
2010/0249669 A1 9/2010 Ulric et al.
2010/0256489 A1 10/2010 Pedersen et al.
2010/0274161 A1 10/2010 Azhari et al.
2010/0280420 A1 11/2010 Barthe et al.
2010/0286518 A1 11/2010 Lee et al.
2010/0312150 A1 12/2010 Douglas et al.
2011/0040171 A1 2/2011 Foley et al.
2011/0040190 A1 2/2011 Jahnke et al.
2011/0040213 A1 2/2011 Dietz et al.
2011/0040214 A1 2/2011 Foley et al.
2011/0066084 A1 3/2011 Desilets et al.
2011/0072970 A1 3/2011 Slobodzian et al.
2011/0077514 A1 3/2011 Ulric et al.
2011/0079083 A1 4/2011 Yoe et al.
2011/0087099 A1 4/2011 Eshel et al.
2011/0087255 A1 4/2011 McCormack et al.
2011/0112405 A1 5/2011 Barthe et al.
2011/0144490 A1 6/2011 Davis et al.
2011/0178444 A1 7/2011 Slayton et al.
2011/0178541 A1 7/2011 Azhari
2011/0190745 A1 8/2011 Uebelhoer et al.
2011/0201976 A1 8/2011 Sanghvi et al.
2011/0251524 A1 10/2011 Azhari et al.
2011/0251527 A1 10/2011 Kushculey et al.
2011/0270137 A1 11/2011 Goren et al.
2011/0319793 A1 12/2011 Henrik et al.
2011/0319794 A1 12/2011 Gertner
2012/0004549 A1 1/2012 Barthe et al.
2012/0016239 A1 1/2012 Barthe et al.
2012/0029353 A1 2/2012 Slayton et al.
2012/0035473 A1 2/2012 Sanghvi et al.
2012/0035475 A1 2/2012 Barthe et al.
2012/0035476 A1 2/2012 Barthe et al.
2012/0046547 A1 2/2012 Barthe et al.
2012/0053458 A1 3/2012 Barthe et al.
2012/0059288 A1 3/2012 Barthe et al.
2012/0111339 A1 5/2012 Barthe et al.
2012/0123304 A1 5/2012 Rybyanets et al.
2012/0136280 A1 5/2012 Rosenberg et al.
2012/0136282 A1 5/2012 Rosenberg et al.
2012/0143056 A1 6/2012 Slayton et al.
2012/0143100 A1 6/2012 Jeong et al.
2012/0165668 A1 6/2012 Slayton et al.
2012/0165848 A1 6/2012 Slayton et al.
2012/0191019 A1 7/2012 Desilets et al.
2012/0191020 A1 7/2012 Vitek et al.
2012/0197120 A1 8/2012 Makin et al.
2012/0197121 A1 8/2012 Slayton et al.
2012/0209150 A1 8/2012 Zeng et al.
2012/0215105 A1 8/2012 Slayton et al.
2012/0271202 A1 10/2012 Wisdom
2012/0271294 A1 10/2012 Barthe et al.
2012/0277639 A1 11/2012 Pollock et al.
2012/0296240 A1 11/2012 Azhari et al.
2012/0302883 A1 11/2012 Kong et al.
2012/0316426 A1 12/2012 Foley et al.
2012/0330197 A1 12/2012 Makin et al.
2012/0330222 A1 12/2012 Makin et al.

(56) References Cited

U.S. PATENT DOCUMENTS

2012/0330223 A1 12/2012 Makin et al.
2012/0330283 A1 12/2012 Hyde et al.
2012/0330284 A1 12/2012 Hyde et al.
2013/0012755 A1 1/2013 Slayton
2013/0012816 A1 1/2013 Slayton et al.
2013/0012838 A1 1/2013 Jaeger et al.
2013/0012842 A1 1/2013 Barthe
2013/0018285 A1 1/2013 Park et al.
2013/0018286 A1 1/2013 Slayton et al.
2013/0046209 A1 2/2013 Slayton et al.
2013/0051178 A1 2/2013 Rybyanets
2013/0060170 A1 3/2013 Lee et al.
2013/0066208 A1 3/2013 Barthe et al.
2013/0066237 A1 3/2013 Smotrich et al.
2013/0072826 A1 3/2013 Slayton et al.
2013/0073001 A1 3/2013 Campbell
2013/0096471 A1 4/2013 Slayton et al.
2013/0096596 A1 4/2013 Schafer
2013/0190659 A1 7/2013 Slayton et al.
2013/0211293 A1 8/2013 Auboiroux et al.
2013/0225994 A1 8/2013 Hsu et al.
2013/0268032 A1 10/2013 Neev
2013/0274603 A1 10/2013 Barthe et al.
2013/0278111 A1 10/2013 Sammoura et al.
2013/0281853 A1 10/2013 Slayton et al.
2013/0281891 A1 10/2013 Slayton et al.
2013/0296697 A1 11/2013 Slayton et al.
2013/0296700 A1 11/2013 Slayton et al.
2013/0296743 A1 11/2013 Lee et al.
2013/0303904 A1 11/2013 Barthe et al.
2013/0303905 A1 11/2013 Barthe et al.
2013/0310714 A1 11/2013 Eshel et al.
2013/0310863 A1 11/2013 Makin et al.
2013/0345562 A1 12/2013 Barthe et al.
2014/0024974 A1 1/2014 Slayton et al.
2014/0050054 A1 2/2014 Toda et al.
2014/0081300 A1 3/2014 Melodelima et al.
2014/0082907 A1 3/2014 Barthe et al.
2014/0117814 A1 5/2014 Toda et al.
2014/0142430 A1 5/2014 Slayton et al.
2014/0148834 A1 5/2014 Barthe et al.
2014/0155747 A1 6/2014 Bennett et al.
2014/0180174 A1 6/2014 Slayton et al.
2014/0187944 A1 7/2014 Slayton et al.
2014/0188015 A1 7/2014 Slayton et al.
2014/0188145 A1 7/2014 Slayton et al.
2014/0194723 A1 7/2014 Herzog et al.
2014/0208856 A1 7/2014 Schmid
2014/0221823 A1 8/2014 Keogh et al.
2014/0236049 A1 8/2014 Barthe et al.
2014/0236061 A1 8/2014 Lee et al.
2014/0243713 A1 8/2014 Slayton et al.
2014/0257145 A1 9/2014 Emery
2014/0276055 A1 9/2014 Barthe et al.
2015/0000674 A1 1/2015 Barthe et al.
2015/0025420 A1 1/2015 Slayton et al.
2015/0064165 A1 3/2015 Perry et al.
2015/0080723 A1 3/2015 Barthe et al.
2015/0080771 A1 3/2015 Barthe et al.
2015/0080874 A1 3/2015 Slayton et al.
2015/0088182 A1 3/2015 Slayton et al.
2015/0141734 A1 5/2015 Chapelon et al.
2015/0164734 A1 6/2015 Slayton et al.
2015/0165238 A1 6/2015 Slayton et al.
2015/0165243 A1 6/2015 Slayton et al.
2015/0174388 A1 6/2015 Slayton
2015/0202468 A1 7/2015 Slayton et al.
2015/0217141 A1 8/2015 Barthe et al.
2015/0238258 A1 8/2015 Palero et al.
2015/0297188 A1 10/2015 Konofagou et al.
2015/0321026 A1 11/2015 Branson et al.
2015/0360058 A1 12/2015 Barthe et al.
2015/0374333 A1 12/2015 Barthe et al.
2015/0375014 A1 12/2015 Slayton et al.
2016/0001097 A1 1/2016 Cho et al.
2016/0016015 A1 1/2016 Slayton et al.
2016/0027994 A1 1/2016 Toda et al.
2016/0051321 A1* 2/2016 Salahieh ..... A61B 8/12 600/439
2016/0151618 A1 6/2016 Powers et al.
2016/0158580 A1 6/2016 Slayton et al.
2016/0175619 A1 6/2016 Lee et al.
2016/0206335 A1 7/2016 Slayton
2016/0206341 A1 7/2016 Slayton
2016/0256675 A1 9/2016 Slayton
2016/0296769 A1 10/2016 Barthe et al.
2016/0310444 A1 10/2016 Dobak, III
2016/0361571 A1 12/2016 Bernabei
2016/0361572 A1 12/2016 Slayton
2017/0028227 A1 2/2017 Emery et al.
2017/0043190 A1 2/2017 Barthe et al.
2017/0050019 A1 2/2017 Ron Edoute et al.
2017/0080257 A1 3/2017 Paunescu et al.
2017/0100585 A1 4/2017 Hall et al.
2017/0119345 A1 5/2017 Levien et al.
2017/0136263 A1 5/2017 Reil
2017/0209201 A1 7/2017 Slayton et al.
2017/0209202 A1 7/2017 Friedrichs et al.
2017/0304654 A1 10/2017 Blanche et al.
2017/0368574 A1* 12/2017 Sammoura ..... H01L 41/0471
2018/0001113 A1 1/2018 Streeter
2018/0015308 A1 1/2018 Reed et al.
2018/0043147 A1 2/2018 Slayton
2018/0099162 A1 4/2018 Bernabei
2018/0099163 A1 4/2018 Bernabei
2018/0126190 A1 5/2018 Aviad et al.
2018/0154184 A1 6/2018 Kong et al.
2018/0207450 A1 7/2018 Sanchez et al.
2018/0272156 A1 9/2018 Slayton et al.
2018/0272157 A1 9/2018 Barthe et al.
2018/0272158 A1 9/2018 Barthe et al.
2018/0272159 A1 9/2018 Slayton et al.
2018/0317884 A1 11/2018 Chapelon et al.
2018/0333595 A1 11/2018 Barthe et al.
2018/0360420 A1 12/2018 Vortman et al.
2019/0000498 A1 1/2019 Barthe et al.
2019/0009110 A1 1/2019 Gross et al.
2019/0009111 A1 1/2019 Myhr et al.
2019/0022405 A1 1/2019 Greenbaum et al.
2019/0038921 A1 2/2019 Domankevitz
2019/0060675 A1 2/2019 Krone et al.
2019/0091490 A1 3/2019 Alexander et al.
2019/0142380 A1 5/2019 Emery et al.
2019/0143148 A1 5/2019 Slayton
2019/0184202 A1 6/2019 Zereshkian et al.
2019/0184203 A1 6/2019 Slayton et al.
2019/0184205 A1 6/2019 Slayton et al.
2019/0184207 A1 6/2019 Barthe et al.
2019/0184208 A1 6/2019 Barthe et al.
2019/0224501 A1 7/2019 Burdette
2019/0262634 A1 8/2019 Barthe et al.
2019/0282834 A1 9/2019 Zawada et al.
2019/0290939 A1 9/2019 Watson et al.
2019/0350562 A1 11/2019 Slayton et al.
2019/0366126 A1 12/2019 Pahk et al.
2019/0366127 A1 12/2019 Emery
2019/0366128 A1 12/2019 Slayton et al.
2020/0094083 A1 3/2020 Slayton et al.
2020/0100762 A1 4/2020 Barthe et al.
2020/0129759 A1 4/2020 Schwarz
2020/0171330 A1 6/2020 Barthe et al.
2020/0179727 A1 6/2020 Slayton et al.
2020/0179729 A1 6/2020 Slayton et al.
2020/0188703 A1 6/2020 Barthe et al.
2020/0188704 A1 6/2020 Barthe et al.
2020/0206072 A1 7/2020 Capelli et al.
2020/0222728 A1 7/2020 Khokhlova et al.
2021/0038925 A1 2/2021 Emery

FOREIGN PATENT DOCUMENTS

CN 104027893 9/2014
DE 4029175 3/1992
DE 10140064 3/2003

(56) References Cited

FOREIGN PATENT DOCUMENTS

| | | |
|---|---|---|
| DE | 10219297 | 11/2003 |
| DE | 10219217 | 12/2004 |
| DE | 20314479 | 12/2004 |
| EP | 0142215 | 5/1984 |
| EP | 0344773 | 12/1989 |
| EP | 1479412 | 11/1991 |
| EP | 0473553 | 4/1992 |
| EP | 670147 | 2/1995 |
| EP | 0661029 | 7/1995 |
| EP | 724894 | 2/1996 |
| EP | 763371 | 11/1996 |
| EP | 1044038 | 10/2000 |
| EP | 1050322 | 11/2000 |
| EP | 1234566 | 8/2002 |
| EP | 1262160 | 12/2002 |
| EP | 0659387 | 4/2003 |
| EP | 1374944 | 1/2004 |
| EP | 1028660 | 1/2008 |
| EP | 1874241 | 1/2008 |
| EP | 1362223 | 5/2008 |
| EP | 1750804 | 7/2008 |
| EP | 1283690 | 11/2008 |
| EP | 1811901 | 4/2009 |
| EP | 1785164 | 8/2009 |
| EP | 2230904 | 9/2010 |
| EP | 1501331 | 6/2011 |
| EP | 2066405 | 11/2011 |
| EP | 2474050 | 7/2012 |
| EP | 2709726 | 11/2015 |
| EP | 1538980 | 1/2017 |
| EP | 3124047 | 1/2017 |
| EP | 2897547 | 11/2017 |
| EP | 2173261 B1 | 8/2018 |
| EP | 3417911 | 12/2018 |
| FR | 2532851 | 9/1983 |
| FR | 2685872 | 1/1992 |
| FR | 2672486 | 8/1992 |
| FR | 2703254 | 3/1994 |
| GB | 2113099 | 8/1983 |
| IL | 102516 | 1/1996 |
| IL | 112369 | 8/1999 |
| IL | 120079 | 3/2001 |
| JP | 63036171 | 2/1988 |
| JP | 03048299 | 3/1991 |
| JP | 3123559 | 5/1991 |
| JP | 03136642 | 6/1991 |
| JP | 4089058 | 3/1992 |
| JP | 04150847 | 5/1992 |
| JP | 7080087 | 3/1995 |
| JP | 07505793 | 6/1995 |
| JP | 7184907 | 7/1995 |
| JP | 7222782 | 8/1995 |
| JP | 09047458 | 2/1997 |
| JP | 9108288 | 4/1997 |
| JP | 9503926 | 4/1997 |
| JP | 11123226 | 5/1999 |
| JP | 11505440 | 5/1999 |
| JP | 11506636 | 6/1999 |
| JP | 10248850 | 9/1999 |
| JP | 2000126310 | 5/2000 |
| JP | 2000166940 | 6/2000 |
| JP | 2000233009 | 8/2000 |
| JP | 2001-46387 | 2/2001 |
| JP | 2001136599 A | 5/2001 |
| JP | 2001170068 | 6/2001 |
| JP | 2002505596 | 2/2002 |
| JP | 2002078764 | 3/2002 |
| JP | 2002515786 | 5/2002 |
| JP | 2002537013 | 5/2002 |
| JP | 2002521118 | 7/2002 |
| JP | 2002537939 | 11/2002 |
| JP | 2003050298 | 7/2003 |
| JP | 2003204982 | 7/2003 |
| JP | 2004-504898 | 2/2004 |
| JP | 2004-507280 | 3/2004 |
| JP | 2004154256 | 3/2004 |
| JP | 2004-509671 | 4/2004 |
| JP | 2004-512856 | 4/2004 |
| JP | 2004147719 | 5/2004 |
| JP | 2005503388 | 2/2005 |
| JP | 2005527336 | 9/2005 |
| JP | 2005323213 | 11/2005 |
| JP | 2006520247 | 9/2006 |
| JP | 2008515559 | 5/2008 |
| JP | 2009518126 | 5/2009 |
| JP | 2010517695 | 5/2010 |
| KR | 2001-0019317 | 3/2001 |
| KR | 1020010024871 | 3/2001 |
| KR | 2002-0038547 | 5/2002 |
| KR | 100400870 | 10/2003 |
| KR | 20060121267 | 11/2006 |
| KR | 1020060113930 | 11/2006 |
| KR | 1020070065332 | 6/2007 |
| KR | 1020070070161 | 7/2007 |
| KR | 1020070098856 | 10/2007 |
| KR | 1020070104878 | 10/2007 |
| KR | 1020070114105 | 11/2007 |
| KR | 1020000059516 | 4/2012 |
| KR | 10-2013-0124598 | 11/2013 |
| KR | 10-1365946 | 2/2014 |
| TW | 386883 | 9/2000 |
| TW | 201208734 A | 3/2012 |
| WO | WO9312742 | 7/1993 |
| WO | WO9524159 | 9/1995 |
| WO | WO9625888 | 8/1996 |
| WO | WO9634568 | 11/1996 |
| WO | WO9639079 | 12/1996 |
| WO | WO9735518 | 10/1997 |
| WO | WO9832379 | 7/1998 |
| WO | WO9852465 | 11/1998 |
| WO | WO9933520 | 7/1999 |
| WO | WO9939677 | 8/1999 |
| WO | WO9949788 | 10/1999 |
| WO | WO200006032 | 2/2000 |
| WO | WO0015300 | 3/2000 |
| WO | WO0021612 | 4/2000 |
| WO | WO0048518 | 8/2000 |
| WO | WO0053113 | 9/2000 |
| WO | WO200071021 | 11/2000 |
| WO | WO0128623 | 4/2001 |
| WO | WO01045550 | 6/2001 |
| WO | Wo0182777 | 11/2001 |
| WO | WO0182778 | 11/2001 |
| WO | WO0187161 | 11/2001 |
| WO | WO01080709 | 11/2001 |
| WO | WO2001087161 | 11/2001 |
| WO | WO0209812 | 2/2002 |
| WO | WO0209813 | 2/2002 |
| WO | WO02015768 | 2/2002 |
| WO | WO0224050 | 3/2002 |
| WO | WO2002054018 | 7/2002 |
| WO | WO02092168 | 11/2002 |
| WO | WO03053266 | 7/2003 |
| WO | WO03065347 | 8/2003 |
| WO | WO03070105 | 8/2003 |
| WO | WO03077833 | 9/2003 |
| WO | WO03086215 | 10/2003 |
| WO | WO03096883 | 11/2003 |
| WO | WO03099177 | 12/2003 |
| WO | WO03099382 | 12/2003 |
| WO | WO03101530 | 12/2003 |
| WO | WO2004000116 | 12/2003 |
| WO | WO2004080147 | 9/2004 |
| WO | WO2004110558 | 12/2004 |
| WO | WO2005/011804 | 2/2005 |
| WO | WO2005065408 | 7/2005 |
| WO | WO2005065409 | 7/2005 |
| WO | WO2005090978 | 9/2005 |
| WO | WO2005113068 | 12/2005 |
| WO | WO2006/042163 | 4/2006 |
| WO | WO2006036870 | 4/2006 |
| WO | WO2006042168 | 4/2006 |
| WO | WO2006042201 | 4/2006 |
| WO | WO2006065671 | 6/2006 |

(56) References Cited

FOREIGN PATENT DOCUMENTS

| | | |
|---|---|---|
| WO | WO2006082573 | 8/2006 |
| WO | WO2006104568 | 10/2006 |
| WO | WO2007067563 | 6/2007 |
| WO | WO2008036479 | 3/2008 |
| WO | WO2008036622 | 3/2008 |
| WO | WO2008144274 | 11/2008 |
| WO | WO2009013729 | 1/2009 |
| WO | WO2009149390 | 10/2009 |
| WO | WO2012134645 | 10/2012 |
| WO | WO2013048912 | 4/2013 |
| WO | WO2013178830 | 12/2013 |
| WO | WO2014045216 | 3/2014 |
| WO | WO2014055708 | 4/2014 |
| WO | WO2014057388 | 4/2014 |
| WO | WO2014127091 | 8/2014 |
| WO | WO2015160708 | 10/2015 |
| WO | WO2016054155 | 4/2016 |
| WO | WO2016115363 | 7/2016 |
| WO | WO2017127328 | 7/2017 |
| WO | WO2017149506 | 9/2017 |
| WO | WO2017165595 | 9/2017 |
| WO | WO 2017/212489 | 12/2017 |
| WO | WO2017212489 | 12/2017 |
| WO | WO2018035012 | 2/2018 |
| WO | WO2018158355 | 9/2018 |
| WO | WO2019008573 | 1/2019 |
| WO | WO2019147596 | 8/2019 |
| WO | WO 2019147596 | 8/2019 |
| WO | WO2019164836 | 8/2019 |
| WO | WO2020009324 | 1/2020 |
| WO | WO2020075906 | 4/2020 |
| WO | WO2020080730 | 4/2020 |
| WO | WO2020121307 | 6/2020 |

OTHER PUBLICATIONS

U.S. Appl. No. 12/996,616, filed Jan. 12, 2011, Hand Wand for Ultrasonic Cosmetic Treatment and Imaging.
U.S. Appl. No. 16/703,019, filed Dec. 6, 2019, System and Method for Ultrasound Treatment.
U.S. Appl. No. 13/245,822, filed Sep. 26, 2011, System and Method for Cosmetic Treatment.
U.S. Appl. No. 13/245,852, filed Sep. 26, 2011, Systems for Cosmetic Treatment.
U.S. Appl. No. 13/245,864, filed Sep. 27, 2011, Methods for Non-Invasive Cosmetic Treatment of the Eye Region.
U.S. Appl. No. 13/246,117, filed Sep. 27, 2011, Methods for Non-Invasive Lifting and Tightening of the Lower Face and Neck.
U.S. Appl. No. 13/246,112, filed Sep. 27, 2011, Tissue Imaging and Treatment Method.
U.S. Appl. No. 14/193,234, filed Sep. 28, 2014, Devices and Methods for Multi-Focus Ultrasound Therapy.
U.S. Appl. No. 16/541,476, filed Aug. 15, 2019, Devices and Methods for Multi-Focus Ultrasound Therapy.
U.S. Appl. No. 15/302,436, filed Oct. 6, 2016, Band Transducer Ultrasound Therapy.
U.S. Appl. No. 15/855,949, filed Dec. 27, 2017, Band Transducer Ultrasound Therapy.
U.S. Appl. No. 16/797,393, filed Feb. 21, 2020, Band Transducer Ultrasound Therapy.
U.S. Appl. No. 15/562,384, filed Oct. 27, 2017, Systems and Methods for Cosmetic Ultrasound Treatment of Skin.
U.S. Appl. No. 16/069,319, filed Jul. 11, 2018, Compact ultrasound device having annular ultrasound array peripherally electrically connected to flexible printed circuit board and method of assembly thereof.
U.S. Appl. No. 16/964,914, filed Jul. 24, 2020, Systems and Methods for Simultaneous Multi-Focus Ultrasound Therapy in Multiple Dimensions.
U.S. Appl. No. 16/970,772, filed Aug. 18, 2020, Systems and Methods for Combined Cosmetic Treatment of Cellulite With Ultrasound.
U.S. Appl. No. 08/950,353, filed Oct. 14, 1997, Imaging, Therapy and Temperature Monitoring Ultrasonic System.
U.S. Appl. No. 09/502,174, filed Feb. 10, 2000, Imaging, Therapy and Temperature Monitoring Ultrasonic System.
U.S. Appl. No. 10/193,419, filed Jul. 10, 2002, Imaging, Therapy and Temperature Monitoring Ultrasonic System.
U.S. Appl. No. 10/944,499, filed Sep. 16, 2004, Method and System for Ultrasound Treatment With a Multi-Directional Transducer.
U.S. Appl. No. 11/163,177, filed Oct. 7, 2005, Method and System for Treating Acne and Sebaceous Glands.
U.S. Appl. No. 10/950,112, filed Sep. 24, 2004, Method and System for Combined Ultrasound Treatment.
U.S. Appl. No. 11/163,178, filed Oct. 7, 2005, Method and System for Treating Stretch Marks.
U.S. Appl. No. 11/245,999, filed Oct. 6, 2005, System and Method for Ultra-High Frequency Ultrasound Treatment.
U.S. Appl. No. 10/944,500, filed Sep. 16, 2004, System and Method for Variable Depth Ultrasound Treatment.
U.S. Appl. No. 11/744,655, filed May 4, 2007, Imaging, Therapy and Temperature Monitoring Ultrasonic System.
U.S. Appl. No. 13/937,190, filed Jul. 8, 2013, Imaging, Therapy and Temperature Monitoring Ultrasonic System.
U.S. Appl. No. 12/135,962, filed Jun. 9, 2008, Method and System for Ultrasound Treatment With a Multi-Directional Transducer.
U.S. Appl. No. 12/792,934, filed Jun. 3, 2010, System and Method for Ultra-High Frequency Ultrasound Treatment.
U.S. Appl. No. 13/914,945, filed Jun. 11, 2013, System and Method for Ultra-High Frequency Ultrasound Treatment.
U.S. Appl. No. 12/834,754, filed Jul. 12, 2010, System and Method for Variable Depth Ultrasound Treatment.
U.S. Appl. No. 14/264,732, filed Apr. 29, 2014, System and Method for Variable Depth Ultrasound Treatment.
U.S. Appl. No. 11/126,760, filed May 11, 2005, Method and System for Three-Dimensional Scanning and Imaging.
U.S. Appl. No. 13/564,552, filed Aug. 1, 2012, Method and System for Controlled Scanning, Imaging and/or Therapy.
U.S. Appl. No. 12/437,726, filed May 8, 2009, Method and System for Combined Ultrasound Treatment.
U.S. Appl. No. 11/163,148, filed Oct. 6, 2005, Method and System for Controlled Thermal Injury of Human Superficial Tissue.
U.S. Appl. No. 13/444,688, filed Apr. 11, 2012, Customized Cosmetic Treatment.
U.S. Appl. No. 16/427,969, filed May 31, 2019, Customized Cosmetic Treatment.
U.S. Appl. No. 11/163,152, filed Oct. 6, 2005, Method and System for Treatment of Sweat Glands.
U.S. Appl. No. 13/444,485, filed Apr. 11, 2012, Methods for Treatment of Sweat Glands.
U.S. Appl. No. 13/603,159, filed Sep. 4, 2012, Methods for Treatment of Hyperhidrosis.
U.S. Appl. No. 13/603,279, filed Sep. 4, 2012, Energy Based Hyperhidrosis Treatment.
U.S. Appl. No. 13/950,728, filed Jul. 25, 2013, Energy Based Hyperhidrosis Treatment.
U.S. Appl. No. 14/571,835, filed Dec. 16, 2014, Energy Based Hyperhidrosis Treatment.
U.S. Appl. No. 15/243,081, filed Aug. 22, 2016, Energy Based Hyperhidrosis Treatment.
U.S. Appl. No. 16/049,365, filed Jul. 30, 2018, Energy Based Hyperhidrosis Treatment.
U.S. Appl. No. 11/163,151, filed Oct. 6, 2005, Method and System for Noninvasive Face Lifts and Deep Tissue Tightening.
U.S. Appl. No. 13/444,436, fied Apr. 11, 2012, Treatment of Sub-Dermal Regions for Cosmetic Effects.
U.S. Appl. No. 13/679,430, filed Nov. 16, 2012, Ultrasound Treatment of Sub-Dermal Tissue for Cosmetic Effects.
U.S. Appl. No. 13/924,376, filed Jun. 21, 2013, Noninvasive Tissue Tightening for Cosmetic Effects.
U.S. Appl. No. 13/924,355, filed Jun. 21, 2013, Noninvasive Aesthetic Treatment for Tightening Tissue.
U.S. Appl. No. 13/924,323, filed Jun. 21, 2013, Energy-Based Tissue Tightening.

(56) References Cited

OTHER PUBLICATIONS

U.S. Appl. No. 14/200,852, filed Mar. 7, 2014, Noninvasive Tissue Tightening System.
U.S. Appl. No. 14/200,961, filed Mar. 7, 2014, Energy-Based Tissue Tightening System.
U.S. Appl. No. 16/543,137, filed Aug. 16, 2019, Noninvasive Tissue Tightening System.
U.S. Appl. No. 12/028,636, filed Feb. 8, 2008, Method and System for Noninvasive Face Lifts and Deep Tissue Tightening.
U.S. Appl. No. 13/964,820, filed Aug. 12, 2013, Methods for Noninvasive Skin Tightening.
U.S. Appl. No. 14/201,256, filed Mar. 7, 2014, System for Noninvasive Skin Tightening.
U.S. Appl. No. 15/098,139, filed Apr. 13, 2016, System and Method for Noninvasive Skin Tightening.
U.S. Appl. No. 15/958,939, filed Apr. 20, 2018, System and Method for Noninvasive Skin Tightening.
U.S. Appl. No. 16/698,122, filed Nov. 27, 2019, System and Method for Noninvasive Skin Tightening.
U.S. Appl. No. 14/685,390, filed Apr. 13, 2015, Energy-Based Tissue Tightening System.
U.S. Appl. No. 11/163,150, filed Oct. 6, 2005, Method and System for Photoaged Tissue.
U.S. Appl. No. 13/230,498, filed Sep. 12, 2011, Method and System for Photoaged Tissue.
U.S. Appl. No. 14/169/709, filed Jan. 31, 2014, Methods for Treating Skin Laxity.
U.S. Appl. No. 14/692,114, filed Apr. 21, 2015, Systems for Treating Skin Laxity.
U.S. Appl. No. 15/248,407, filed Aug. 26, 2016, Systems for Treating Skin Laxity.
U.S. Appl. No. 15/625,700, filed Jan. 16, 2017, Systems for Treating Skin Laxity.
U.S. Appl. No. 15/821,070, filed Nov. 22, 2017, Ultrasound Probe for Treating Skin Laxity.
U.S. Appl. No. 15/996,255, filed Jun. 1, 2018, Ultrasound Probe for Treating Skin Laxity.
U.S. Appl. No. 16/284,907, filed Feb. 25, 2019, Ultrasound Probe for Treating Skin Laxity.
U.S. Appl. No. 16/797,362, filed Feb. 21, 2020, Ultrasound Probe for Treating Skin Laxity.
U.S. Appl. No. 17/127,721, filed Dec. 18, 2020, Ultrasound Probe for Treating Skin Laxity.
U.S. Appl. No. 11/163,176, filed Oct. 7, 2005, Method and System for Treating Blood Vessel Disorders.
U.S. Appl. No. 13/601,742, filed Aug. 31, 2012, Method and System for Treating Blood Vessel Disorders.
U.S. Appl. No. 12/574,512, filed Oct. 6, 2009, Method and System for Treating Stretch Marks.
U.S. Appl. No. 14/554,668, filed Nov. 26, 2014, Method and System for Treating Stretch Marks.
U.S. Appl. No. 15/260,825, filed Sep. 12, 2016, Method and System for Ultrasound Treatment of Skin.
U.S. Appl. No. 15/625,818, filed Jun. 16, 2017, Method and System for Ultrasound Treatment of Skin.
U.S. Appl. No. 15/829,182, filed Dec. 1, 2017, Ultrasound Probe for Treatment of Skin.
U.S. Appl. No. 15/996,263, filed Jun. 1, 2018, Ultrasound Probe for Treatment of Skin.
U.S. Appl. No. 16/284,920, filed Feb. 25, 2019, Ultrasound Probe for Treatment of Skin.
U.S. Appl. No. 16/797,387, filed Feb. 21, 2020, Ultrasound Probe for Treatment of Skin.
U.S. Appl. No. 11/857,989, filed Sep. 19, 2007, Method and System for Treating Muscle, Tendon, Ligament and Cartilage Tissue.
U.S. Appl. No. 13/494,856, filed Jun 12, 2012, Method and System for Treating Muscle, Tendon, Ligament and Cartilage Tissue.
U.S. Appl. No. 13/835,635, filed Mar. 15, 2013, Methods for Face and Neck Lifts.
U.S. Appl. No. 13/965,741, filed Aug. 13, 2013, Methods for Preheating Tissue for Cosmetic Treatment of the Face and Body.
U.S. Appl. No. 14/740,092, filed Jun. 15, 2015, Methods for Rejuvenating Skin by Heating Tissue for Cosmetic Treatment of the Face and Body.
U.S. Appl. No. 15/862,400, filed Jan. 4, 2018, Rejuvenating Skin by Heating Tissue for Cosmetic Treatment of the Face and Body.
U.S. Appl. No. 16/409,678, filed May 10, 2019, Rejuvenating Skin by Heating Tissue for Cosmetic Treatment of the Face and Body.
U.S. Appl. No. 17/081,754, filed Oct. 27, 2020, Rejuvenating Skin by Heating Tissue for Cosmetic Treatment of the Face and Body.
U.S. Appl. No. 14/628,198, filed Feb. 20, 2015, System and Method for Treating Cartilage and Injuries to Joints and Connective Tissue.
U.S. Appl. No. 14/554,571, filed Nov. 26, 2014, Methods for Face and Neck Lifts.
U.S. Appl. No. 15/248,454,, filed Aug. 26, 2016, Methods for Face and Neck Lifts.
U.S. Appl. No. 16/049,293, filed Jul. 30, 2018, Methods for Face and Neck Lifts.
U.S. Appl. No. 16/367,970, filed Nov. 27, 2019, Methods for Lifting Skin Tissue.
U.S. Appl. No. 12/954,484,, filed Nov. 24, 2010, Methods and Systems for Generating Thermal Bubbles for Improved Ultrasound Imaging and Therapy.
U.S. Appl. No. 12/350,383, filed Jan. 8, 2009, Method and System for Treating Acne and Sebaceous Glands.
U.S. Appl. No. 12/116,845, filed May 7, 2008, Method and System for Combined Energy Profile.
U.S. Appl. No. 14/643,749, filed Mar. 10, 2015, Method and System for Combined Energy Profile.
U.S. Appl. No. 08/766,083, filed Dec. 16, 1996, Method and Apparatus for Surface Ultrasound Imaging.
U.S. Appl. No. 09/113,227, filed Jul. 10, 1998, Method and Apparatus for Three Dimensional Ultrasound Imaging.
U.S. Appl. No. 08/944,261, filed Oct. 6, 1997, Wideband Acoustic Transducer.
U.S. Appl. No. 09/434,078, filed Nov. 5, 1999, Method and Apparatus for Three Dimensional Ultrasound Imaging.
U.S. Appl. No. 09/523,890, filed Mar. 13, 2000, Method and Apparatus for Three Dimensional Ultrasound Imaging.
U.S. Appl. No. 09/419,543, filed Oct. 18, 1999, Peripheral Ultrasound Imaging System.
U.S. Appl. No. 09/750,816, filed Dec. 28, 2000, Visual Imaging System for Ultrasonic Probe.
U.S. Appl. No. 10/358,110, filed Feb. 4, 2003, Visual Imaging System for Ultrasonic Probe.
U.S. Appl. No. 11/380,161, filed Apr. 25, 2006, Method and System for Enhancing Computer Peripheral Safety.
U.S. Appl. No. 11/554,272, filed Oct. 30, 2006, Visual Imaging System for Ultrasonic Probe.
U.S. Appl. No. 13/071,298, filed Mar. 24, 2011, Visual Imaging System for Ultrasonic Probe.
U.S. Appl. No. 13/854,936, filed Mar. 25, 2013, Visual Imaging System for Ultrasonic Probe.
U.S. Appl. No. 12/509,254, filed Jul. 24, 2009, Method and System for Enhancing Computer Peripheral Safety.
U.S. Appl. No. 13/453,847, filed Apr. 23, 2012, Method and System for Enhancing Computer Peripheral Safety.
U.S. Appl. No. 11/538,794, filed Oct. 4, 2006, Ultrasound System and Method for Imaging and/or Measuring Displacement of Moving Tissue and Fluid.
U.S. Appl. No. 09/502,175, filed Feb. 10, 2000, Method and Apparatus for Safely Delivering Medicants to a Region of Tissue, Using Imaging, Therapy and Temperature Monitoring.
U.S. Appl. No. 08/943,728, filed Oct. 3, 1997, Method and Apparatus for Safely Delivering Medicants to a Region of Tissue Using Ultrasound.
U.S. Appl. No. 12/415,945, filed Mar. 31, 2009, Method and System for Noninvasive Mastopexy.
U.S. Appl. No. 11/163,155, filed Oct. 6, 2005, Method and System for Noninvasive Mastopexy.
U.S. Appl. No. 11/163,154, filed Oct. 6, 2005, Method and System for Treatment of Cellulite.

(56) References Cited

OTHER PUBLICATIONS

U.S. Appl. No. 13/356,405, filed Jan. 23, 2012, Method and System for Treatment of Cellulite.
U.S. Appl. No. 13/789,562, filed Mar. 7, 2013, Method and System for Ultrasound Treatment of Fat.
U.S. Appl. No. 14/164,598, filed Jan. 27, 2013, Method for Fat and Cellulite Reduction.
U.S. Appl. No. 14/550,720, filed Nov. 21, 2014, System and Method for Fat and Cellulite Reduction.
U.S. Appl. No. 15/041,829, filed Feb. 11, 2016, System and Method for Fat and Cellulite Reduction.
U.S. Appl. No. 15/374,918, filed Dec. 9, 2016, System and Method for Fat and Cellulite Reduction.
U.S. Appl. No. 15/650,246, filed Jul. 14, 2017, System and Method for Fat and Cellulite Reduction.
U.S. Appl. No. 15/821,281, filed Nov. 22, 2017, Ultrasound Probe for Fat and Cellulite Reduction.
U.S. Appl. No. 15/996,295, filed Jun. 1, 2018, Ultrasound Probe for Fat and Cellulite Reduction.
U.S. Appl. No. 16/272,453, filed Feb. 11, 2019, Ultrasound Probe for Tissue Treatment.
U.S. Appl. No. 16/794,717, filed Feb. 19, 2020, Ultrasound Probe for Tissue Treatment.
U.S. Appl. No. 17/127,705, filed Dec. 18, 2020, Ultrasound Probe for Tissue Treatment.
U.S. Appl. No. 11/738,682, filed Apr. 23, 2007, Method and System for Non-Ablative Acne Treatment and Prevention.
U.S. Appl. No. 12/116,810, filed May 7, 2008, Methods and Systems for Modulating Medicants Using Acoustic Energy.
U.S. Appl. No. 12/116,828, filed May 7, 2008, Methods and Systems for Coupling and Focusing Acoustic Energy Using a Coupler Member.
U.S. Appl. No. 13/646,609, filed Dec. 23, 2009, Methods and System for Fat Reduction and/or Cellulite Treatment.
U.S. Appl. No. 14/192,520, filed Feb. 27, 2014, Energy Based Fat Reduction.
U.S. Appl. No. 14/550,772 filed Feb. Energy Based Fat Reduction.
U.S. Appl. No. 15/401,804, filed Feb. 11, 2016, Energy Based Fat Reduction.
U.S. Appl. No. 15/380,267, filed Dec. 15, 2016, Energy Based Fat Reduction.
U.S. Appl. No. 15/650,525, filed Jul. 18, 2017, Energy Based Fat Reduction.
U.S. Appl. No. 15/829,175, filed Dec. 1, 2017, Energy Based Fat Reduction.
U.S. Appl. No. 15/996,249, filed Jun. 1, 2018, Energy Based Fat Reduction.
U.S. Appl. No. 16/272,427, filed Feb. 11, 2019, Energy Based Fat Reduction.
U.S. Appl. No. 16/794,701, filed Feb. 19, 2020, Energy Based Fat Reduction.
U.S. Appl. No. 17/127,691, filed Dec. 18, 2020, Energy Based Fat Reduction.
U.S. Appl. No. 13/291,312, filed Nov. 11, 2011, Devices and Methods for Acoustic Shielding.
U.S. Appl. No. 14/487,504, filed Sep. 16, 2014, Devices and Methods for Acoustic Shielding.
U.S. Appl. No. 13/136,538, filed Aug. 2, 2011, Systems and Methods for Treating Acute and/or Chronic Injuries in Soft Tissue.
U.S. Appl. No. 13/136,542, filed Aug. 2, 2011, System and Method for Treating Cartilage.
U.S. Appl. No. 13/463,541, filed Aug. 2, 2011, Methods and Systems for Treating Plantar Fascia.
U.S. Appl. No. 13/136,544, filed Aug. 2, 2011, Systems and Methods for Ultrasound Treatment.
U.S. Appl. No. 13/547,023, filed Jul. 11, 2012, Systems and Methods for Coupling an Ultrasound Source to Tissue.
U.S. Appl. No. 13/545,931, filed Jul. 10, 2012, Methods and Systems for Controlling Acoustic Energy Deposition Into a Medium.
U.S. Appl. No. 13/545,953, filed Jul. 10, 2012, Systems and Methods for Accelerating Healing of Implanted Material and/or Native Tissue.
U.S. Appl. No. 13/547,011, filed Jul. 11, 2012, Systems and Methods for Monitoring and Controlling Ultrasound Power Output and Stability.
U.S. Appl. No. 13/545,954, filed Jul. 10, 2012, Systems and Methods for Improving an Outside Appearance of Skin Using Ultrasound As an Energy Source.
U.S. Appl. No. 13/545,945, filed Jul. 10, 2012, Systems and Methods for Treating Injuries to Joints and Connective Tissue.
U.S. Appl. No. 13/545,929, filed Jul. 10, 2012, Methods and Systems for Ultrasound Treatment.
U.S. Appl. No. 13/863,249, filed Apr. 15, 2013, Systems for Cosmetic Treatment.
U.S. Appl. No. 13/863,281, filed Apr. 15, 2013, Methods for Non-invasive Cosmetic Treatment.
U.S. Appl. No. 14/847,626, filed Sep. 8, 2015, Systems for Cosmetic Treatment.
U.S. Appl. No. 13/863,362, filed Apr. 15, 2013, Thick Film Transducer Arrays.
U.S. Appl. No. 14/217,110, filed Mar. 17, 2014, Ultrasound Treatment Device and Method of Use.
U.S. Appl. No. 14/217,382, filed Mar. 17, 2014, Ultrasound Treatment Device and Method of Use.
U.S. Appl. No. 14/225,189, filed Mar. 25, 2014, Reflective Ultrasound Technology for Dermatological Treatments.
U.S. Appl. No. 15/345,908, filed Nov. 8, 2016, Reflective Ultrasound Technology for Dermatological Treatments.
U.S. Appl. No. 15/719,377, filed Sep. 28, 2017, Reflective Ultrasound Technology for Dermatological Treatments.
U.S. Appl. No. 14/270,859, filed May 6, 2014, Methods and Systems for Generating Thermal Bubbles for Improved Ultrasound Imaging and Therapy.
U.S. Appl. No. 14/679,494, filed Apr. 6, 2015, Methods and Systems for Generating Thermal Bubbles for Improved Ultrasound Imaging and Therapy.
U.S. Appl. No. 14/405,368, filed Dec. 3, 2014, Devices and Methods for Ultrasound Focal Depth Control.
U.S. Appl. No. 14/568,954, filed Dec. 12, 2014, System and Method for Cosmetic Enhancement of Lips.
U.S. Appl. No. 14/569,001, filed Dec. 12, 2014, System and Method for Non-Invasive Treatment With Improved Efficiency.
U.S. Appl. No. 14/600,782, filed Jan. 20, 2015, Methods and Systems for Controlling and Acoustic Energy Deposition in Various Media.
U.S. Appl. No. 14/738,420, filed Jun. 12, 2015, Systems and Methods for Fast Ultrasound Treatment.
U.S. Appl. No. 14/751,349, filed Jun. 26, 2015, Methods and Systems for Tattoo Removal.
U.S. Appl. No. 15/001,712, filed Jan. 20, 2016, Methods and Systems for Removal of a Targeted Tissue from a Body.
U.S. Appl. No. 15/001,621, filed Jan. 20, 2016, Methods and Systems for Removal of a Foreign Object from Tissue.
U.S. Appl. No. 15/059,773, filed Mar. 3, 2016, Methods and Systems for Material Transport Across an Impermeable or Semi-Permeable Membrane Via Artificially Created Microchannels.
U.S. Appl. No. 15/094,774, filed Apr. 8, 2016, System and Method for Increased Control of Ultrasound Treatments.
Extended European Search Report in EPO App. 17741797.9 dated Sep. 9, 2019.
Adams et al., "High Intensity Focused Ultrasound Ablation of Rabbit Kidney Tumors" Sonablate High-Intensity Focused Ultrasound device; Journal of Endourology vol. 10, No. 1, (Feb. 1996).
Agren, Magnus S. et al., Collagenase in Wound Healing: Effect of Wound Age and Type. The Journal of Investigative Dermatology, vol. 99/No. 6, (Dec. 1992).
Alam, M., "The future of noninvasive procedural dermatology". Semin Cutan Med Surg. Mar. 2013; 32(1):59-61.
Alam, M., et al., "Ultrasound tightening of facial and neck skin: a rater-blinded prospective cohort study". J Am Acad Dermatol, 2010. 62(2): p. 262-9.

(56) References Cited

OTHER PUBLICATIONS

Alexiades-Armenakas, M., "Ultrasound Technologies for Dermatologic Techniques". J Drugs Derm. 2014. 12 (11): p. 1305.
Alster, T.S., et al., "Noninvasive lifting of arm, thigh, and knee skin with transcutaneousintense focused ultrasound". Dermatol Surg, 2012. 38(5): p. 754-9.
Alster, Tinas S., Tanzi, Elizabeth L., "Cellulite Treatment using a Novel Combination Radiofrequency, Infrared Light, and Mechanical Tissue Manipulation Device," Journal of Cosmetic & Laser Therapy, Jun. 2005, vol. 7, Issue 2, pp. 81-85.
Arosarena, O., "Options and Challenges for Facial Rejuvenation in Patients With Higher Fitzpatrick Skin Phototypes". JAMA Facial Plastic Surgery, 2015.
Arthur et al., "Non-invasive estimation of hyperthermia temperatures with ultrasound," Int. J. Hyperthermia, Sep. 2005, 21(6), pp. 589-600.
Barthe et al., "Ultrasound therapy system and ablation results utilizing miniature imaging/therapy arrays," Ultrasonics Symposium, 2004 IEEE, Aug. 23, 2004, pp. 1792-1795, vol. 3.
Bozec, Laurent et al., Thermal Denaturation Studies of Collagen by Microthermal Analysis and Atomic Force Microscopy, Biophysical Journal, vol. 101, pp. 228-236. (Jul. 2001).
Brobst, R.W., et al., "Noninvasive Treatment of the Neck". Facial Plast Surg Clin North Am, 2014. 22(2): p. 191-202.
Brobst, R.W., et., al., "Ulthera: initial and six month results". Facial Plast Surg Clin North Am, 2012. 20(2): p. 163-76.
Brown J A et al.: "Fabrication and performance of 40-60 MHz annular arrays", 2003 IEEE Ultrasonics Symposium Proceedings. Honolulu, Hawaii, Oct. 5-8, 2003; [IEEE Ultrasonics Symposium Proceedings], New York, NY : IEEE, US, vol. 1, Oct. 5, 2003 (Oct. 5, 2003), pp. 869-872.
Calderhead et al., "One Mechanism Behind LED Photo-Therapy for Wound Healing and Skin Rejuvenation: Key Role of the Mast Cell" Laser Therapy 17.3: 141-148 (2008).
Carruthers et al., "Consensus Recommendations for Combined Aesthetic Interventions in the Face Using Botulinum Toxin, Fillers,and Energy-Based Devices" Dermatol Surg 2016 (pp. 1-12).
Casabona, G., et al., "Microfocused Ultrasound with Visualization and Calcium Hydroxylapatite for Improving Skin Laxity and Cellulite Appearance"; Plast Reconstr Surg Glob Open. Jul. 25, 2017;5(7):e1388, 8 pages.
Casabona, G., et al., "Microfocused Ultrasound With Visualization and Fillers for Increased Neocollagenesis: Clinical and Histological Evaluation". Dermatol Surg 2014;40:S194-S198.
Chan, N.P., et al., "Safety study of transcutaneous focused ultrasound for non-invasive skin tightening in Asians". Lasers Surg Med, 2011. 43(5): p. 366-75.
Chapelon et al., "Effects of Cavitation In The High Intensity Therapeutic Ultrasound", Ultrasonics Symposium—1357 (1991).
Chapelon, et al., "Thresholds for Tissue Ablation by Focused Ultrasound" (1990).
Chen, L. et al., "Effect of Blood Perfusion on the ablation of liver parenchyma with high intensity focused ultrasound," Phys. Med. Biol; 38:1661-1673; 1993b.
Coon, Joshua et al., "Protein identification using sequential ion/ion reactions and tandem mass spectrometry" Proceedings of the National Academy of Sciences of the USA, vol. 102, No. 27, Jul. 27, 2005, pp. 9463-9468.
Corry, Peter M., et al., "Human Cancer Treatment with Ultrasound", IEEE Transactions on Sonics and Ultrasonics, vol. SU-31, No. 5, Sep. 1984, pp. 444, 456.
Damianou et al., "Application of the Thermal Dose Concept for Predicting the Necrosed Tissue Volume During Ultrasound Surgery," 1993 IEEE Ultrasound Symposium, pp. 1199-1202.
Daum et al., Design and Evaluation of a Feedback Based Phased Array System for Ultrasound Surgery, IEEE Transactions on Ultrasonics, Ferroelectrics, and Frequency Control, vol. 45, No. 2, Mar. 1998, pp. 431-438.
Davis, Brian J., et al., "An Acoustic Phase Shift Technique for the Non-Invasive Measurement of Temperature Changes in Tissues", 1985 Ultrasonics Symposium, pp. 921-924.
Dayan, S.H., et al., "Prospective, Multi-Center, Pivotal Trial Evaluating the Safety and Effectiveness of Micro-Focused Ultrasound with Visualization (MFU-V) for Improvement in Lines and Wrinkles of the Decolletage". Plast Reconstr Surg. Oct. 2014; 134(4 Suppl 1):123-4.
Decision of the Korean Intellectual Property Tribunal dated Jun. 28, 2013 regarding Korean Patent No. 10-1142108, which is related to the pending application and/or an application identified in the Table on pp. 1-4 of the Information Disclosure Statement herein (English translation, English translation certification, and Korean decision included).
Delon Martin, C., et al., "Venous Thrombosis Generation by Means of High-Intensity Focused Ultrasound" Ultrasound in Med. & Biol., vol. 21, No. 1, pp. 113-119 (1995).
Dierickx, Christine C., "The Role of Deep Heating for Noninvasive Skin Rejuvenation" Lasers in Surgery and Medicine 38:799-807 (2006).
Dobke, M.K., et al., "Tissue restructuring by energy-based surgical tools". Clin Plast Surg, 2012. 39(4): p. 399-408.
Dong, Yuan-Lin et al., "Effect of Ibuprofen on the Inflammatory Response to Surgical Wounds" The Journal of Trauma, vol. 35, No. 3. (1993).
Driller et al., "Therapeutic Applications of Ultrasound: A Review" IEEE Engineering in Medicine and Biology; (Dec. 1987) pp. 33-40.
Dvivedi, Sanjay, et al. "Effect of Ibuprofen and diclofenac sodium on experimental wound healing" Indian Journal of Experimental Biology, vol. 35, pp. 1243-1245. (Nov. 1997).
Fabi, S.G., "Microfocused Ultrasound With Visualization for Skin Tightening and Lifting: My Experience and a Review of the Literature". Dermatol Surg. Dec. 2014; 40 Suppl 12:S164-7.
Fabi, S.G., "Noninvasive skin tightening: focus on new ultrasound techniques". Clin Cosmet Investig Dermatol. Feb. 5, 2015; 8:47-52.
Fabi, S.G., et al., "A prospective multicenter pilot study of the safety and efficacy of microfocused ultrasound with visualization for improving lines and wrinkles of the décolleté". Dermatol Surg. Mar. 2015; 41(3):327-35.
Fabi, S.G., et al., "Evaluation of microfocused ultrasound with visualization for lifting, tightening, and wrinkle reduction of the decolletage". J Am Acad Dermatol, 2013. 69(6): p. 965-71.
Fabi, S.G., et al., "Future directions in cutaneous laser surgery". Dermatol Clin, 2014. 32(1): p. 61-9.
Fabi, S.G., et al., "Retrospective Evaluation of Micro-focused Ultrasound for Lifting and Tightening the Face and Neck". Dermatol Surg, 2014.
Friedmann D.P., "Comments on evaluation of microfocused ultrasound system for improving skin laxity and tightening in the lower face". Aesthet Surg J. Mar. 2015;35(3):NP81 -2.
Friedmann, D.P., et al., "Combination of intense pulsed light, Sculptra, and Ultherapy for treatment of the aging face". J Cosmet Dermatol, 2014. 13(2): p. 109-18.
Fry, W.J. et al., "Production of Focal Destructive Lesions in the Central Nervous System with Ultrasound," J. Neurosurg., 11:471-478; 1954.
Fujimoto, et al., "A New Cavitation Suppression Technique for Local Ablation Using High-Intensity Focused Ultrasound" Ultrasonics Symposium—1629 (1995).
Gliklich et al., Clinical Pilot Study of Intense Ultrasound therapy to Deep Dermal Facial Skin and Subcutaneous Tissues, Arch Facial Plastic Surgery, Mar. 1, 2007, vol. 9, No. 1.
Gold, M.H., et al., "Use of Micro-Focused Ultrasound with Visualization to Lift and Tighten Lax Knee Skin". J Cosmet Laser Ther, 2014: p. 1 -15.
Goldberg, D.J., et al., "Safety and Efficacy of Microfocused Ultrasound to Lift, Tighten, and Smooth the Buttocks". Dermatol Surg 2014; 40:1113-1117.
Greene, R.M., et al., "Skin tightening technologies". Facial Plast Surg. Feb. 2014; 30(1 ):62-7.
Greenhalgh, David G., "Wound healing and diabetes mellitus" Clinics in Plastic Surgery 30; 37-45. (2003).

(56) References Cited

OTHER PUBLICATIONS

Guo, S. et al., "Factors Affecting Wound Healing" Critical Reviews in Oral Biology & Medicine, J Dent Res 89(3), pp. 219-229. (2010).
Haar, G.R. et al., "Tissue Destruction with Focused Ultrasound in Vivo," Eur. Urol. 23 (suppl. 1):8-11; 1993.
Hantash, Basil M. et al., "Bipolar Fractional Radiofrequency Treatment Induces Neoelastogenesis and Neocollagenesis" Lasers in Surgery and Medicine 41:1-9 (2009).
Hantash, Basil M. et al., "In Vivo Histological Evaluation of a Novel Ablative Fractional Resurfacing Device" Lasers in Surgery and Medicine 39:96-107 (2007).
Harris, M.O., "Safety of Microfocused Ultrasound With Visualization in Patients With Fitzpatrick Skin Phototypes III to VI". JAMA Facial Plast. Surg, 2015.
Hart, et al., "Current Concepts in the Use of PLLA:Clinical Synergy Noted with Combined Use of Microfocused Ultrasound and Poly-I-Lactic Acid on the Face, Neck, and Décolletage". Amer. Soc. Plast. Surg. 2015. 136; 180-187S.
Hassan et al., "Structure and Applications of Poly(vinyl alcohol) Hydrogels Produced by Conventional Crosslinking or by Freezing/Thawing Methods," advanced in Polymer Science, 2000, pp. 37-65, vol. 153.
Hassan et al., "Structure and Morphology of Freeze/Thawed PVA Hydrogels," Macromolecules, Mar. 11, 2000, pp. 2472-2479, vol. 33, No. 7.
Hexsel et al., "A Validated Photonumeric Cellulite Severity Scale"; J Eur Acad Dermatol Venereol. May 2009; 23(5):523-8, 6 pages.
Hitchcock, T.M. et al., "Review of the safety profile for microfocused ultrasound with Visualization". Journal of Cosmetic Dermatology, 13, 329-335. (2014).
Husseini et al., "The Role of Cavitation in Acoustically Activated Drug Delivery," J. Control Release, Oct. 3, 2005, pp. 253-261, vol. 107(2).
Husseini et al. "Investigating the mechanism of acoustically activated uptake of drugs from Pluronic micelles," BMD Cancer 2002, 2:20k, Aug. 30, 2002, pp. 1-6.
Hynynen et al., Temperature Distributions During Local Ultrasound Induced Hyperthermia In Vivo, Ultrasonics Symposiu—745 (1982).
Jeffers et al., "Evaluation of the Effect of Cavitation Activity on Drug-Ultrasound Synergisms," 1993 IEEE Ultrasonics Symposium, pp. 925-928.
Jenne, J., et al., "Temperature Mapping for High Energy US-Therapy", 1994 Ultrasonics Symposium, pp. 1879-1882.
Jeong, K.H., et al., "Neurologic complication associated with intense focused ultrasound". J Cosmet Laser Ther, 2013.
Johnson, S.A., et al., "Non-Intrusive Measurement of Microwave and Ultrasound-Induced Hyperthermia by Acoustic Temperature Tomography", Ultrasonics Symposium Proceedings, pp. 977-982. (1977).
Ketterling J. A. et al.: "Design and fabrication of a 40-MHz annular array transducer", IEEE Transactions On Ultrasonics, Ferroelectrics and Frequency Control, IEEE, US, vol. 52, No. 4, Apr. 1, 2005 (Apr. 1, 2005), pp. 672-681.
Kim, H.J., et al., "Coagulation and ablation patterns of high-intensity focused ultrasound on a tissue mimicking phantom and cadaveric skin". Laser Med Sci. Sep. 4, 2015.
Kornstein, A.N., "Ulthera for silicone lip correction". Plast Reconstr Surg, 2012. 129(6): p. 1014e-1015e.
Kornstein, A.N., "Ultherapy shrinks nasal skin after rhinoplasty following failure of conservative measures". Plast Reconstr Surg, 2013. 131(4): p. 664e-6e.
Krischak, G.D., et al., "The effects of non-steroidal anti-inflammatory drug application on incisional wound healing in rats" Journal of Wound Care, vol. 6, No. 2, (Feb. 2007).
Laubach, H.J., et al., "Confined Thermal Damage with Intense Ultrasound (IUS)" [abstr.] American Society for Laser Medicine and Surgery Abstracts, p. 15 #43 (Apr. 2006).
Laubach, H.J., et al., "Intense focused ultrasound: evaluation of a new treatment modality for precise microcoagulation within the skin". Dermatol Surg, 2008. 34(5): p. 727-34.
Lee, H.J., et al., "The efficacy and safety of intense focused ultrasound in the treatment of enlarged facial pores in Asian skin". J Dermatolog Treat, 2014.
Lee, H.S., et al., "Multiple Pass Ultrasound Tightening of Skin Laxity of the Lower Face and Neck". Dermatol Surg, 2011.
Lin, Sung-Jan, et al., "Monitoring the thermally induced structural transitions of collagen by use of second-harmonic generation microscopy" Optics Letters, vol. 30, No. 6, (Mar. 15, 2005).
Macgregor J.L., et al., "Microfocused Ultrasound for Skin Tightening". Semin Cutan Med Surg 32:18-25. (2013).
Madersbacher, S. et al., "Tissue Ablation in Benign Prostatic Hyperplasia with High Intensity Focused Ultrasound," Dur. Urol., 23 (suppl. 1):39-43; 1993.
Makin et al., "B-Scan Imaging and Thermal Lesion Monitoring Using Miniaturized Dual-Functionality Ultrasound Arrays," Ultrasonics Symposium, 2004 IEEE, Aug. 23, 2004, pp. 1788-1791, vol. 3.
Makin et al., "Confirmed Bulk Ablation and Therapy Monitoring Using Intracorporeal Image-Treat Ultrasound Arrays," 4th International Symposium on Therapeutic Ultrasound, Sep. 19, 2004.
Makin et al., "Miniaturized Ultrasound Arrays for Interstitial Ablation and Imaging," UltraSound Med. Biol. 2005, Nov. 1, 2005, pp. 1539-1550, vol. 31(11).
Manohar et al., "Photoacoustic mammography laboratory prototype: imaging of breast tissue phantoms," Journal of Biomedical Optics, Nov./Dec. 2004, pp. 1172-1181, vol. 9, No. 6.
Mast et al., "Bulk Ablation of Soft Tissue with Intense Ultrasound; Modeling and Experiments," J. Acoust. Soc. Am., Oct. 1, 2005, pp. 2715-2724, vol. 118(4).
Meshkinpour, Azin, et al., "Treatment of Hypertrophic Scars and Keloids With a Radiofrequency Device: A Study of Collagen Effects" Lasers in Surgery and Medicine 37:343-349 (2005).
MICROCHIP microID 125 kHz EFID System Design Guide, Microchip Technology Inc. (2004).
Minkis, K., et al., "Ultrasound skin tightening". Dermatol Clin, 2014. 32(1): p. 71-7.
Mitragotri, S., "Healing sound: the use of ultrasound in drug delivery and other therapeutic applications," Nature Reviews; Drug Delivery, pp. 255-260, vol. 4 (Mar. 2005).
Mosser, David M. et al., "Exploring the full spectrum of macrophage activation" Nat Rev Immunol; 8(12): 958-969. (Dec. 2008).
Murota, Sei-Itsu, et al., "Stimulatory Effect of Prostaglandins on the Production of Hexosamine-Containing Substances by Cultured Fibroblasts (3) Induction of Hyaluronic Acid Synthetase by Prostaglandin" Department of Pharmacology, Tokyo Metropolitan Institute of Gerontology, Itabashiku, Tokyo-173, Japan. (Nov. 1977, vol. 14, No. 5).
Murota, Sei-Itsu, et al., "The Stimulatory Effect of Prostaglandins on Production of Hexosamine-Containing Substances by Cultured Fibroblasts" Department of Pharmacology, Tokyo Metropolitan Institute of Gerontology, Itabashiku, Tokyo-173, Japan. (Aug. 1976, vol. 12, No. 2).
Nestor, M.S. et al., "Safety and Efficacy of Micro-focused Ultrasound Plus Visualization for the Treatment of Axillary Hyperhidrosis". J Clin Aesthet Dermatol, 2014. 7(4): p. 14-21.
Oni, G., et al. "Response to 'comments on evaluation of microfocused ultrasound system for improving skin laxity and tightening in the lower face'". Aesthet Surg J. Mar. 2015;35(3):NP83-4.
Oni, G., et al., "Evaluation of a Microfocused Ultrasound System for Improving Skin Laxity and Tightening in the Lower Face". Aesthet Surg J, 2014. 38:861-868.
Pak, C.S., et al., "Safety and Efficacy of Ulthera in the Rejuvenation of Aging Lower Eyelids: A Pivotal Clinical Trial". Aesthetic Plast Surg, 2014.
Paradossi et al., "Poly(vinyl alcohol) as versatile biomaterial for potential biomedical applications," Journal of Materials Science: Materials in Medicine, 2003, pp. 687-691, vol. 14.
Pritzker, R.N., et al., "Updates in noninvasive and minimally invasive skin tightening". Semin Cutan Med Surg. Dec. 2014;33(4):182-7.
Pritzker, R.N., et al., "Comparison of different technologies for noninvasive skin tightening". Journal of Cosmetic Dermatology, 13, 315-323. (2014).

(56) References Cited

OTHER PUBLICATIONS

Rappolee, Daniel A., et al., "Wound Macrophages Express TGF and Other Growth Factors in Vivo: Analysis by mRNA Phenotyping" Science, vol. 241, No. 4866 (Aug. 1988).
Reid, Gavin, et al., "Tandem Mass spectrometry of ribonuclease A and B: N-linked glycosylation site analysis of whole protein ions," Analytical Chemistry. Feb. 1, 2002, vol. 74, No. 3, pp. 577-583.
Righetti et al., "Elastographic Characterization of HIFU-lnduced Lesions in Canine Livers," 1999, Ultrasound in Med & Bio, vol. 25, No. 7, pp. 1099-1113.
Rokhsar, C., et al., "Safety and efficacy of microfocused ultrasound in tightening of lax elbow skin". Dermatol Surg. 2015; 41(7):821-6.
Rosenberg, Carol S. "Wound Healing in the Patient with Diabetes Mellitus" Nursing Clinics of North America, vol. 25, No. 1, (Mar. 1990).
Saad et al., "Ultrasound-Enhanced Effects of Adriamycin Against Murine Tumors," Ultrasound in Med. & Biol. Vol. 18, No. 8, pp. 715-723 (1992).
Sabet-Peyman, E.J. et al., "Complications Using Intense Ultrasound Therapy to TreatDeep Dermal Facial Skin and Subcutaneous Tissues". Dermatol Surg 2014; 40:1108-1112.
Sandulache, Vlad C. et al., "Prostaglandin E2 inhibition of keloid fibroblast migration, contraction, and transforming growth factor (TGF)—B1—induced collagen synthesis" Wound Rep Reg 15 122-133, 2007. (2007).
Sanghvi, N.T., et al., "Transrectal Ablation of Prostate Tissue Using Focused Ultrasound," 1993 Ultrasonics Symposium, IEEE, pp. 1207-1210.
Sasaki, G.H. et al., "Clinical Efficacy and Safety of Focused-lmage Ultrasonography: A 2-Year Experience". Aesthet Surg J, 2012.
Sasaki, G.H. et al., "Microfocused Ultrasound for Nonablative Skin and Subdermal Tightening to the Periorbitum and Body Sites: Preliminary Report on Eighty-Two Patients". Journal of Cosmetics, Dermatological Sciences and Applications, 2012, 2, 108-116.
Sassen, Sander, "ATI's R520 architecture, the new king of the hill?" http://www.hardwarearialysis.com/content/article/1813, Sep. 16, 2005, 2 pages.
Seip, Ralf, et al., "Noninvasive Detection of Thermal Effects Due to Highly Focused Ultrasonic Fields," IEEE Symposium, pp. 1229-1232, vol. 2, Oct. 3-Nov. 1993.
Seip, Ralf, et al., "Noninvasive Estimation of Tissue Temperature Response to Heating Fields Using Diagnostic Ultrasound," IEEE Transactions on Biomedical Engineering, vol. 42, No. 8, Aug. 1995, pp. 828-839.
Simon et al., "Applications of Lipid-Coated Microbubble Ultrasonic Contrast to Tumor Therapy," Ultrasound in Med. & Biol. Vol. 19, No. 2, pp. 123-125 (1993).
Sklar, L.R., et al., "Use of transcutaneous ultrasound for lipolysis and skin tightening: a review". Aesthetic Plast Surg, 2014. 38(2): p. 429-41.
Smith, Nadine Barrie, et al., "Non-invasive In Vivo Temperature Mapping of Ultrasound Heating Using Magnetic Resonance Techniques", 1994 Ultrasonics Symposium, pp. 1829-1832, vol. 3.
Sonocare, Inc. Therapeutic Ultrasound System Model CST-100 Instruction Manual (1985).
Suh, D.H., et al., "A intense-focused ultrasound tightening for the treatment of infraorbital laxity". J Cosmet Laser Ther, 2012. 14(6): p. 290-5.
Suh, D.H., et al., "Comparative histometric analysis of the effects of high-intensity focused ultrasound and radiofrequency on skin". J Cosmet Laser Ther. Mar. 24, 2015:1-7.
Suh, D.H., et al., "Intense Focused Ultrasound Tightening in Asian Skin: Clinical and Pathologic Results" American Society for Dermatologic Surgery, Inc.; 37:1595-1602. (2011).
Surry et al., "Poly(vinyl alcohol) cryogel phantoms for use in ultrasound and MR imaging," Phys. Med. Biol., Dec. 6, 2004, pp. 5529-5546, vol. 49.
Syka J. E. P. et al., "Peptide and Protein Sequence Analysis by Electron Transfer Dissociation Mass Spectrometry," Proceedings of the National Academy of Sciences of USA, National Academy of Science, Washington, DC, vol. 101, No. 26, Jun. 29, 2004, pp. 9528-9533.
Talbert, D. G., "An Add-On Modification for Linear Array Real-Time Ultrasound Scanners to Produce 3D Displays," UTS Int'l 1977 Brighton, England (Jun. 28-30, 1977) pp. 57-67.
Tata et al., "Interaction of Ultrasound and Model Membrane Systems: Analyses and Predictions," American Chemical Society, Phys. Chem. 1992, 96, pp. 3548-3555.
Ueno, S., et al., "Ultrasound Thermometry in Hyperthermia", 1990 Ultrasonic Symposium, pp. 1645-1652.
Verhofstad, Michiel H.J. et al., "Collagen Synthesis in rat skin and ileum fibroblasts is affected differently by diabetes-related factors" Int. J. Exp. Path. (1998), 79, 321-328.
Wang, H., et al., "Limits on Focused Ultrasound for Deep Hyperthermia", 1994 Ultrasonic Symposium, Nov. 1-4, 1994, pp. 1869-1872, vol. 3.
Wasson, Scott, "NVIDIA's GeForce 7800 GTX graphics processor Power MADD," httpi//techreport.com/reviews/2005g2/geforce-7800gtx/index.x?pg=1, Jun. 22, 2005, 4 pages.
Webster et al. "The role of ultrasound-induced cavitation in the 'in vitro' stimulation of collagen synthesis in human fibroblasts"; Ultrasonics pp. 33-37(Jan. 1980).
Weiss, M., "Commentary: noninvasive skin tightening: ultrasound and other technologies: where are we in 2011?" Dermatol Surg, 2012. 38(1): p. 28-30.
White et al. "Selective Creating of Thermal Injury Zones in the Superficial Musculoaponeurotic System Using Intense Ultrasound Therapy," Arch Facial Plastic Surgery, Jan./Feb. 2007, vol. 9, No. 1 (pp. 22-29).
White, W. M., et al., "Selective Transcutaneous Delivery of Energy to Facial Subdermal Tissues Using the Ultrasound Therapy System" [abstr], American Society for Laser Medicine and Surgery Abstracts, p. 37 #113 (Apr. 2006).
White, W. Matthew, et al., "Selective Transcutaneous Delivery of Energy to Porcine Soft Tissues Using Intense Ultrasound (IUS)" Lasers in Surgery and Medicine 40:67-75 (2008).
Woodward, J.A., et al. "Safety and Efficacy of Combining Microfocused Ultrasound With Fractional CO2 Laser Resurfacing for Lifting and Tightening the Face and Neck". Dermatol Surg, Dec. 4, 20140:S190-S193.
Zelickson, Brian D et al., "Histological and Ultrastructural Evaluation of the Effects of a Radiofrequency-Based Nonablative Dermal Remodeling Device, A Pilot Study" Arch Dermatol, vol. 140, (Feb. 2004).
Ulthera, Inc., Petition for Inter Partes Review filed Jul. 19, 2016 in Re U.S. Pat. No. 6,113,559; IPR2016-01459; 63 pages (Filed Jul. 19, 2016).
ULTHERA Exhibit 1001, U.S. Pat. No. 6,113,559 to Klopotek, filed Jul. 19, 2016 in re IPR2016-01459.
ULTHERA Exhibit 1002, Patent file history of U.S. Pat. No. 6,113,559 Klopotek filed Jul. 19, 2016 in re IPR2016-01459.
ULTHERA Exhibit 1003, Declaration of Expert Witness Mark E. Schafer, Ph.D. filed Jul. 19, 2016 in re IPR2016-01459.
ULTHERA Exhibit 1004, Curriculum Vitae of Mark E. Schafer, Ph.D. filed Jul. 19, 2016 in re IPR2016-01459.
ULTHERA Exhibit 1005, International PCT Publication WO96/34568 Knowlton filed Jul. 19, 2016 in re IPR2016-01459.
ULTHERA Exhibit 1006, French Patent No. 2,672,486, Technomed patent filed Jul. 19, 2016 in re IPR2016-01459.
ULTHERA Exhibit 1007, English translation of French Patent No. 2,672,486, Technomed filed Jul. 19, 2016 in re IPR2016-01459.
ULTHERA Exhibit 1008, International PCT Publication WO93/12742, Technomed PCT filed Jul. 19, 2016 in re IPR2016-01459.
ULTHERA Exhibit 1009, English translation of International PCT Publication WO93/12742, Technomed PCT filed Jul. 19, 2016 in re IPR2016-01459.
ULTHERA Exhibit 1010, U.S. Pat. No. 5,601,526, which claims priority to Technomed PCT filed Jul. 19, 2016 in re IPR2016-01459.
ULTHERA Exhibit 1011, Patent file history for European Patent Application No. 98964890.2, Klopotek filed Jul. 19, 2016 in re IPR2016-01459.

(56) References Cited

OTHER PUBLICATIONS

ULTHERA Exhibit 1012, Translator Declaration filed Jul. 19, 2016 in re IPR2016-01459.
ULTHERA Exhibit 1013, U.S. Pat. No. 5,230,334 to Klopotek filed Jul. 19, 2016 in re IPR2016-01459.
ULTHERA Exhibit 1014, U.S. Pat. No. 5,755,753 to Knowlton filed Jul. 19, 2016 in re IPR2016-01459.
ULTHERA Exhibit 1015, Excerpts from The American Medical Association Encyclopedia of Medicine (1989) filed Jul. 19, 2016 in re IPR2016-01459.
ULTHERA Exhibit 1016, The Simultaneous Study of Light Emissions and Shock Waves Produced by Cavitation Bubbles, G. Gimenez, J. Acoust. Soc. Am. 71(4), Apr. 1982, pp. 839-847 (filed Jul. 19, 2016 in re IPR2016-01459).
ULTHERA Exhibit 1017, Excerpts from Gray's Anatomy (1995) (filed Jul. 19, 2016 in re IPR2016-01459).
ULTHERA Exhibit 1018, Anatomy of the Superficial Venous System, Comjen G.M., Dermatol. Surg., 1995; 21:35-45 (filed Jul. 19, 2016 in re IPR2016-01459).
ULTHERA Exhibit 1019, Section 2.6 from Ultrasonics Theory and Application, by G.L. Gooberman (Hart Publishing Co., 1969) (filed Jul. 19, 2016 in re IPR2016-01459).
ULTHERA Exhibit 1020, Deep Local Hyperthermia for Cancer Therapy: External Electromagnetic and Ultrasound Techniques, A.Y. Cheung and A. Neyzari, Cancer Research (Suppl.), vol. 44, pp. 4736-4744 (1984) (filed Jul. 19, 2016 in re IPR2016-01459).
Decision on Institution of Inter Partes Review in Re U.S. Pat. No. 6,113,559; IPR2016-01459; 20 pages [011 ] (Dated Jan. 23, 2017).
DERMAFOCUS Response to Institution of Inter Partes Review in Re U.S. Pat. No. 6,113,559; IPR2016-01459; 73 pages [018] (Dated Apr. 26, 2017).
DERMAFOCUS Exhibit List in Re U.S. Pat. No. 6,113,559; IPR2016-01459; 5 pages [019] (Dated Apr. 26, 2017).
DERMAFOCUS Exhibit 2002, Declaration of Mark Palmeri, in Re U.S. Pat. No. 6,113,559; IPR2016-01459; 136 pages (Filed Apr. 26, 2017).
DERMAFOCUS Exhibit 2003, Deposition of Dr. Mark Schafer, in Re U.S. Pat. No. 6,113,559; IPR2016-01459; 327 pages (Filed Apr. 26, 2017).
DERMAFOCUS Exhibit 2004, Amendment No. 4 to Ulthera Form S-1, in Re U.S. Pat. No. 6,113,559; IPR2016-01459; 308 pages (Filed Apr. 26, 2017).
DERMAFOCUS Exhibit 2005, Excerpt from Churchill Livingstone, Gray's Anatomy (38th ed. 1995), in Re U.S. Pat. No. 6,113,559; IPR2016-01459; 7 pages (Filed Apr. 26, 2017).
DERMAFOCUS Exhibit 2006, Bo Eklof et al., "Revision of the CEAP Classification for Chronic Venous Disorders: Consensus Statement," Acta Fac Med Naiss, vol. 25, No. 1 (2008), 3-10 in Re U.S. Pat. No. 6,113,559; IPR2016-01459; 7 pages (Filed Apr. 26, 2017).
DERMAFOCUS Exhibit 2007, WebMD, "Varicose Veins and Spider Veins" downloaded from http://www.webmd.com/skin-problems-andtreatments/guide/varicose-spider-veins#1 in Re. U.S. Pat. No. 6,113,559; IPR2016-01459; 3 pages (Filed Apr. 26, 2017).
DERMAFOCUS Exhibit 2008, John M. Porter et al., "Reporting Standards in Venous Disease: An Update," Journal of Vascular Surgery, vol. 21, No. 4 (1995), 635-645 in Re U.S. Pat. No. 6,113,559; IPR2016-01459; 11 pages (Filed Apr. 26, 2017).
DERMAFOCUS Exhibit 2009, Kullervo Hynynen, "Review of Ultrasound Therapy," 1997 Ultrasonics Symposium (1997), 1305-1313, in Re U.S. Pat. No. 6,113,559; IPR2016-01459; 9 pages (Filed Apr. 26, 2017).
DERMAFOCUS Exhibit 2010, A.G. Visioli et al., "Prelimiary Results of a Phase I Dose Escalation Clinical Trial Using Focused Ultrasound in the Treatment of Localised Tumours," European Journal of Ultrasound, vol. 9 (1999), 11-18, in Re U.S. Pat. No. 6,113,559; IPR2016-01459; 8 pages (Filed Apr. 26, 2017).
DERMAFOCUS Exhibit 2011, U.S. Pat. No. 5,143,063, issued on Sep. 1, 1992, Fellner, in Re U.S. Pat. No. 6,113,559; IPR2016-01459; 6 pages (Filed Apr. 26, 2017).
DERMAFOCUS Exhibit 2012, Hugh G. Beebe et al., "Consensus Statement: Classification and Grading of Chronic Venous Disease in the Lower Limbs," European Journal of Vascular and Endovascular Surgery, vol. 12 (1996), 487-492, in Re U.S. Pat. No. 6,113,559; IPR2016-01459; 6 pages (Filed Apr. 26, 2017).
DERMAFOCUS Exhibit 2013, Excerpt from Mosby's Medical Dictionary (3rd ed. 1990), in Re U.S. Pat. No. 6,113,559; IPR2016-01459; 4 pages (Filed Apr. 26, 2017).
DERMAFOCUS Exhibit 2014, Excerpt from Miller-Keane Encyclopedias Dictionary of Medicine, Nursing, & Allied Health (5th ed. 1992), in Re U.S. Pat. No. 6,113,559; IPR2016-01459; 6 pages (Filed Apr. 26, 2017).
DERMAFOCUS Exhibit 2015, David J. Tibbs et al., Varicose Veins, Venous Disorders, and Lymphatic Problems in the Lower Limbs (1997), Chapter 4: Clinical Patterns of Venous Disorder I, 47-67, in Re U.S. Pat. No. 6,113,559; IPR2016-01459; 24 pages (Filed Apr. 26, 2017).
DERMAFOCUS Exhibit 2016, Mitchel P. Goldman et al., Varicose Veins and Telangiectasias (2nd ed. 1999), Chapter 22: Treatment of Leg Telangiectasias with Laser and High-Intensity Pulsed Light, 470-497, in Re U.S. Pat. No. 6,113,559; IPR2016-01459; 31 pages (Filed Apr. 26, 2017).
DERMAFOCUS Exhibit 2017, Email from Anderson to Klopotek dated May 25, 2004, in Re U.S. Pat. No. 6,113,559; IPR2016-01459; 1 page (Filed Apr. 26, 2017).
DERMAFOCUS Exhibit 2018, List of Klopotek Patents, in Re U.S. Pat. No. 6,113,559; IPR2016-01459; 411 pages (Filed Apr. 26, 2017).
DERMAFOCUS Exhibit 2019, Declaration of Peter Klopotek Civil Action 15-CV-654-SLR, dated Nov. 2, 2016, in Re U.S. Pat. No. 6,113,559; IPR2016-01459; 1 page (Filed Apr. 26, 2017).
DERMAFOCUS Exhibit 2020, "Our Technology," downloaded from http://jobs.uithera.com/about on Apr. 10, 2017, in Re U.S. Pat. No. 6,113,559; IPR2016-01459;. 4 pages (Filed Apr. 26, 2017).
DERMAFOCUS Exhibit 2021, C. Damianou and K. Hynynen, "Focal Spacing and Near-Field Heating During Pulsed High Temperature Ultrasound Therapy," Ultrasound in Medicine & Biology, vol. 19, No. 9 (1993), 777-787, in Re U.S. Pat. No. 6,113,559; IPR2016-01459; 11 pages (Filed Apr. 26, 2017).
DERMAFOCUS Exhibit 2022, Excerpt from Mosby's Medical Dictionary (5th ed. 1997), in Re U.S. Pat. No. 6,113,559; IPR2016-01459; 5 pages (Filed Apr. 26, 2017).
DERMAFOCUS Exhibit 2023, Excerpt from Miller-Keane Encyclopedias Dictionary of Medicine, Nursing, & Allied Health (6th ed. 1997), in Re U.S. Pat. No. 6,113,559; IPR2016-01459; 7 pages (Filed Apr. 26, 2017).
DERMAFOCUS Exhibit 2024, Excerpt from Stedman's Concise Medical Dictionary (3 rd ed. 1997), in Re U.S. Pat. No. 6,113,559; IPR2016-01459; 4 pages (Filed Apr. 26, 2017).
DERMAFOCUS Exhibit 2025, Excerpt from Taber's Cyclopedic Medical Dictionary (18th ed. 1997), in Re U.S. Pat. No. 6,113,559; IPR2016-01459; 9 pages (Filed Apr. 26, 2017).
DERMAFOCUS Exhibit 2026, Bo Eklof et al., "Revision of the CEAP Classification for Chronic Venous Disorders: Consensus Statement," Journal of Vascular Surgery, vol. 40, No. 6 (2004), 1248-1252.el, in Re U.S. Pat. No. 6,113,559; IPR2016-01459; 6 pages (Filed Apr. 26, 2017).
Ulthera, Inc., Reply in Support of Petition for Inter Partes Review in Re U.S. Pat. No. 6,113,559; IPR2016-01459; 33 pages (Filed Aug. 2, 2017).
ULTHERA Exhibit 1022, Use of the Argon and Carbon Dioxide Lasers for Treatment of Superficial Venous Varicosities of the Lower Extremity, D. Apfelberg et al., Lasers in Surgery and Medicine, vol. 4.3, pp. 221-231 (1984) (filed Aug. 2, 2017 in re IPR2016-01459).
ULTHERA Exhibit 1023, 532-Nanometer Green Laser Beam Treatment of Superficial Varicosities of the Lower Extremities, T. Smith et al., Lasers in Surgery and Medicine, vol. 8.2, pp. 130-134 (1988) (filed Aug. 2, 2017 in re IPR2016-01459).
ULTHERA Exhibit 1024, Deposition Transcript of Dr. Mark Palmeri on Jul. 11, 2017 (filed Aug. 2, 2017 in re IPR2016-01459).
ULTHERA Exhibit 1025, Ulthera Oral Proceeding Demonstrative Slides (filed Oct. 2, 2017 in re IPR2016-01459).

(56) References Cited

OTHER PUBLICATIONS

DERMAFOCUS Exhibit 2027, DermaFocus Oral Proceeding Demonstrative Slides (filed Oct. 2, 2017 in re IPR2016-01459).
PTAB Record of Oral Hearing held Oct. 4, 2017 in Re U.S. Pat. No. 6,113,559; IPR2016-01459; 67 pages (PTAB Document sent to Ulthera on Nov. 1, 2017).
Final Written Decision of Inter Partes Review in Re U.S. Pat. No. 6,113,559; IPR2016-01459; 37 pages [030] (Entered Jan. 19, 2018).
Ulthera, Inc., Petitioner Notice of Appeal to Federal Circuit 2018-1542 re: IPR2016-01459; 4 pages from [001] (No. appendices) (Filed Feb. 9, 2018).
Federal Circuit Order Granting Ulthera Motion to Remand, re: 2018-1542; 4 pages [022] (Dated May 25, 2018).
Ulthera Brief (Corrected), Fed. Cir. Appeal Case 19-1006 from re: IPR2016-01459; 136 pages [030] (Dated Apr. 3, 2019).
DermaFocus Brief (Corrected), Fed. Cir. Appeal Case 19-1006 from re: IPR2016-01459; 73 pages [032] (Dated Apr. 4, 2019).
PCT/US2017/013657 International Search Report dated Apr. 16, 2017, 11 pages.
U.S. Appl. No. 14/193,234, filed Feb. 28, 2014, Devices and Methods for Multi-Focus Ultrasound Therapy.
U.S. Appl. No. 13/135,962, filed Jun. 9, 2008, Method and System for Ultrasound Treatment With a Multi-Directional Transducer.
U.S. Appl. No. 14/264,732, filed filed Apr. 29, 2014, System and Method for Variable Depth Ultrasound Treatment.
U.S. Appl. No. 13/444,336, filed Apr. 11, 2012, Treatment of Sub-Dermal Regions for Cosmetic Effects.
U.S. Appl. No. 15/248,407, fied Aug. 26, 2016, Systems for Treating Skin Laxity.
U.S. Appl. No. 15/625,700, filed Jun. 16, 2017, Systems for Treating Skin Laxity.
U.S. Appl. No. 11/163,176, fied Oct. 7, 2005, Method and System for Treating Blood Vessel Disorders.
U.S. Appl. No. 12/574,512, fied Oct. 6, 2009, Method and System for Treating Stretch Marks.
U.S. Appl. No. 12/646,609, filed Dec. 23, 2009, Methods and System for Fat Reduction and/or Cellulite Treatment.
U.S. Appl. No. 14/550,772, filed Nov. 21, 2014, Energy Based Fat Reduction.
U.S. Appl. No. 13/163,541, filed Aug. 2, 2011, Methods and Systems for Treating Plantar Fascia.
U.S. Appl. No. 14/847,626, filed Spe. 8, 2015, Systems for Cosmetic Treatment.

* cited by examiner

COMPACT ULTRASOUND DEVICE HAVING ANNULAR ULTRASOUND ARRAY PERIPHERALLY ELECTRICALLY CONNECTED TO FLEXIBLE PRINTED CIRCUIT BOARD AND METHOD OF ASSEMBLY THEREOF

INCORPORATION BY REFERENCE TO ANY PRIORITY APPLICATIONS

This application is a U.S. National Phase application of Intl. App. No. PCT/US2017/013657 filed on Jan. 16, 2017 and published in English as WO 2017/127328 on Jul. 27, 2017, which claims the benefit of priority from U.S. Provisional Patent Application No. 62/280,038 filed on Jan. 18, 2016, which is incorporated in its entirety by reference, herein. Any and all applications for which a foreign or domestic priority claim is identified in the Application Data Sheet as filed with the present application are hereby incorporated by reference under 37 CFR 1.57.

BACKGROUND

Several embodiments of the present invention disclosure relate to the assembly and electrical interconnection of ultrasound transducers having annular arrays.

SUMMARY

Embodiments (e.g., examples) of ultrasound devices, and associated methods of assembly thereof, are disclosed whereby an annular electrode array of an ultrasound transducer is electrically connected (e.g., wire bonded or conductive epoxied, etc.) to a flexible printed circuit board in a compact configuration. The flexible circuit board includes an elongate flexible segment and a distal distribution segment, where the distribution segment is attached to a peripheral support ring that surrounds at least a portion of the ultrasound transducer. The distribution segment includes a plurality of spatially distributed contact pads, and electrical connectors (e.g., wire bonds or conductive epoxy) are provided between the contact pads and the annular electrodes of the annular array. A backing material may be provided that contacts and extends from the annular array electrodes, and a distal portion of the elongate flexible segment may be encapsulated in the backing material, such that the distal portion extends inwardly from the peripheral support ring, without contacting the electrical connectors (e.g., wire bonds or conductive epoxy) and without contacting the array surface.

Accordingly, in one embodied aspect, there is provided an ultrasound device comprising: an ultrasound transducer comprising an annular ultrasound array, wherein said annular ultrasound array is defined at least in part by a plurality of concentric annular electrodes provided on a first surface of a piezoelectric layer, and wherein a ground plane electrode is provided on a second surface of said piezoelectric layer; a peripheral support ring surrounding at least a portion of said ultrasound transducer; and a flexible printed circuit board comprising: an elongate flexible segment; and a distribution segment that is in contact with at least a portion of said peripheral support ring, such that a plurality of conductive paths extending through said elongate flexible segment are routed through said distribution segment to respective contact pads located at different locations on said peripheral support ring; wherein each annular electrode is electrically connected (e.g., wire bonded or conductive epoxied) to a respective contact pad; and wherein at least one conductive path of said flexible printed circuit board is a ground conductive path that is in electrical contact with said ground plane electrode.

In various embodiments, an ultrasound device includes an ultrasound transducer comprising an annular ultrasound array, wherein the annular ultrasound array is defined at least in part by a plurality of concentric annular electrodes provided on a first surface of a piezoelectric layer, and wherein a ground plane electrode is provided on a second surface of the piezoelectric layer, a peripheral support ring surrounding at least a portion of the ultrasound transducer; and a flexible printed circuit board. In an embodiment, the flexible printed circuit board includes an elongate flexible segment and a distribution segment that is in contact with at least a portion of the peripheral support ring, such that a plurality of conductive paths extending through the elongate flexible segment are routed through the distribution segment to respective contact pads located at different locations on the peripheral support ring. In an embodiment, each annular electrode is electrically connected (e.g., wire bonded and/or conductively epoxied) to a respective contact pad. In an embodiment, at least one conductive path of the flexible printed circuit board is a ground conductive path that is in electrical contact with the ground plane electrode.

In an embodiment, the device also includes a backing material contacting and extending from the first surface, wherein a distal portion of the elongate flexible segment is encapsulated in the backing material, such that the distal portion of the elongate flexible segment extends inwardly (e.g., parallel and along the first surface) from the peripheral support ring and bends outwardly (e.g., perpendicularly) away from the first surface, within the backing material, without contacting the wire bonds and without contacting the first surface. In an embodiment, the plurality of conductive paths are routed bi-directionally within the distribution segment. In an embodiment, the distal portion of the elongate flexible segment comprises a plurality of branched distal segments that contact the peripheral support ring at different locations with gaps defined there between. In an embodiment, one or more of the branched distal segments include only two conductive paths. In an embodiment, the two conductive paths are bi-directionally routed to different contact pads. In an embodiment, one or more wire bonds are formed within each gap. In an embodiment, the distal portion of the elongate flexible segment is bent, within the backing material, over an angle ranging between 90 degrees and 180 degrees relative to the first surface. In an embodiment, the elongate flexible segment is encapsulated within the backing material and emerges from a distal surface of the backing material without extending beyond a side surface of the backing material. In an embodiment, the elongate flexible segment emerges from the backing material at an angle of approximately 90 degrees relative to the first surface. In an embodiment, the elongate flexible segment emerges from the backing material at an angle of greater than or equal to approximately 90 degrees relative to the first surface. In an embodiment, an initial radius of curvature of the distal portion of the elongate flexible segment is less than 8 mm. In an embodiment, a contact surface of the peripheral support ring that contacts the distribution segment is spatially offset from the first surface. In an embodiment, the elongate flexible segment extends outwardly from the peripheral support ring. In an embodiment, the peripheral support ring has a transverse width of less than 1 mm. In an embodiment, the peripheral support ring completely surrounds the ultrasound transducer. In an embodiment, the ultrasound transducer is disc shaped, and wherein the peripheral support ring is at least a portion of an annulus. In an embodiment, an outer diameter of the annulus is less than 10 mm. In an embodiment, the peripheral support ring is electrically conductive, and wherein the peripheral support ring is in electrical communication with the ground conductive path and the ground plane electrode. In an embodiment, the plurality of concentric annular electrodes are provided in a sparse configuration, thereby defining a sparse annular ultrasound array.

A further understanding of the functional and advantageous aspects of the disclosure can be realized by reference to the following detailed description and drawings.

BRIEF DESCRIPTION OF THE DRAWINGS

Embodiments will now be described, by way of example only, with reference to the drawings, in which:

FIGS. 16A and 169 illustrate an example embodiment in which each annular array includes conductive features that encode information.

DETAILED DESCRIPTION OF THE PREFERRED EMBODIMENT

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms "comprises" and "comprising" are to be construed as being inclusive and open ended, and not exclusive. Specifically, when used in the specification and claims, the terms "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately" are meant cover variations that may exist in the upper and lower limits of the ranges of values, such as variations in properties, parameters, and dimensions. Unless otherwise specified, the terms "about" and "approximately" mean plus or minus 10 percent or less.

It is to be understood that unless otherwise specified, any specified range or group is as a shorthand way of referring to each and every member of a range or group individually, as well as each and every possible sub-range or sub-group encompassed therein and similarly with respect to any sub-ranges or sub-groups therein. Unless otherwise specified, the present disclosure relates to and explicitly incorporates each and every specific member and combination of sub-ranges or sub-groups.

As used herein, the term "on the order of", when used in conjunction with a quantity or parameter, refers to a range spanning approximately one tenth to ten times the stated quantity or parameter.

In various example embodiments of the present disclosure, ultrasound devices are described in which electrodes of an annular ultrasound array are electrically connected (e.g., wire bonded or conductive epoxied) to a flexible printed circuit board. Various configurations and methods of manufacture are provided for forming electrical connections (e.g., wire bonds or conductive epoxy) between annular electrodes of the annular ultrasound array and contact pads of the flexible printed circuit board, where the contact pads are supported by, and spatially distributed around, a peripheral support ring that surrounds at least a portion of the ultrasound transducer.

Figure 1:
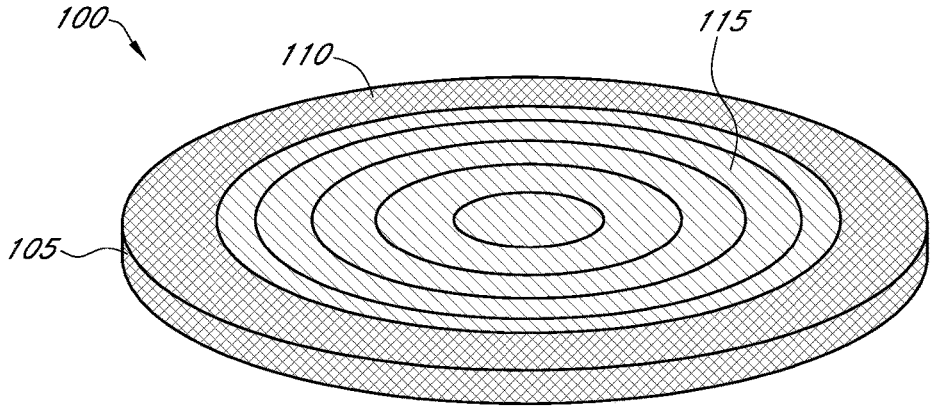
FIG. 1 shows an example of an ultrasound transducer having an annular ultrasound array.

FIG. 1 shows an example of an ultrasound transducer 100 that includes an annular ultrasound array. The example ultrasound transducer 100 includes a piezoelectric layer 105 having a first side 110 on which a set of concentric annular electrodes 115 are provided. The other surface (not shown) of the piezoelectric layer 105 has an electrode provided thereon (e.g. a ground plane electrode). The concentric annular electrodes 115 define, at least in part, annular array elements of the annular ultrasound array. The array may be a kerfed array, or may be a kerfless array. The ultrasound transducer 100 may include one or more additional layers, such as impedance matching layers, and a backing material (e.g., an acoustic backing material).

As shown in FIGS. 2A, 2B, 3A and 3B, the electrically connecting (e.g., wire bonding or conductive epoxying) of the annular electrodes 115 to contact pads of a flexible printed circuit board may be facilitated by the use of a peripheral support ring. As shown FIG. 3A, a peripheral support ring 130 is provided such that it surrounds at least a portion of the ultrasound transducer 100. The peripheral support ring 130 is shaped to support the distal region of a flexible printed circuit board. The peripheral support ring 130 may be electrically conductive over its entirety or over a portion thereof.

Figure 2A:
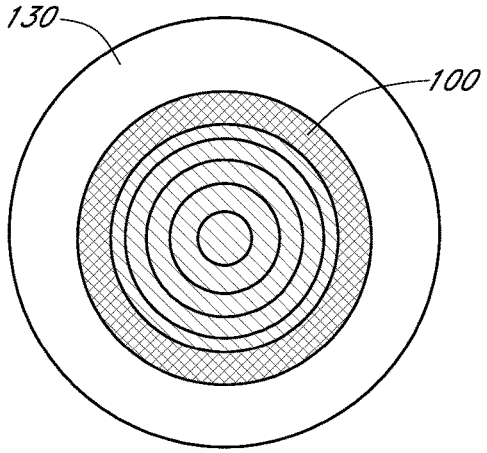
FIGS. 2A and 2B show (A) a peripheral support ring surrounding an ultrasound transducer having an annular ultrasound array, and (B) a flexible printed circuit board suitable for mounting to the peripheral support ring and electrically connecting (e.g., wire bonding or conductive epoxying) to the annular electrodes of the annular ultrasound array.
Figure 2B:
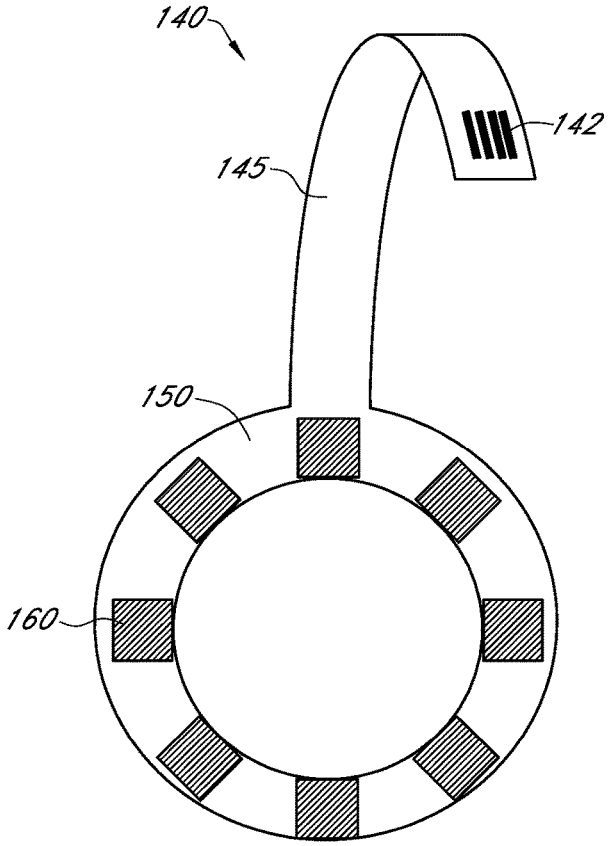

An example of a suitable flexible printed circuit board 140 is shown in FIG. 2B. The example flexible printed circuit board 140 has an elongate flexible segment 145, 142 and a distribution segment 150 (which may also be flexible). The distribution segment 150 has a spatially distributed array of contact pads 160 that are in electrical communication with the conductive paths of the flexible printed circuit board. The proximal region of the elongate flexible segment 145 may include a plurality of proximal contact pads.

Figure 3A:
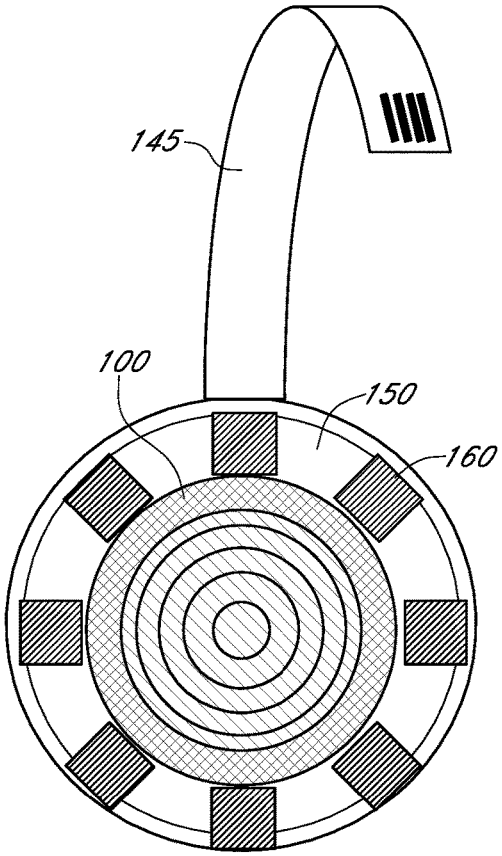
FIGS. 3A and 3B show front and back views, respectively, of an assembly in which an ultrasound transducer is surrounded by a peripheral support ring having a flexible printed circuit board mounted thereto, prior to electrically connecting (e.g., wire bonding or conductive epoxying).
Figure 3B:
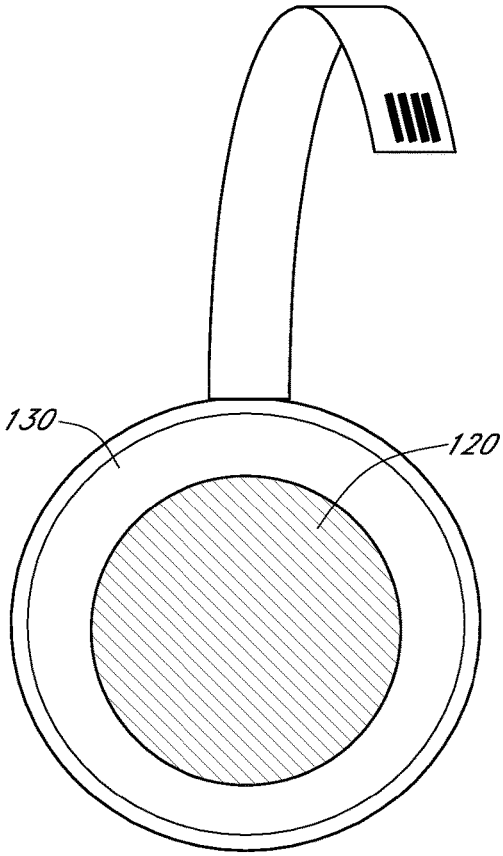

The distribution segment 150 is shaped so that it can be mounted or otherwise affixed to the peripheral support ring 130. FIGS. 3A and 3B show a configuration in which the distribution segment 150 is mounted to the peripheral support ring (the peripheral support ring lies beneath the distribution segment 150 in FIG. 3A). The contact pads 160 of the distribution segment 150 are spatially distributed around the outer perimeter of the ultrasound transducer 100, thus facilitating electrically connecting (e.g., wire bonding or conductive epoxying).

FIG. 3B shows the corresponding back view relative to FIG. 3A, where the ground plane electrode 120 is visible adjacent to the peripheral support ring 130. This second surface, shown in FIG. 3B, is the surface through which the ultrasound beam is to be emitted and/or received.

As described below, in some embodiments, the peripheral support ring 130 may be electrically conductive and brought into electrical communication with a ground conductive path of the flexible printed circuit and with the ground plane electrode 120 of the ultrasound transducer. For example, the bottom surface of the distribution segment 150 may include an exposed conductive region that may be attached to a conductive peripheral support ring though an electrically conductive bonding means (such as soldering), and the electrical connection between the bottom surface of the conductive peripheral support ring and the ground plane electrode 120 of the ultrasound transducer may be may via evaporative deposition of a metal (this evaporative step may be performed after infiltration with an epoxy backing material, as described in further detail below, such that a gap between the ultrasound transducer and the peripheral support ring is filled, at least partially, with backing material, upon which the metal may be deposited to form the electrical connection).

Figure 4A:
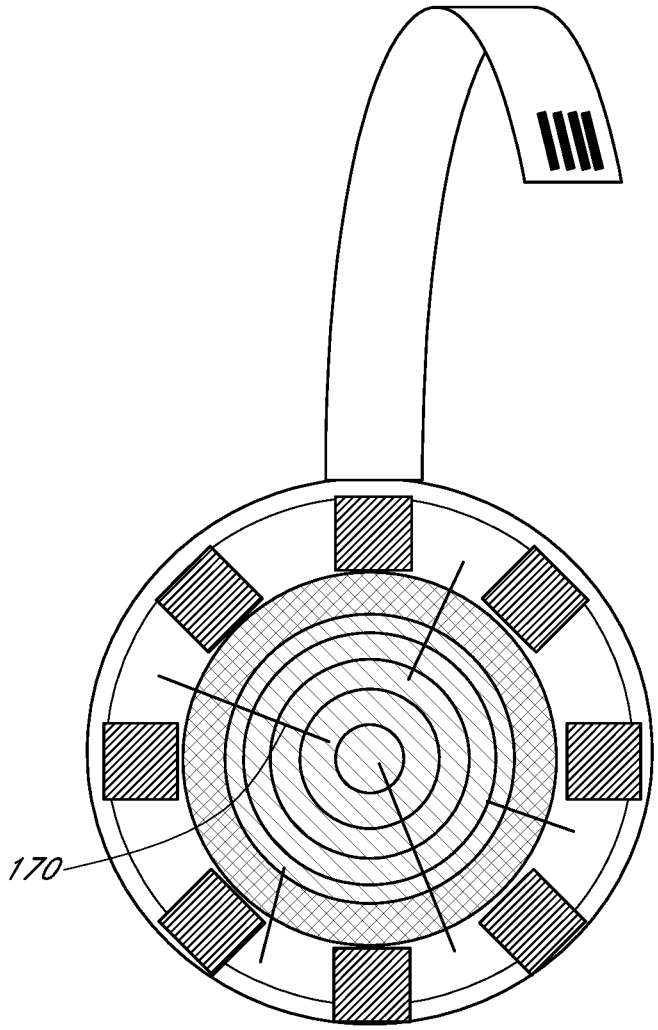
FIGS. 4A and 4B show top and sides views, respectively, of an assembly in which an ultrasound transducer is surrounded by a peripheral supporting ring having a flexible printed circuit board mounted thereto, after electrically connecting (e.g., wire bonding or conductive epoxying).
Figure 4B:
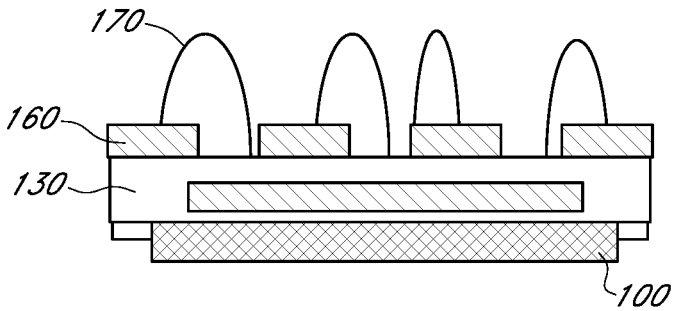
Figure 5A:
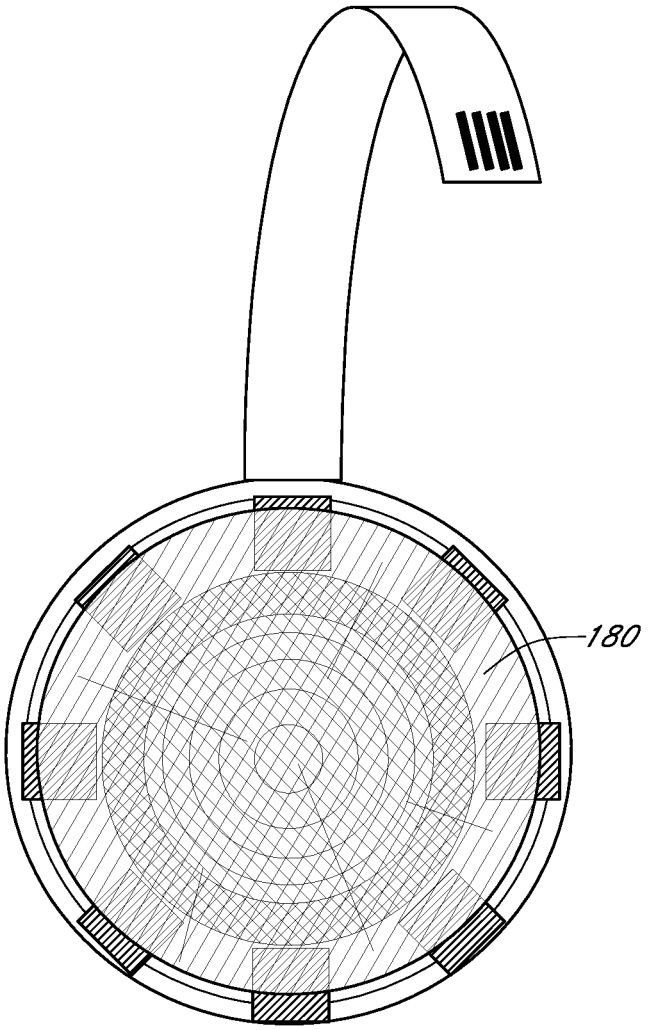
FIGS. 5A and 5B show top and sides views, respectively, of an assembly in which an ultrasound transducer is surrounded by a peripheral supporting ring having a flexible printed circuit board mounted thereto, after incorporation of a backing material.
Figure 5B:
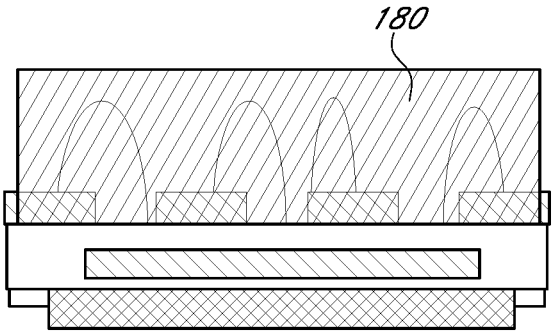
Figure 6:
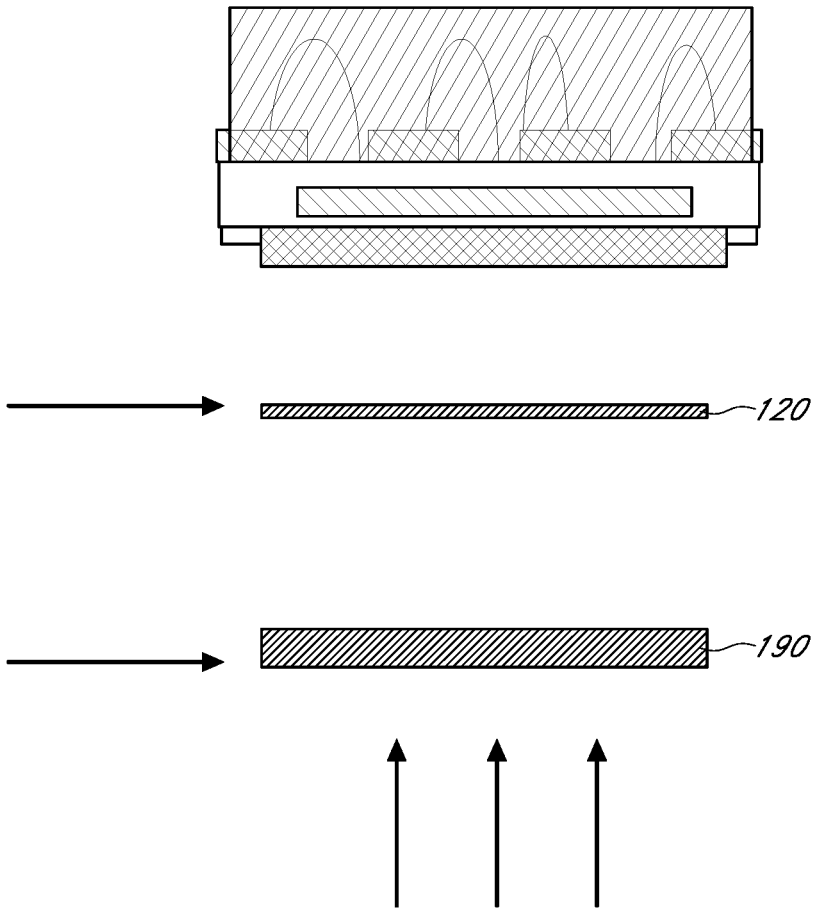
FIG. 6 shows the addition of a ground plane electrode and a matching layer.

The spatial distribution of the contact pads 160 around the peripheral region of the ultrasound transducer facilitates electrically connecting (e.g., wire bonding or conductive epoxying) of the contact pads 160 to the annular array elements 115. This is shown in FIGS. 4A and 4B, where electrical connections 170 (e.g., wire bonds 170 or conductive epoxy 170) are shown between the contact pads 160 and the annular electrodes 115 of the ultrasound transducer. It is noted that FIG. 4B is a cross-sectional profile that omits the elongate segment of the flexible printed circuit board. FIGS. 5A and 5B show how a backing material 180 may be added to contact the first surface of the ultrasound transducer and encapsulate the electrical connections (e.g., wire bonds or conductive epoxy). FIG. 6 shows the addition of the ground electrode 120 to the second side of the piezoelectric layer, and the addition of a matching layer 190.

In embodiments in which the annular support ring is electrically conductive, a spatial gap (not shown in FIG. 2A) is maintained between the inner portion of the peripheral support ring 130 and the outer portion of the ultrasound transducer 100. Furthermore, although the piezoelectric layer 105 is shown having a disc shape, it will be understood that other shapes (e.g. square or rectangular may be employed). However, it will be beneficial to employ a circular shape in order to reduce the cross-sectional size (e.g. diameter) of the overall device.

In the example embodiment illustrated in FIGS. 2A to 7, the elongate flexible segment 145 of the flexible printed circuit board 140 is connected to the distribution segment 150 such that the elongate flexible segment extends outwardly from the peripheral support ring. However, in other example embodiments that are described here below, the elongate flexible segment 145 may be connected to the distribution segment 150 such that a distal portion of the elongate flexible segment 145 is encapsulated within the backing material, and such that the distal portion of the elongate flexible segment 145 extends inwardly (e.g., parallel and along the transducer surface) from the peripheral support ring 130 and bends outwardly (e.g., perpendicular to the transducer surface) away from the first surface 110 of the ultrasound transducer, within the backing material. In one embodiment, the elongate flexible segment 145 may be connected to the distribution segment 150 such that a distal portion of the elongate flexible segment 145 is encapsulated within the backing material, and such that the distal portion of the elongate flexible segment 145 extends parallel and along the transducer surface from the peripheral support ring 130 and bends perpendicular to the transducer surface away from the first surface 110 of the ultrasound transducer, within the backing material.

Figure 7A:
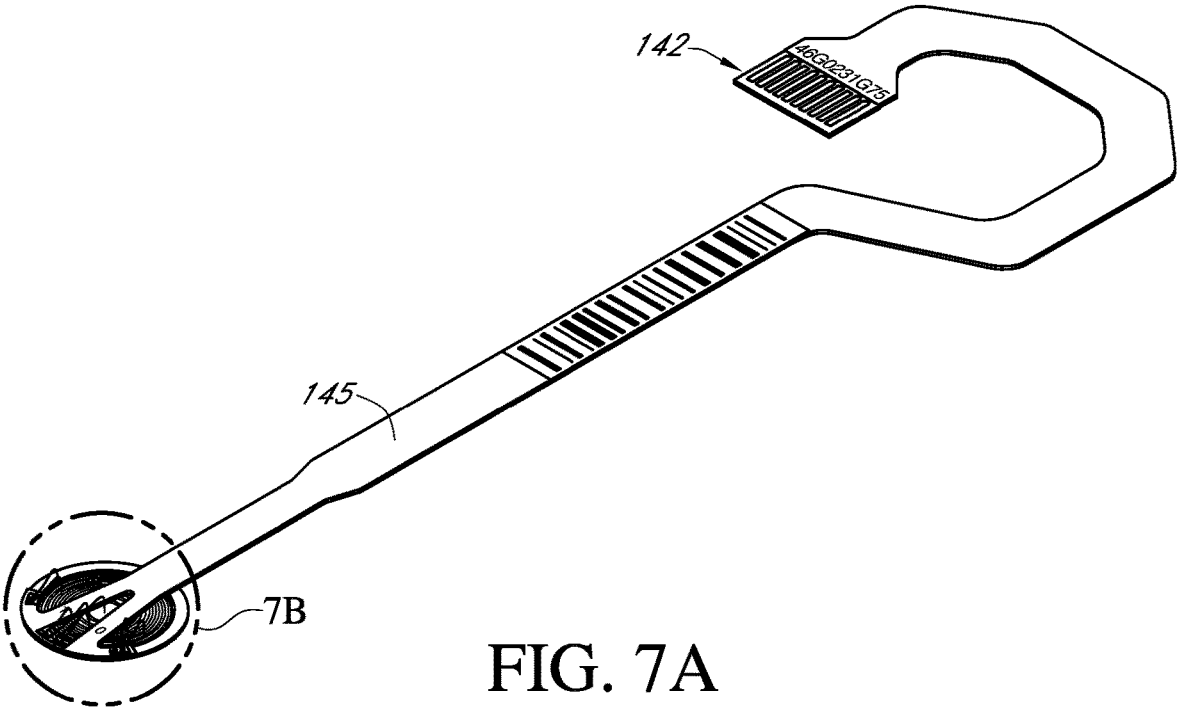
FIGS. 7A and 7B show an example embodiment in which the distal portion of the elongate segment of a flexible printed circuit board extends inwardly from the peripheral ring for encapsulation within a backing material.
Figure 7B:
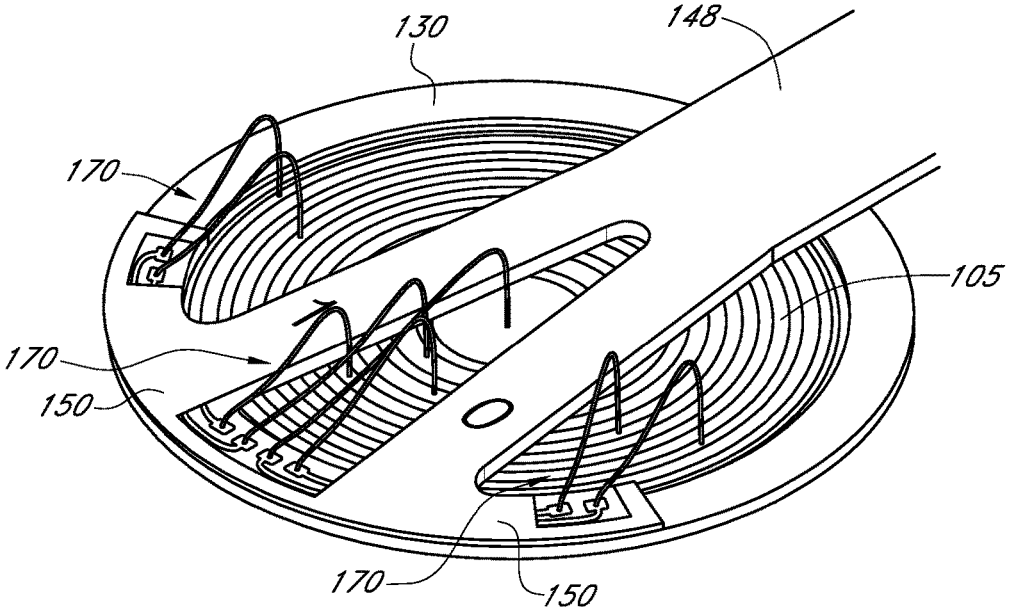

An example of such an embodiment is illustrated in FIGS. 7A and 7B, where FIG. 7A shows the device including the full length of the flexible printed circuit board 140, while FIG. 7B shows a detail (A) illustrating how the distal portion 148 of the elongate flexible segment 145, 142 is connected to the distribution segment 150. As shown in FIG. 7B, the distal portion 148 of the elongate flexible segment 145 extends inwardly (e.g., parallel and along the transducer surface) from the peripheral support ring 130. This distal portion 148 may be bent outwardly (e.g., perpendicular to the transducer surface) away from the first surface of the ultrasound transducer, such that the distal portion 148 of the elongate flexible segment avoids contact with the electrical connections 170 (e.g., wire bonds 170 or conductive epoxy 170) and does not contact the first surface 110 of the ultrasound transducer.

Figure 8A:
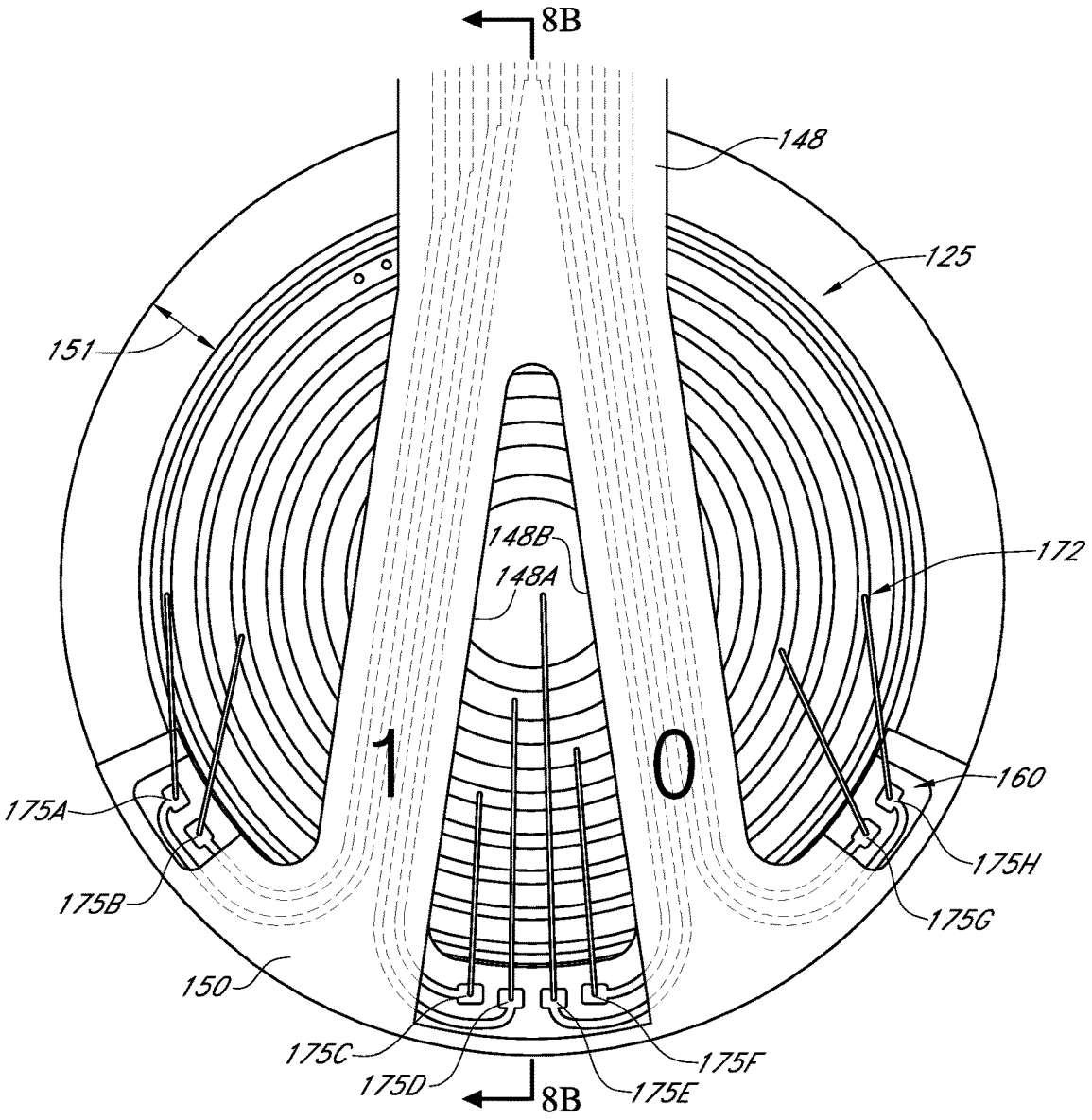
FIGS. 8A and 8B show top and side views of the embodiment shown in FIGS. 7A and 7B.

Referring now to FIG. 8A, an overhead view is provided that shows the configuration of the distal portion of the elongate flexible segment 145 relative to the peripheral support ring 130. The figure also illustrates the routing of the various conductive paths of the flexible printed circuit board to different contact pads 160 within the distribution segment 150 of the flexible printed circuit board. The figure shows the electrical connections (e.g., wire bonds or conductive epoxy) that extend from each contact pad (175A-H) to respective annular electrodes (e.g. see 172). In the present example embodiment, the peripheral support ring 130 is electrically conductive, and a gap 125 is provided between the outer perimeter of the ultrasound transducer and the inner edge of the peripheral support ring 130 to electrically isolate the peripheral support ring 130 from the annular electrodes 115 (note however that electrical contact is made between the peripheral support ring 130 and the ground plane electrode that is formed on the second side of the ultrasound transducer after infiltration with the backing material).

As shown in FIG. 8A, the conductive paths of the flexible printed circuit board may be routed bi-directionally within the distribution segment 150, such that some of the conductive paths are routed within the distribution segment 150 in one peripheral direction, while other conductive paths are routed in the distribution segment 150 in an opposing peripheral direction. For example, an even number of conductive paths may be routed in each direction. Such embodiments may be beneficial in reducing or minimizing the transverse width 151 of the peripheral support ring 130 (measured in a direction perpendicular to the peripheral direction), since the minimum transverse width 151 is proportional or otherwise related to the number of conductive paths that are routed in a given direction. For example, the peripheral support ring may have a transverse width of less than 2 mm, less than 1 mm, less than 750 microns, or less than 500 microns. In some example implementations in which the peripheral support ring is an annulus, an outer diameter of the annulus may be selected to be 20 mm, less than 10 mm, less than 7 mm, or less than 5 mm.

In some embodiments, the distal portion 148 of the elongate segment of the flexible printed circuit may be a single segment. However, in other embodiments, such as the embodiment shown in FIG. 8A, the distal portion 148 may be split to provide a plurality of branched distal segments (e.g. branched distal segments 148A and 148B) that contact the peripheral support ring at different locations. The gap that is formed between the branched distal segments 148A and 148B may be employed for electrically connecting (e.g., wire bonding or conductive epoxying) at least a portion of the annular electrodes.

Figure 9:
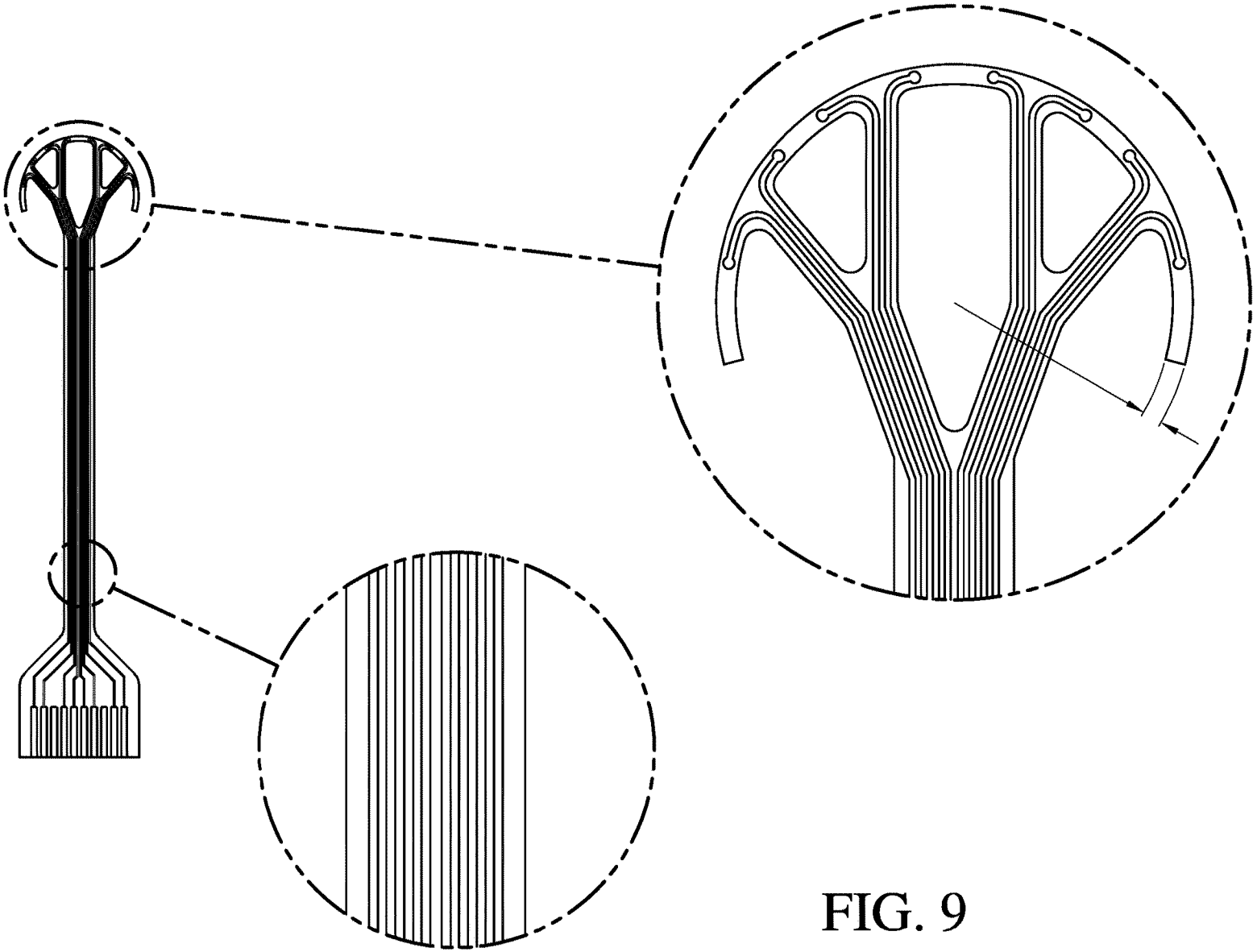
FIG. 9 shows an example embodiment of a flexible printed circuit board having branched distal segments, with two conductive signal paths per branched distal segment.
Figure 10:
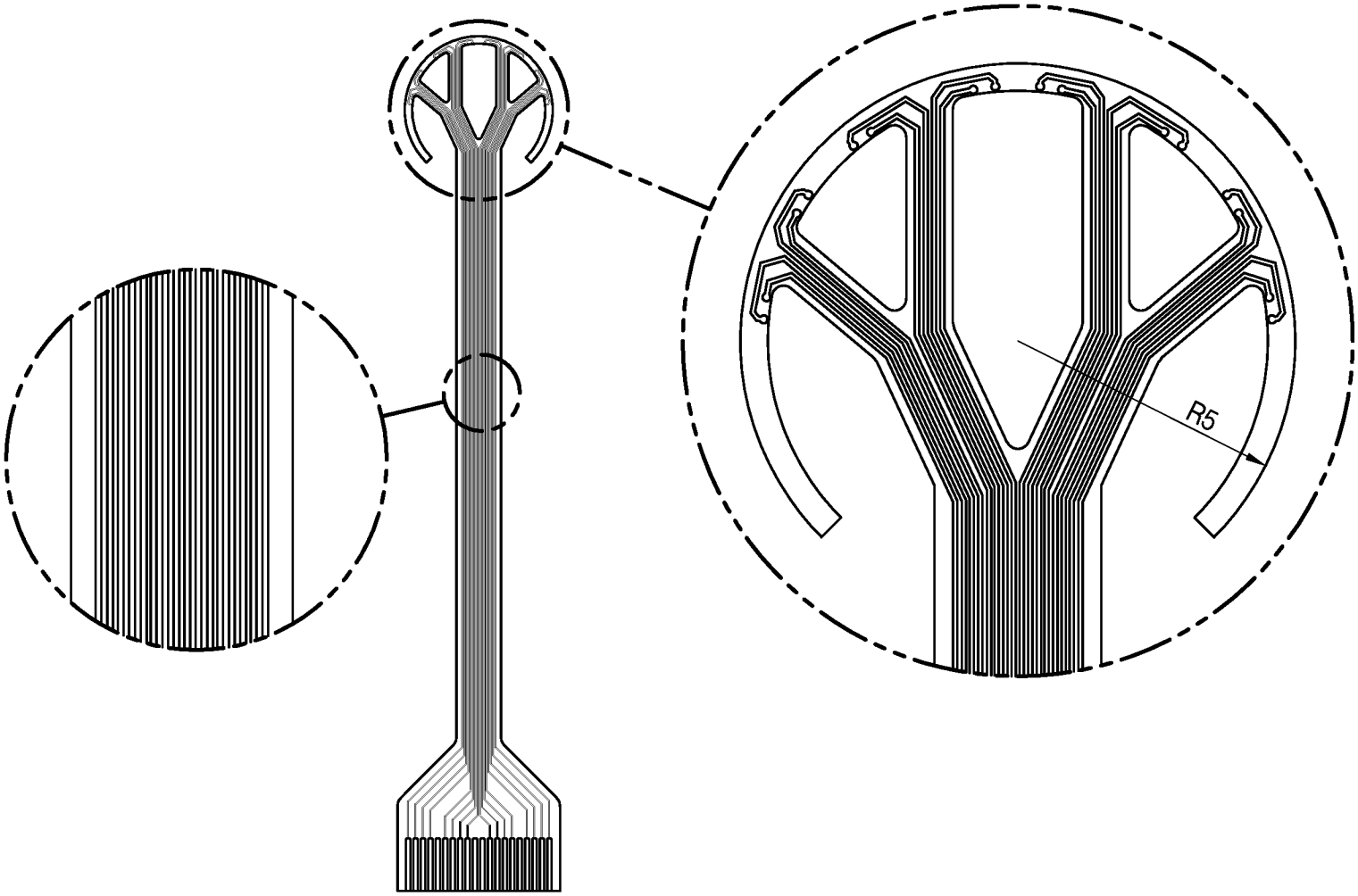
FIG. 10 shows another example embodiment of a flexible printed circuit board having branched distal segments, with sixteen conductive signal paths, and four conductive signal paths per branched distal segment.

In one example implementation, the number of branched distal segments may be selected so that at least one branched distal segment includes only two conductive paths (optionally plus a ground path formed on a separate layer), such that when the two conductive paths are bi-directionally routed within the distribution segment, only one conductive path is routed in each direction. Such an example embodiment may be beneficial in enabling a thin peripheral support ring. An example of such an embodiment is shown in FIG. 9. FIG. 10 illustrates another example implementation in which sixteen conductive channels are split among four branched distal segments.

Figure 8B:
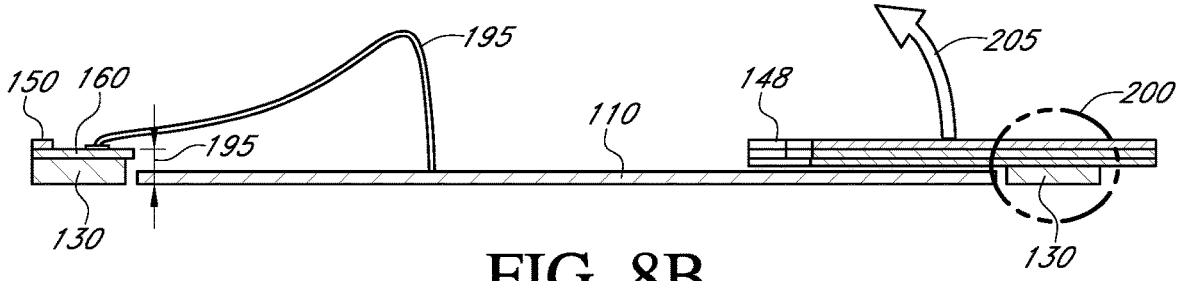

FIG. 8B shows a cross-sectional view of the embodiment shown in FIG. 8A, where the cross-section is taken through one of the electrical connections (e.g., wire bonds or conductive epoxy). As can be seen in the figure, the distal portion 148 of the elongate flexible segment may initially lay in contact with the peripheral support ring 130 in the region shown at 200. However, during assembly, the distal portion 148 is bent away (see arrow 205) from the surface 110 of the ultrasound transducer, thereby allowing the backing material to infiltrate the region below the distal portion 148, contacting the surface 110. In one embodiment, the orientation of the distal portion 148 allows the bend radius of the flex PCB to be larger than the full of the transducer 130 when exiting in a direction perpendicular to the surface 110. In an embodiment, this reduces stress on the flex PCB, increasing reliability and simplifying the fabrication process. In an embodiment, this allows for the flex to be directed backwards perpendicular to the transducer surface while maintaining a large flex bend radius. Several example manufacturing and assembly steps are described in further detail below. A spatial offset 195 may be provided between the upper surface of the peripheral support ring 130 and the first surface 110 of the ultrasound transducer (e.g. to assist with the infiltration of the backing material beneath the distal portion 148 near the distribution segment 150). Alternatively, the thickness of the peripheral support ring may be approximately equal to that of the ultrasound transducer.

FIGS. 11-15 illustrate various steps in an example process of providing a backing material that encapsulates the distal portion of the elongate flexible segment of the flexible printed circuit board. According to the present example method, the distribution segment of the flexible printed circuit board is initially attached to the peripheral support ring. For example, the distribution segment may be soldered to the peripheral support ring if the peripheral support ring is formed from a metal (e.g. copper). This step may be achieved, for example, using a mounting jig, such as the example mounting jig shown in FIG. 13.

Figure 12A:
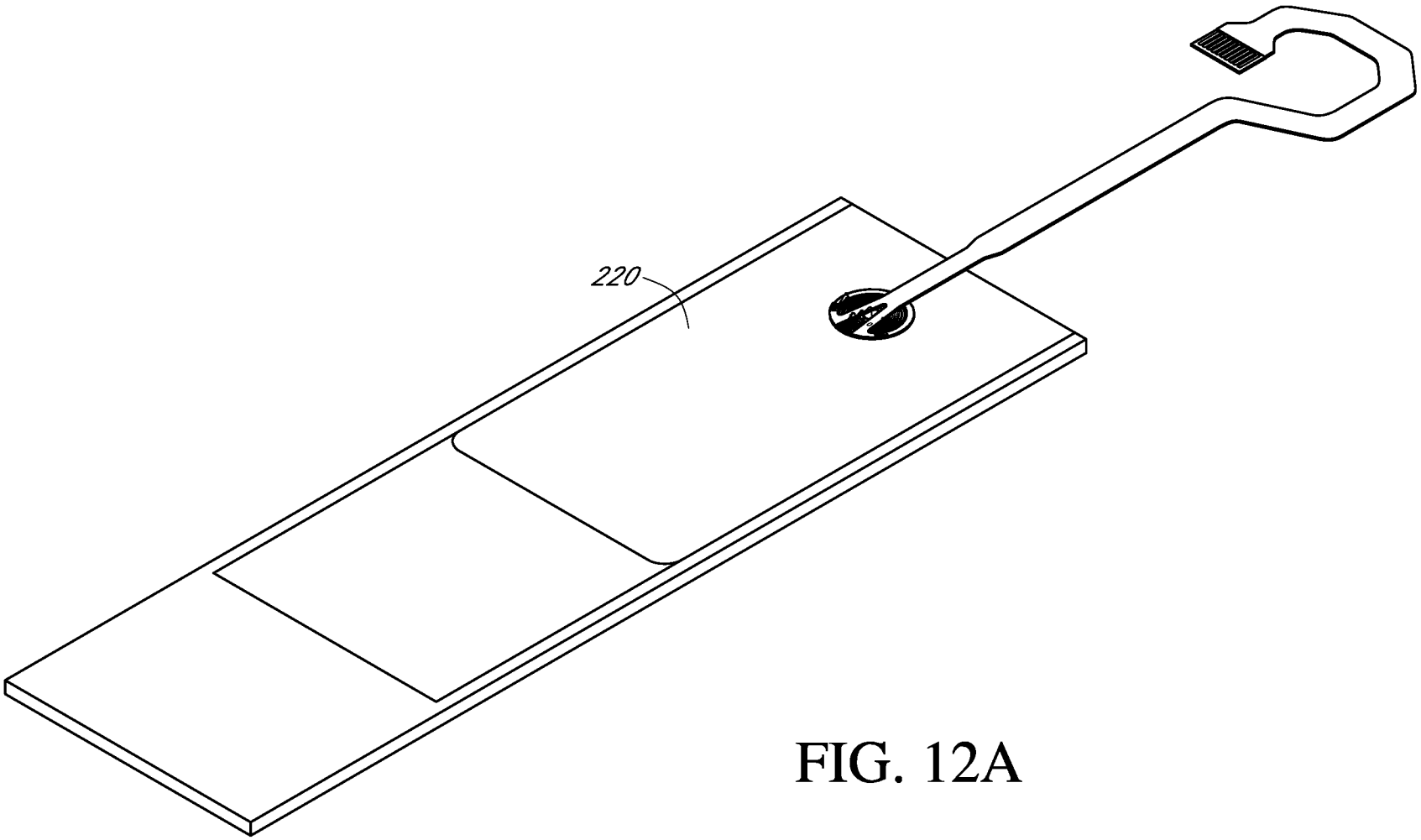
FIGS. 12A-12E show photographs of several assembly steps of an example method, including steps involving the addition of a backing material.

Having attached the flexible printed circuit board to the peripheral support ring, the peripheral support ring positioned to surround (at least in part) the ultrasound transducer. For example, as shown in FIG. 12A, the ultrasound transducer may be placed on double-sided tape 220, and the peripheral support ring may be placed on the double-sided tape so as to surround the ultrasound transducer. Electrically connecting (e.g., wire bonding or conductive epoxying) may then be performed.

Figure 12B:
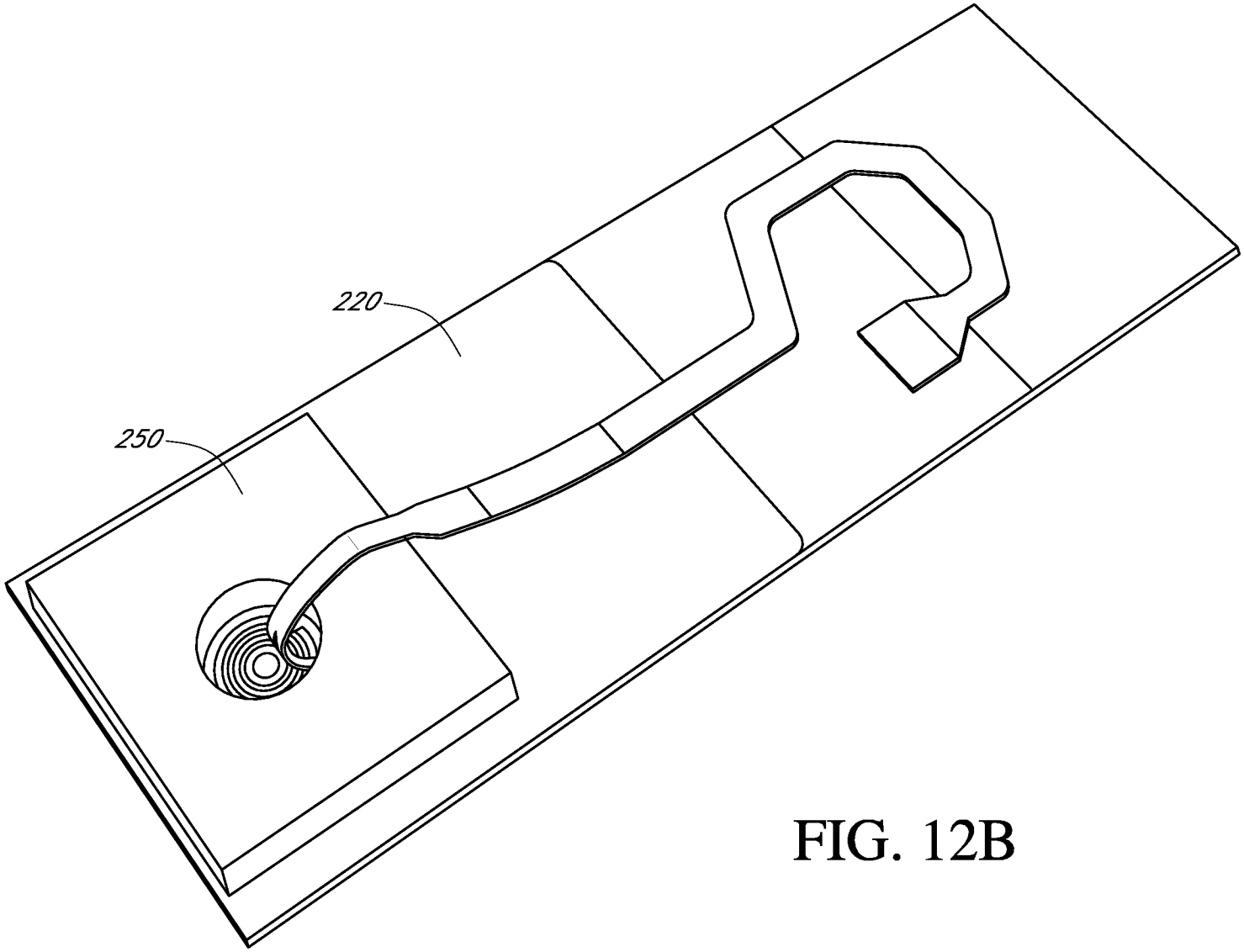
Figure 12C:
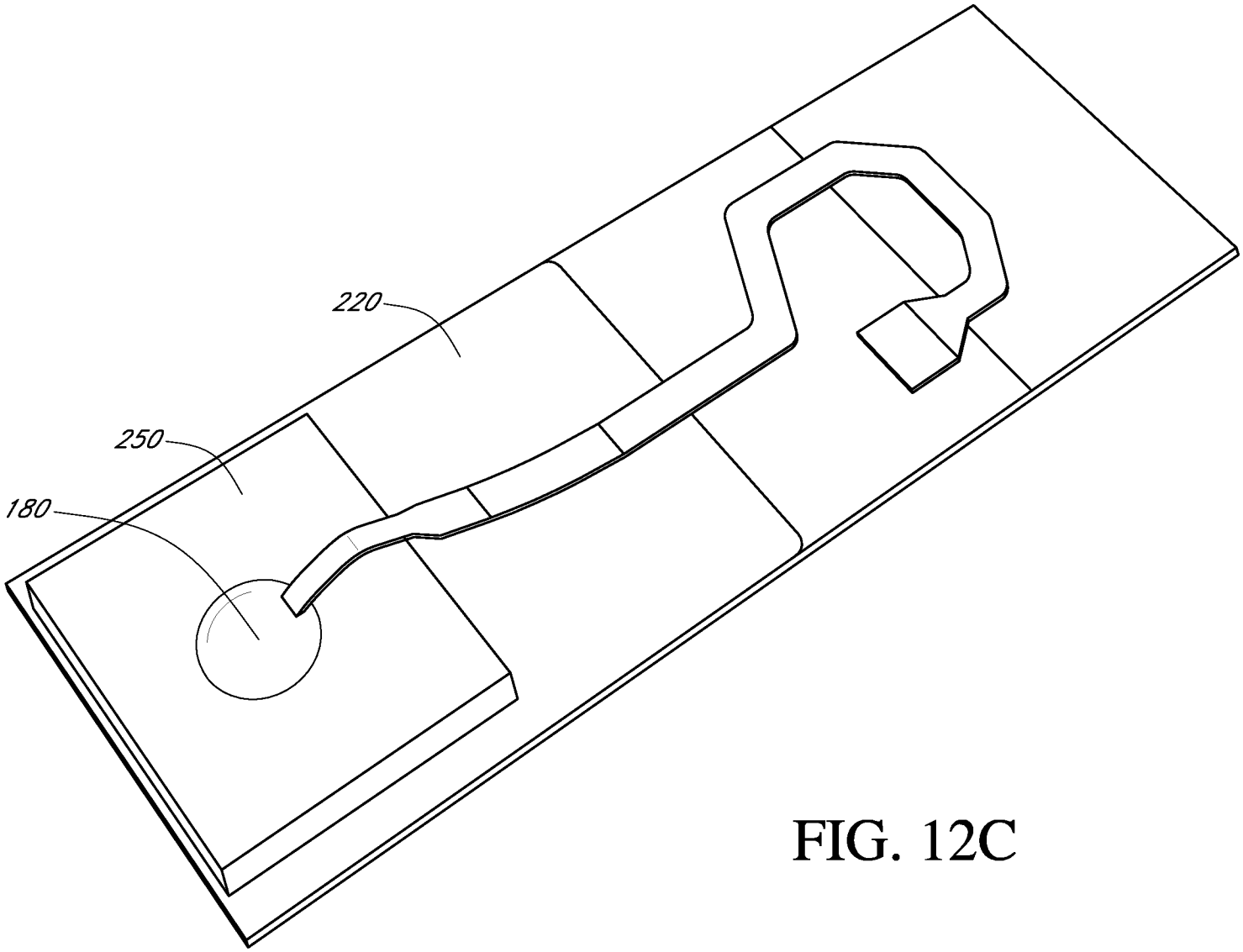
Figure 13:
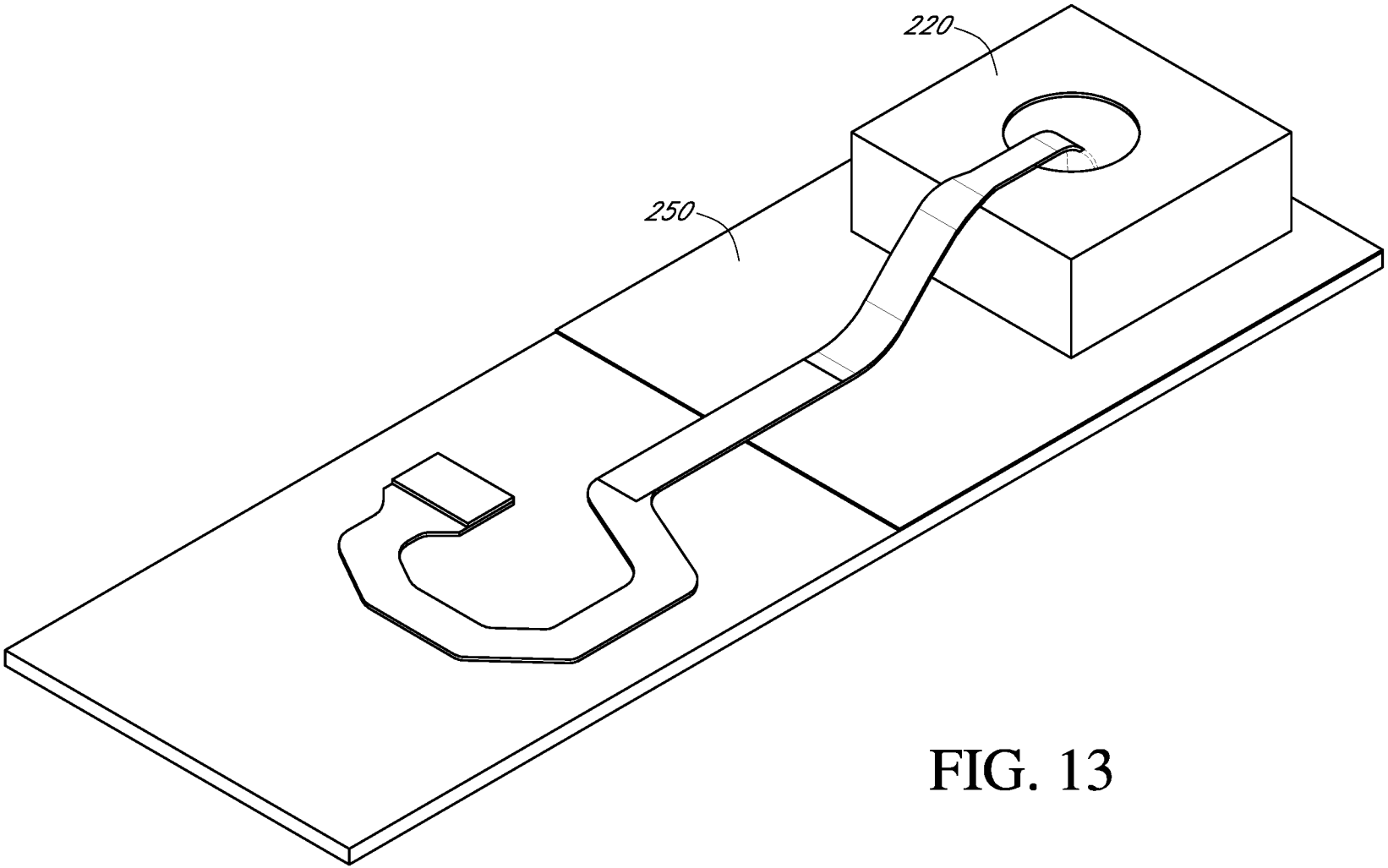
FIGS. 13 and 14A-C show illustrations of several example assembly steps including the addition of a backing material.
Figure 14A:
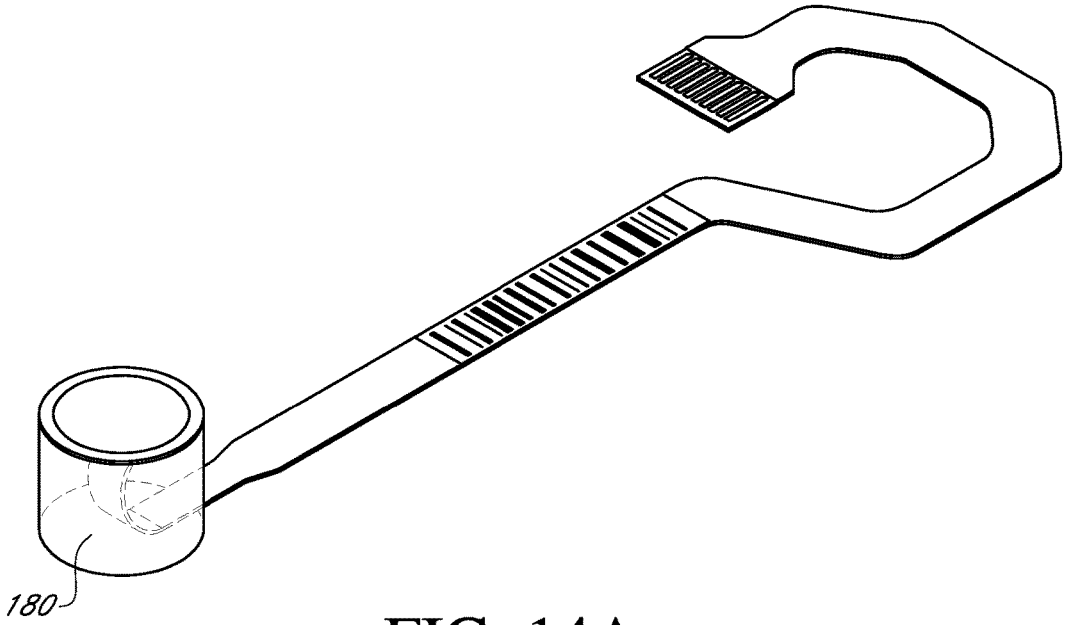
Figure 14B:
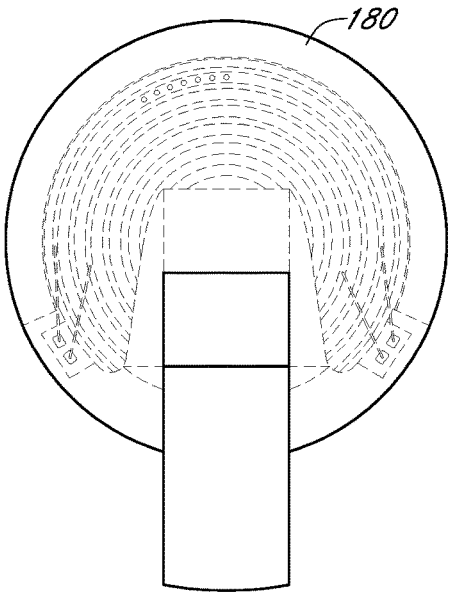
Figure 14C:
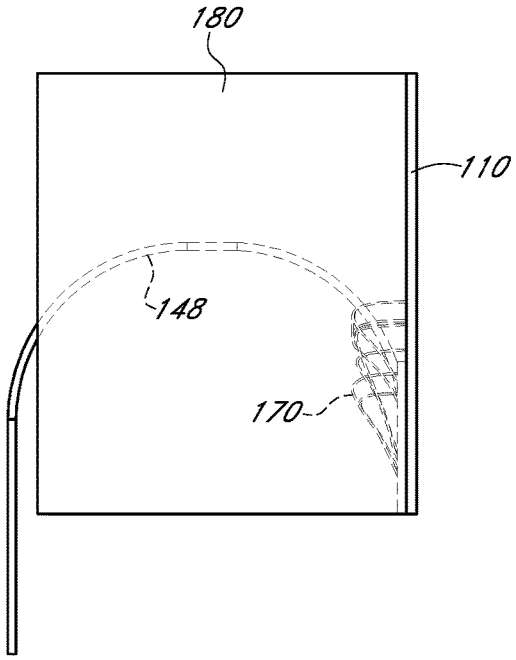

As shown in FIGS. 12B, 12C and 13, a removable mold 250, such as a silicone mold, may then be placed over the assembly. The mold 250 may be filled with a backing material (e.g., an acoustic backing material), such as an epoxy backing. It will be understood that a wide variety of backing materials may be employed. In some embodiments, the backing material is an acoustic backing material. The mold 250 may then be removed to yield an assembled device. As shown in FIGS. 14A-C, the backing material 180 is provided such that it contacts the first surface 110 of the ultrasound transducer, and the backing material 180 may fully encapsulate the electrical connections 170 (e.g., wire bonds 170 or conductive epoxy 170).

It will be understand that the use of a removable mold is merely illustrative of one non-limiting example assembly method. In another example method, a housing may be provided that forms an outer shell surrounding the backing material after the backing material is cured.

Figure 12D:
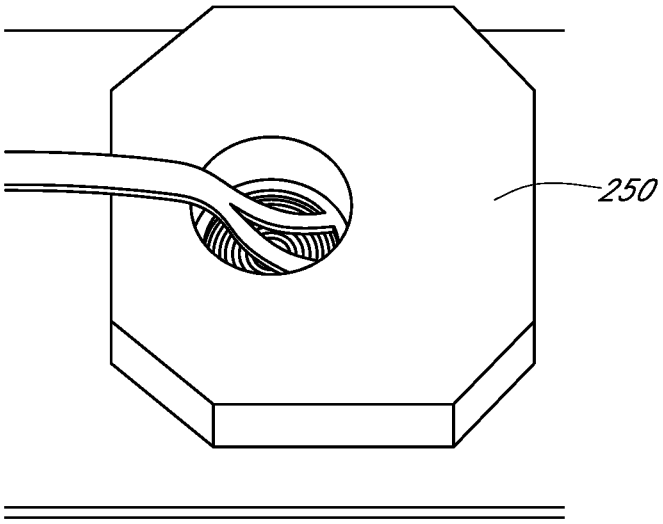
Figure 12E:
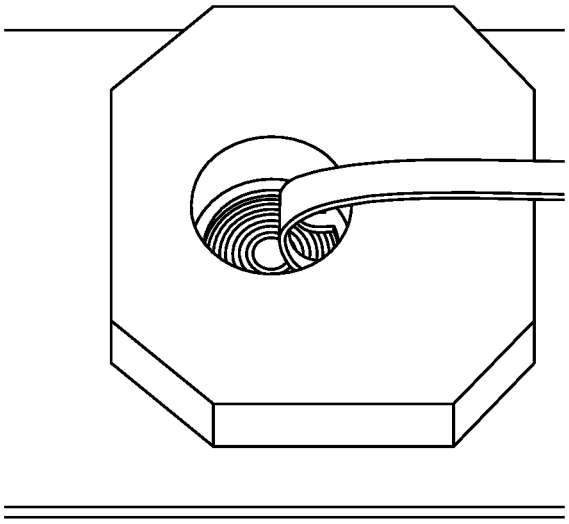

As shown in FIGS. 12D and 12E, the distal portion 148 of the elongate flexible segment may be bent in order to draw the distal portion away from the first surface of the ultrasound transducer, and to facilitate the infiltration of the backing material. For example, the distal portion of the elongate flexible segment may be bent such that the elongate flexible segment emerges through a distal surface of the backing material at an angle of approximately 90 degrees, less than 90 degrees, greater than or equal to 90 degrees, or between 90 and 180 degrees, relative to the first surface of the ultrasound transducer. The distal portion of the elongate flexible segment may be bent according to an initial radius of curvature that is less than 8 mm, less than 5 min, less than 3 mm, or less than 2 mm.

As shown in FIGS. 14A-C, the distal portion of the elongate flexible segment may be encapsulated within the backing material such that it emerges from a distal surface of the backing material without extending beyond a side surface of the backing material. FIG. 14C shows a non-limiting example implementation in which the elongate flexible segment emerges from the backing material at an angle of approximately 180 degrees relative to the first surface of the ultrasound transducer.

Figure 11:
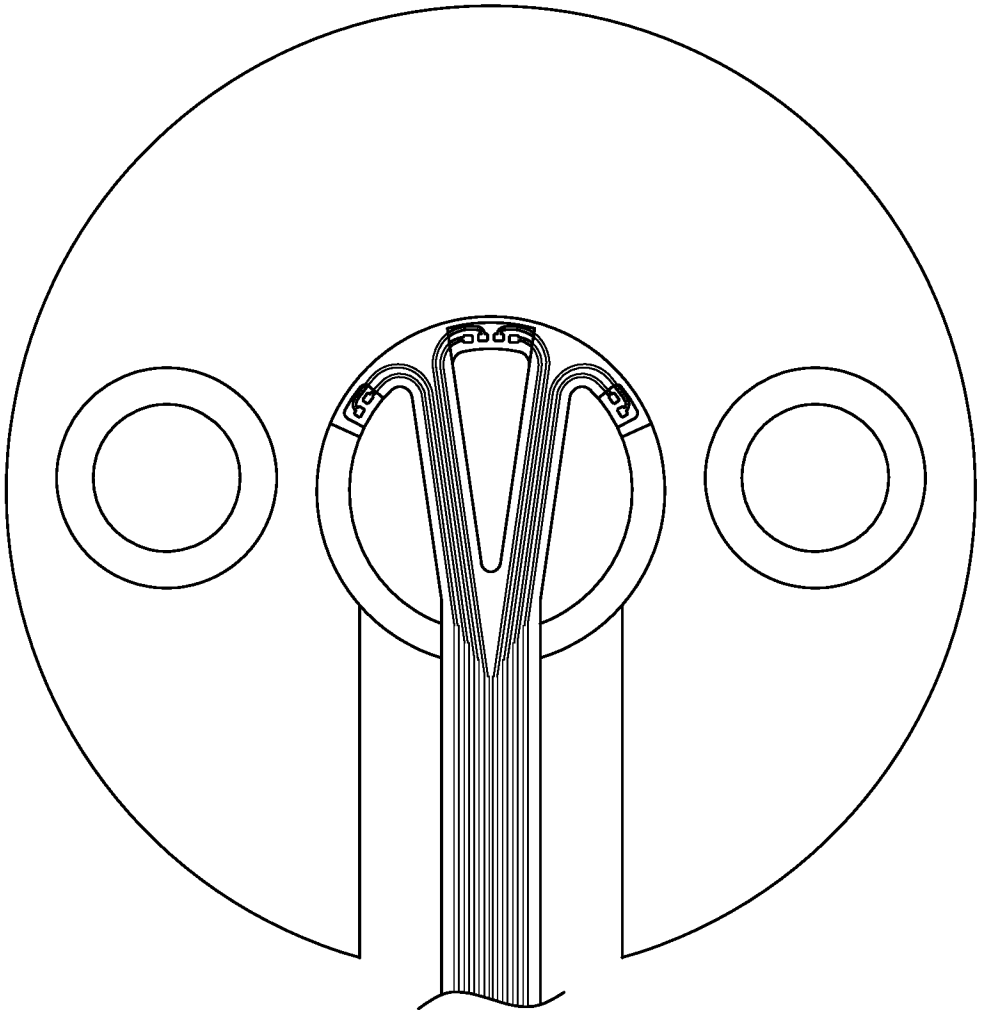
FIG. 11 shows an example assembly jig for mounting the distribution segment of the printed circuit board to the peripheral support ring.
Figure 15:
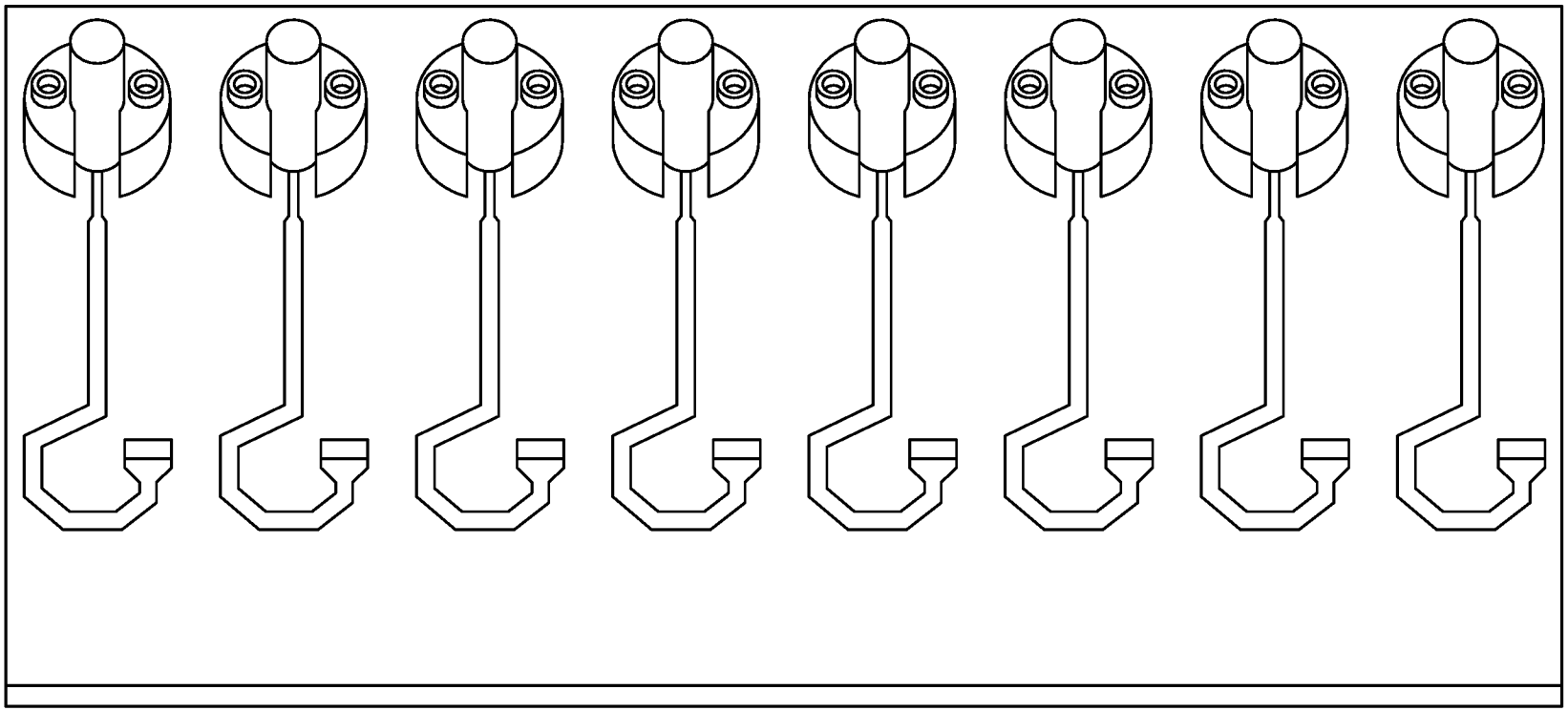
FIG. 15 shows eight assembly jigs as individually depicted in FIG. 11, each containing a peripheral support ring having a flexible printed circuit board mounted thereto for the purpose of reflow soldering.

FIG. 15 shows eight assembly jigs as individually depicted in FIG. 11, each containing a peripheral support ring having a flexible printed circuit board mounted thereto for the purpose of reflow soldering.

Although many of the preceding embodiments employ a backing layer that encapsulates a portion of the elongate flexible segment of the flexible printed circuit board, other example embodiments may be realized using an air-backed configuration. For example, a housing, or guide piece may be attached to the peripheral support ring, where the housing or guide piece includes one or more features to bend and support the distal region of the elongate flexible portion.

Figure 16A:
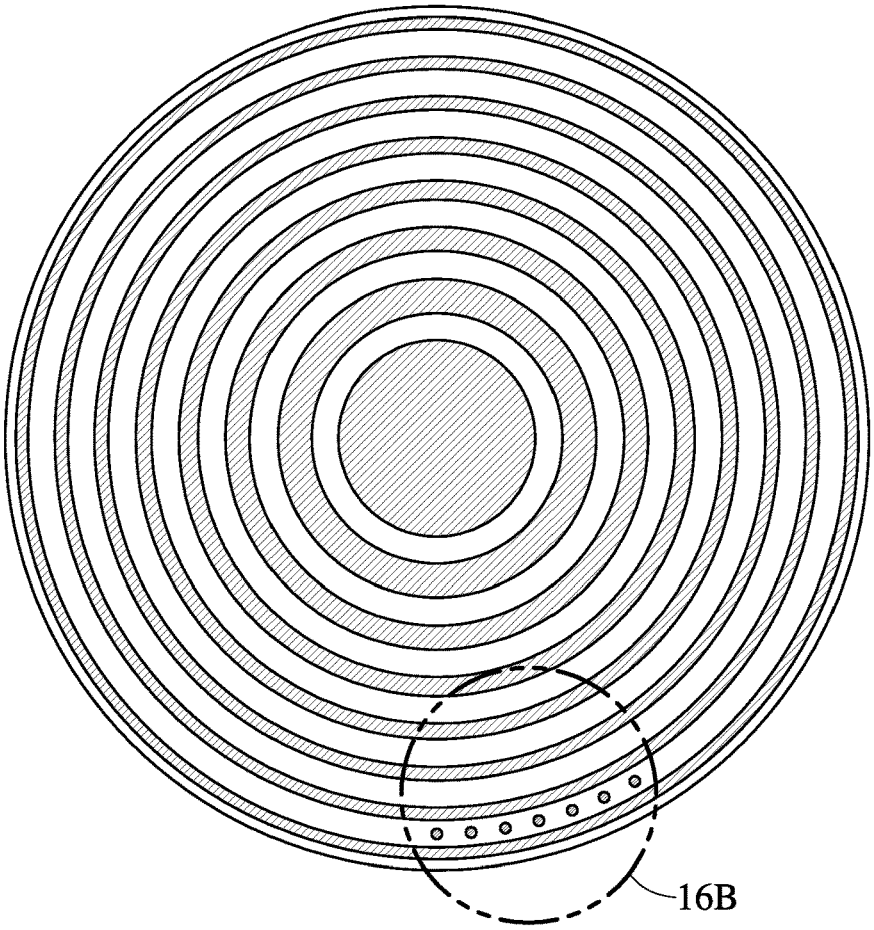
Figure 16B:
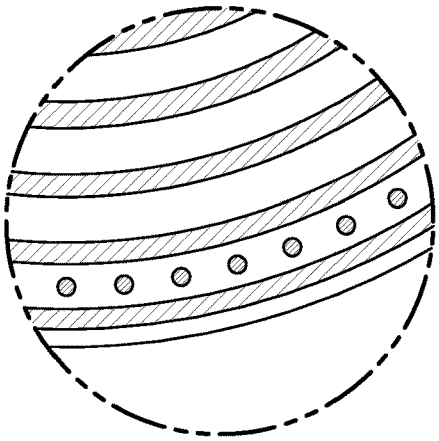

As shown in FIGS. 16A and 16B, one or more annular regions between the annular electrodes may be encoded with conductive markings such as text, barcodes, and other symbols. These conductive markings may be included in the mask that is employed to form the annular electrodes, and the markings may uniquely identify each annular array on a given wafer. In the example implementation shown in FIGS. 16A and 16B, the markings are a series of dots, where each dot encodes one bit of a seven-bit identifier, where a "one" is indicated by the presence of a conductive dot, and a "zero" is indicated by the absence of a conductive dot.

The example embodiments disclosed herein may be employed for the electrical connection and packaging of annular ultrasound transducers in which cost and size are reduced or minimized. In some implementations, size and/or cost reduction may be achieved through the use of a kerfless annular array, and/or the use of a sparse annular array. A sparse annular array is an annular array in which the annular electrodes are thin with relative large gaps separating them. For example, a sparse annular array may be defined as an annular array for which the annular electrodes cover less than half of the transducer surface within the region bounded by the outer annular ring. In one embodiment, this has the effect of reducing the variance in delay across each element for a given depth, thereby lowering the level of secondary lobes, which limit the dynamic range (contrast) in the image. In one embodiment, this has the effect of shortening the phase shift across each element for a given depth, thereby directly lowering the level of secondary lobes, which limit the dynamic range (contrast) in the image.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An ultrasound device comprising:

an ultrasound transducer comprising an annular ultrasound array, wherein said annular ultrasound array is defined at least in part by a plurality of concentric annular electrodes provided on a first surface of a piezoelectric layer, and wherein a ground plane electrode is provided on a second surface of said piezoelectric layer;

a peripheral support ring surrounding at least a portion of said ultrasound transducer, wherein said peripheral support ring is electrically conductive;

a flexible printed circuit board comprising:

an elongate flexible segment; and a distribution segment that is in contact with at least a portion of said peripheral support ring, such that a plurality of conductive paths extending through said elongate flexible segment are routed through said distribution segment to respective contact pads located at different locations on said peripheral support ring;

wherein each of the plurality of concentric annular electrodes is electrically connected to a respective contact pad;

wherein at least one conductive path of said flexible printed circuit board is a ground conductive path that is in electrical contact with said ground plane electrode, and a backing material contacting and extending from said first surface, wherein a distal portion of said elongate flexible segment is encapsulated in said backing material, such that said distal portion of said elongate flexible segment extends inwardly from said peripheral support ring and bends outwardly away from said first surface, within said backing material, without contacting a wire bond and without contacting said first surface.

2. The ultrasound device according to claim 1 wherein said plurality of conductive paths are routed bi-directionally within said distribution segment.

3. The ultrasound device according to claim 1 wherein said distal portion of said elongate flexible segment is bent, within said backing material, over an angle ranging between 90 degrees and 180 degrees relative to said first surface.

4. The ultrasound device according to claim 1 wherein an initial radius of curvature of said distal portion of said elongate flexible segment is less than 8 mm.

5. The ultrasound device according to claim 1 wherein a contact surface of said peripheral support ring that contacts said distribution segment is spatially offset from said first surface.

6. The ultrasound device according to claim 1 wherein said elongate flexible segment extends outwardly from said peripheral support ring.

7. The ultrasound device according to claim 1 wherein said peripheral support ring has a transverse width of less than 1 mm.

8. The ultrasound device according to claim 1 wherein said peripheral support ring completely surrounds said ultrasound transducer.

9. The ultrasound device according to claim 1 and wherein said peripheral support ring is in electrical communication with said ground conductive path and said ground plane electrode.

10. The ultrasound device according to claim 1 wherein said plurality of concentric annular electrodes are provided in a sparse configuration, thereby defining a sparse annular ultrasound array.

11. The ultrasound device according to claim 1 wherein said ultrasound transducer is disc shaped, and wherein said peripheral support ring is at least a portion of an annulus.

12. The ultrasound device according to claim 11 wherein an outer diameter of said annulus is less than 10 mm.

13. The ultrasound device according to claim 1 wherein said elongate flexible segment is encapsulated within said backing material and emerges from a distal surface of said backing material without extending beyond a side surface of said backing material.

14. The ultrasound device according to claim 13 wherein said elongate flexible segment emerges from said backing material at an angle of 90 degrees relative to said first surface.

15. The ultrasound device according to claim 13 wherein said elongate flexible segment emerges from said backing material at an angle of greater than or equal to 90 degrees relative to said first surface.

16. The ultrasound device according to claim 1 wherein said distal portion of said elongate flexible segment comprises a plurality of branched distal segments that contact said peripheral support ring at different locations with gaps defined therebetween.

17. The ultrasound device according to claim 16 wherein one or more wire bonds are formed within each gap.

18. The ultrasound device according to claim 16 wherein one or more of said plurality of branched distal segments include only two conductive paths.

19. The ultrasound device according to claim 18 wherein said two conductive paths are bi-directionally routed to different contact pads.

* * * * *